US006955871B2

(12) United States Patent
Matsumoto et al.

(10) Patent No.: US 6,955,871 B2
(45) Date of Patent: Oct. 18, 2005

(54) LIGHTSENSITIVE MATERIAL PACKAGE

(75) Inventors: Keisuke Matsumoto, Minami-Ashigara (JP); Koichi Yokota, Minami-Ashigara (JP); Ryoji Nishimura, Minami-Ashigara (JP); Hisashi Mikoshiba, Minami-Ashigara (JP); Mitsuro Kamata, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 266 days.

(21) Appl. No.: 09/964,588

(22) Filed: Sep. 28, 2001

(65) Prior Publication Data

US 2003/0017427 A1 Jan. 23, 2003

(30) Foreign Application Priority Data

Sep. 29, 2000 (JP) ..... 2000-299230
Sep. 29, 2000 (JP) ..... 2000-299231
Apr. 3, 2001 (JP) ..... 2001-104710

(51) Int. Cl.[7] ..... G03C 1/005
(52) U.S. Cl. ..... 430/567; 430/569; 430/501; 430/505
(58) Field of Search ..... 430/567, 501, 430/505

(56) References Cited

U.S. PATENT DOCUMENTS 4,433,048 A 2/1984 Solberg et al.
5,827,584 A * 10/1998 Akao et al. ..... 428/35.7
5,906,813 A * 5/1999 Akao ..... 424/76.1
6,013,723 A * 1/2000 Akao ..... 524/577
6,461,803 B1 * 10/2002 Suga et al. ..... 430/505

FOREIGN PATENT DOCUMENTS

EP A2583778 2/1994
JP 2001-075242 * 3/2001 ..... G03C/7/20

OTHER PUBLICATIONS

English language abstract of JP 2001–075242.*

* cited by examiner

*Primary Examiner*—Amanda Walke
(74) *Attorney, Agent, or Firm*—Birch, Stewart, Kolasch & Birch, LLP

(57) ABSTRACT

A lightsensitive material package contains a silver halide color photographic lightsensitive material and a plastic material member. The photographic lightsensitive material has at least one red-sensitive, at least one green-sensitive and at least one blue-sensitive silver halide emulsion layer on a support. The plastic material member is constituted of a thermoplastic reclaimed resin. The photographic lightsensitive material and the plastic material member are arranged in a common gas-phase atmosphere and sealed in the package. 60% or more of the total projected area of silver halide grains contained in at least one of the red-, green- and blue-sensitive silver halide emulsion layers is occupied by tabular grains having an aspect ratio of 8.0 or more. The plastic material member is that produced from a resin to which a substance capable of adsorbing a substance having an adverse effect on a photographic property has been supplementally added prior to molding thereof.

20 Claims, 1 Drawing Sheet

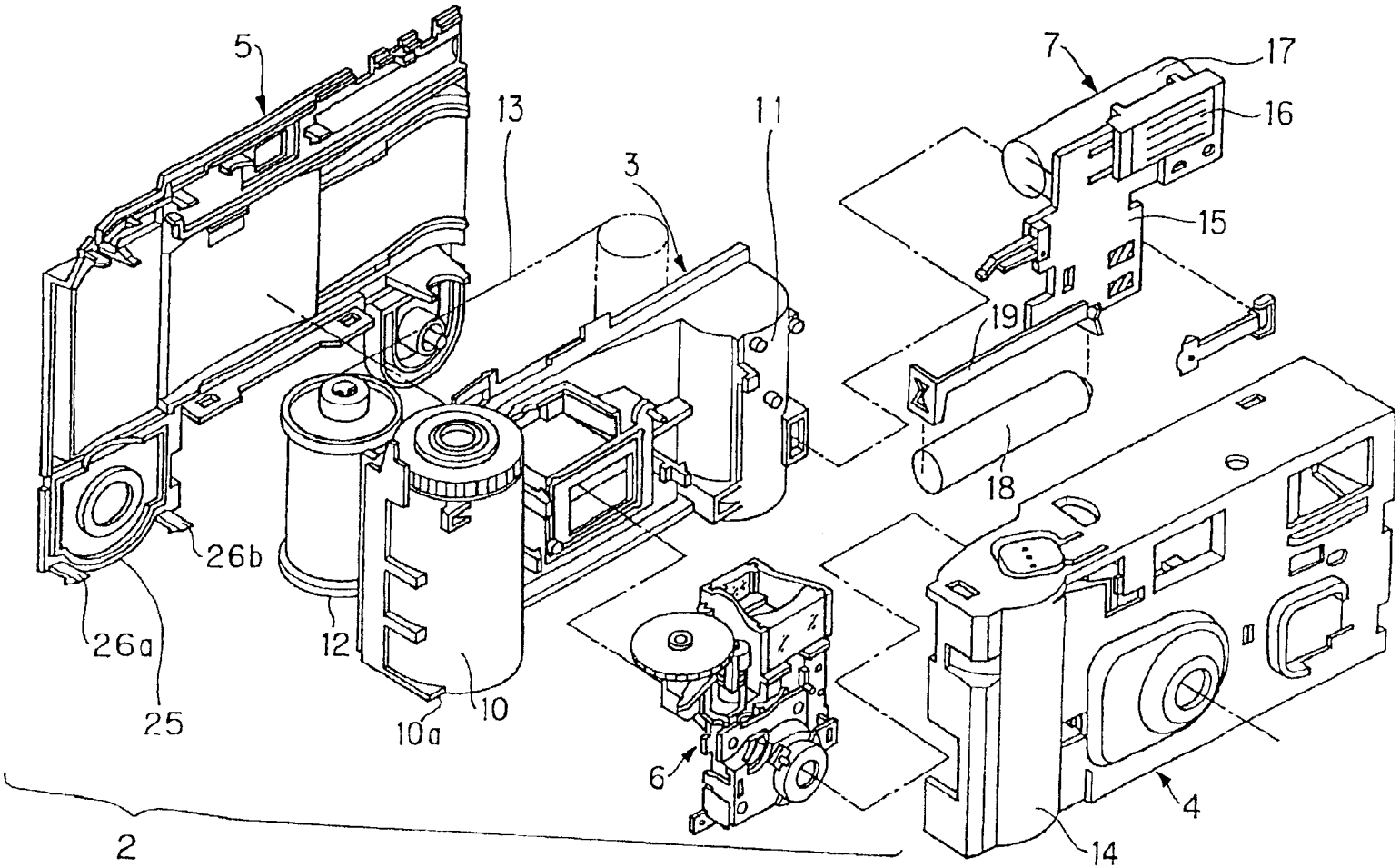
FIGURE

LIGHTSENSITIVE MATERIAL PACKAGE

CROSS-REFERENCE TO RELATED APPLICATIONS

This application is based upon and claims the benefit of priority from the prior Japanese Patent Applications No. 2000-299230, filed Sep. 29, 2000; No. 2000-299231, filed Sep. 29, 2000; and No. 2001-104710, filed Apr. 3, 2001, the entire contents of all of which are incorporated herein by reference.

BACKGROUND OF THE INVENTION

1. Field of the Invention

The present invention relates to a lightsensitive material package. More particularly, the present invention relates to a lightsensitive material package in which a color photographic lightsensitive material having an emulsion of high aspect ratio is arranged in a common gas phase atmosphere and sealed with recycled plastic material members constituted of reclaimed resins, the above reclaimed resins obtained through remelting of, for example, plastic material members made of thermoplastic resins.

2. Description of the Related Art

Reclaimed resins, as plastic material members, are used in, for example, a body of lens-fitted packaging unit and a spool or core of 35 mm patrone, and further used in, other than those accommodated together with a lightsensitive material, a photographic film case and other accommodating items. Further description will be made with reference to a lightsensitive material packaging unit including a built-in color negative photographic lightsensitive material and furnished with an exposure function (known as a lens-fitted film), now widespread for its convenience.

Generally, the cartridge of lens-fitted lightsensitive material packaging unit is produced by molding a high impact polystyrene resin comprising a polystyrene resin (hereinafter referred to as "PS resin") to which a butadiene rubber polymerization has been carried out to thereby impart impact resistance, which high impact PS resin contains carbon black for light shielding and various additives for moldability enhancement. This cartridge of lens-fitted lightsensitive material packaging unit, because of its built-in photographic film, is constituted of resins selected with the care that there should be no fogging or abnormal sensitivity attributed to gases released from impurities or resin ingredients contained therein.

Each lens-fitted lightsensitive material packaging unit, after photographing, is sent to a laboratory, where the film having undergone photographing is taken out, developed and fixed on a photographic paper. The packaging unit from which the photographic film has been removed, for the purpose of environmental protection and resource saving, is collected, converted to reclaimed resins through steps such as disassembly, classification, crushing and melting, and reutilized as a molding material for the cartridge of lens-fitted lightsensitive material packaging unit or the like.

With respect to reclaimed resins, the use thereof in parts brought into contact with the photographic film has been restricted because of the reclamation from products collected on the market, in particular because of the concern about any increase of the occurrence of photographically harmful substances attributed to resin pyrolysis by an increase of heat history and also the concern about the inclusion of substances harmful to photographic film as described in Jpn. Pat. Appln. KOKAI Publication No. (hereinafter referred to as JP-A-) 5-165154.

With respect to harmful substances from thermoplastic resins which have adverse effects on photographic lightsensitive materials, it is presumed that, as described in JP-A's-6-130565 and 6-67356, aldehydes, ketones, free sulfur, cyanide and other compounds resulting from resin pyrolysis are gasified and adsorbed on film surface to thereby denature the silver halides of the film with the result that the photographic properties are changed.

The generation of harmful substances from such resins would be attributable to carbon black, various additives and rubber components and, with respect to reclaimed resins, to impurities adhered thereto on the market.

As a result of practical fogging tests of a high-speed lightsensitive material, i.e., a lightsensitive material of high silver content accommodated in moldings of the same configuration but constituted of a reclaimed resin on the one hand and a virgin resin on the other hand, it has been found that no adverse effect is exerted in the use of a virgin resin while an adverse effect disenabling any practical use occurs in the use of a reclaimed resin.

With respect to gases which are harmful to photographic films, it is described in JP-A-6-130565 that, the greater the heat history frequency at molding or extrusion in the presence of an antioxidant, the greater the evaporation of impurities, so that the amount of antioxidant is less in the reclaimed resin than in the virgin resin. This would reflect that, with respect to the reclaimed resin, the heat history is increased to thereby reduce the amount of antioxidant and cause new photographically harmful gases to occur from the PS resin containing rubber components. Further, it is described in JP-A-6-67356 that harmful substances are suppressed by the addition of an antioxidant or the like. However, in the use of reclaimed resin, the above component reduction occurs with the result that the effect exerted by the virgin resin is diminished.

On the other hand, a speed increase of lightsensitive material has been and is demanded for enhancing the quality of image obtained by the lens-fitted lightsensitive material packaging unit. Various researches for improvement have been carried out in order to attain a photographic speed increase. With respect to the use of tabular emulsion, U.S. Pat. No. 4,433,048 discloses a particular process for producing tabular silver halide grains and a method of using the same. It is known that the configuration of tabular grains is advantageous in, for example, improvement as to the relationship of photographic speed/graininess, sharpness enhancement attributed to specific optical characteristics of tabular grains and increase of covering power. Such a technology that high speed, enhanced graininess and sharpness and excellent pressure resistance can simultaneously be attained by the use of tabular grains of 5 or more aspect ratio having dislocation lines in a lightsensitive material of 320 or more ISO speed in an emulsion layer most remote from its support is disclosed in JP-A-5-341459.

However, the problem that the use of tabular silver halide grains of 8 or more aspect ratio in a high-speed layer for the purpose of photographic speed increase and image quality enhancement invites fogging of lightsensitive material, especially an increase of fogging by prolonged storage, has surfaced. Attaining an improvement on this problem is now an important task.

Moreover, with respect to the deterioration of photographic properties by harmful substances in the lens-fitted lightsensitive material packaging unit which includes the above reclaimed resin, the greater the speed of lightsensitive material, the greater the influence of harmful substances on the lightsensitive material. Therefore, in particular, the use of reclaimed resin has been restricted in the lens-fitted lightsensitive material packaging unit wherein a high-speed lightsensitive material is accommodated.

BRIEF SUMMARY OF THE INVENTION

It is an object of the present invention to provide a lightsensitive material package wherein a molding containing a substance capable of adsorbing harmful substances, in particular gasified harmful substances, in reclaimed resins or capable of suppressing the occurrence thereof, which molding has thus no adverse effects on photographic lightsensitive materials, in particular a photographic lightsensitive material of high-speed film, a lightsensitive material of high silver content and a lightsensitive material of large film thickness, is accommodated in order to expand the use of reclaimed resins in plastic material members.

This object can be attained by the following means.

(1) A lightsensitive material package containing a silver halide color photographic lightsensitive material and a plastic material member, wherein the photographic lightsensitive material having at least one red-sensitive, at least one green-sensitive and at least one blue-sensitive silver halide emulsion layer on a support; the plastic material member being constituted of a thermoplastic reclaimed resin, and the photographic lightsensitive material and the plastic material member being arranged in a common gas-phase atmosphere and sealed in the package;

wherein 60% or more of the total projected area of silver halide grains contained in at least one of the red-, green- and blue-sensitive silver halide emulsion layers is occupied by tabular silver halide grains having an aspect ratio of 8.0 or more, and wherein the plastic material member is that produced from a resin to which a substance capable of adsorbing a substance having an adverse effect on a photographic property has been supplementally added prior to molding thereof.

(2) The lightsensitive material package according to item (1) above, wherein the tabular silver halide grains each have 10 or more dislocation lines per grain.

(3) The lightsensitive material package according to item (1) or (2) above, wherein the tabular silver halide grains each have two or more twin planes having a twin plane spacing of 0.020 $\mu$m or less.

(4) The lightsensitive material package according to any of items (1) to (3) above, wherein the photographic lightsensitive material has an ISO speed of 640 or more.

(5) The lightsensitive material package according to any of items (1) to (4) above, wherein the silver halide color photographic lightsensitive material has a silver content of 6 to 10 g/m$^2$.

(6) The lightsensitive material package according to any of items (1) to (5) above, wherein the total thickness of all hydrophilic colloid layers of the photographic lightsensitive material on its side of the lightsensitive silver halide layers, is 22 $\mu$m or more.

(7) A lightsensitive material package containing a silver halide color photographic lightsensitive material and a plastic material member, wherein the photographic lightsensitive material having at least one red-sensitive, at least one green-sensitive and at least one blue-sensitive silver halide emulsion layer on a support; the plastic material member being constituted of a thermoplastic reclaimed resin; and the photographic lightsensitive material and the plastic material being arranged in a common gas-phase atmosphere and sealed in the package;

wherein 60% or more of the total projected area of silver halide grains contained in at least one of the red-, green- and blue-sensitive silver halide emulsion layers is occupied by tabular silver halide grains having an aspect ratio of 8.0 or more; and wherein the plastic material member is that produced from a resin to which a compound represented by the following general formula (TS-I) and/or (TS-II) has been supplementally added prior to molding thereof.

(TS-I)

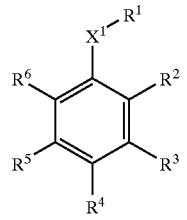

(TS-II)

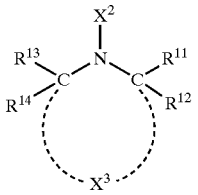

In the formula (TS-I), $R^1$ represents a hydrogen atom, a substituted or unsubstituted alkyl group (including cycloalkyl and bicycloalkyl groups), substituted or unsubstituted alkenyl group (including cycloalkenyl and bicycloalkenyl groups), substituted or unsubstituted aryl group, substituted or unsubstituted heterocyclic group, substituted or unsubstituted acyl group, substituted or unsubstituted alkoxycarbonyl group (including those whose alkyl moiety is cycloalkyl or bicycloalkyl), substituted or unsubstituted aryloxycarbonyl group, substituted or unsubstituted alkylsulfonyl group (including cycloalkylsulfonyl and bicycloalkylsulfonyl groups), substituted or unsubstituted arylsulfonyl group, substituted or unsubstituted phosphino group, substituted or unsubstituted phosphinoyl group, or a group of the formula —Si($R^{21}$)($R^{22}$)($R^{23}$), wherein each of $R^{21}$, $R^{22}$ and $R^{23}$ independently represents a substituted or unsubstituted alkyl group, substituted or unsubstituted aryl group, substituted or unsubstituted alkoxy group, substituted or unsubstituted alkenyloxy group, or substituted or unsubstituted aryloxy group; —$X^1$— represents —O—, —S— or —N($R^{24}$)—, wherein $R^{24}$ has the same meaning as $R^1$; and $R^2$, $R^3$, $R^4$, $R^5$ and $R^6$ may be the same or different from each other, and each thereof represents a hydrogen atom or a substituent, provided that $R^1$ and $R^2$, or $R^{24}$ and $R^6$, or $R^1$ and $R^{24}$, may be bonded with each other to thereby form a 5- to 7-membered ring, provided that $R^2$ and $R^3$, or $R^3$ and $R^4$, or $R^4$ and $R^5$, or $R^5$ and $R^6$, may be bonded with each other to thereby form a 5- to 7-membered ring, or spiro ring or bicyclo ring, and provided that $R^1$, $R^2$, $R^3$, $R^4$, $R^5$, $R^6$ and $R^{24}$ are not simultaneously hydrogen atoms.

In the formula (TS-II), each of $R^{11}$, $R^{12}$, $R^{13}$ and $R^{14}$ independently represents a hydrogen atom, an alkyl group (including cycloalkyl and bicycloalkyl groups), or alkenyl group (including cycloalkenyl and bicycloalkenyl groups), provided that $R^{11}$ and $R^{12}$, or $R^{13}$ and $R^{14}$, may be bonded with each other to thereby form a 5- to 7-membered ring; $X^2$ represents a hydrogen atom, an alkyl group (including cycloalkyl and bicycloalkyl groups), alkenyl group (including cycloalkenyl and bicycloalkenyl groups), alkoxy group (including cycloalkyloxy and bicycloalkyloxy groups), alkenyloxy group (including cycloalkyenyloxy and bicycloalkenyloxy groups), alkyl- and alkenyloxycarbonyl groups (including those whose alkyl moiety is cycloalkyl and bicycloalkyl, and those whose alkenyl moiety is cycloalkenyl and bicycloalkenyl), aryloxycarbonyl group, acyl group, acyloxy group, alkyloxycarbonyloxy group (including those whose alkyl moiety is cycloalkyl and bicycloalkyl), alkenyloxycarbonyloxy group (including those whose alkenyl moiety is cycloalkyenl and bicycloalkyenyl), aryloxycarbonyloxy group, alkyl- and alkenylsulfonyl groups (including those whose alkyl moiety is cycloalkyl and bicycloalkyl, and those whose alkenyl moiety is cycloalkenyl and bicycloalkenyl), arylsulfonyl group, alkyl- and alkenylsulfinyl groups (including those whose alkyl moiety is cycloalkyl and bicycloalkyl, and those whose alkenyl moiety is cycloalkenyl and bicycloalkenyl), arylsulfinyl group, sulfamoyl group, carbamoyl group, hydroxyl group, or oxy radical group; and $X^3$ represents a group of nonmetallic atoms required for forming a 5- to 7-membered ring.

(8) The lightsensitive material package according to item (7) above, wherein the tabular silver halide grains each have 10 or more dislocation lines per grain.

(9) The lightsensitive material package according to item (7) or (8) above, wherein the tabular silver halide grains each have two or more twin planes having a twin plane spacing of 0.020 $\mu$m or less.

(10) The lightsensitive material package according to any of items (7) to (9) above, wherein the photographic lightsensitive material has an ISO speed of 640 or more.

(11) The lightsensitive material package according to any of items (7) to (10) above, wherein the silver halide color photographic lightsensitive material has a silver content of 6 to 10 g/m$^2$.

(12) The lightsensitive material package according to any of items (7) to (11) above, wherein the total thickness of all hydrophilic colloid layers of the photographic lightsensitive material on its side of the lightsensitive silver halide layers, is 22 $\mu$m or more.

(13) The lightsensitive material package according to any of items (1) to (6) above, wherein the plastic material member is that produced from a resin to which a compound represented by the general formula (TS-I) and/or (TS-II) indicated in item (7) above has been supplementally added prior to molding thereof.

(14) The lightsensitive material package according to any of items (7) to (12) above, wherein the plastic material member is that produced from a resin to which a substance capable of adsorbing a substance having an adverse effect on a photographic property has been supplementally added prior to molding thereof.

(15) The lightsensitive material package according to any of items (1) to (6) and (14) above, wherein the substance capable of adsorbing a substance having adverse effects on photographic properties is carbon black having an acetaldehyde gas equilibrium adsorption amount of 2 mg/g or more.

(16) The lightsensitive material package according to any of items (7) to (15) above, wherein the compound represented by the general formula (TS-I) or (TS-II) has a molecular weight of 300 or more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

Single FIGURE is an exploded perspective view of lens-fitted film unit which constitutes one form of the lightsensitive material package of the present invention.

DETAILED DESCRIPTION OF THE INVENTION

The present invention will be explained in more detail below.

The compound represented by the following general formula (TS-I) or (TS-II) will be explained in detail:

(TS-I)

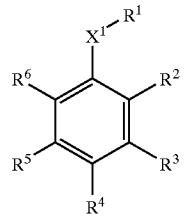

(TS-II)

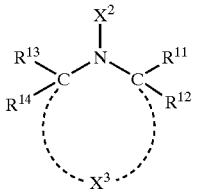

wherein in the formula (TS-I), $R^1$ represents a hydrogen atom; a substituted or unsubstituted alkyl group (including cycloalkyl and bicycloalkyl groups), (preferably those having 1 to 30 carbon atoms, e.g., methyl, ethyl, n-butyl, cyclohexyl, and bicyclo[1,2,2]heptan-2-yl); substituted or unsubstituted alkenyl group (including cycloalkenyl and bicycloalkenyl groups) (preferably those having 3 to 30 carbon atoms, e.g., allyl, geranyl, and 2-cyclohexen-1-yl); substituted or unsubstituted aryl group (preferably those having 6 to 30 carbon atoms, e.g., phenyl, p-tolyl); substituted or unsubstituted heterocyclic group (preferably 5- or 6-membered, substituted or unsubstituted, aromatic or non-aromatic heterocycle from which a hydrogen atom is removed, more preferably, 5- or 6-membered aromatic heterocycle having 3 to 30 carbon atoms from which a hydrogen atom is removed, e.g., 2-furyl, 2-thienyl, and 2-pyrimidinyl); substituted or unsubstituted acyl group (preferably those having 1 to 30 carbon atoms, e.g., formyl, acetyl, and pivaloyl); substituted or unsubstituted alkoxycarbonyl group (preferably those having 2 to 30 carbon atoms, e.g., methoxycarbonyl, ethoxycarbonyl, and decyloxycarbonyl); substituted or unsubstituted aryloxycarbonyl group (preferably those having 7 to 30 carbon atoms, e.g., phenoxycarbonyl); substituted or unsubstituted alkylsulfonyl group (including cycloalkylsulfonyl and bicycloalkylsulfonyl) (preferably those having 1 to 30 carbon atoms, e.g., methanesulfonyl, ethanesulfonyl, and cyclohexylsulfonyl); substituted or unsubstituted arylsulfonyl group (preferably those having 6 to 30 carbon atoms e.g., toluenesulfonyl, and benzenesulfonyl), substituted or unsubstituted phosphino group (preferably those having 0 to 30 carbon atoms, e.g., diphenylphosphino); substituted or unsubstituted phosphinoyl group (preferably those having 0 to 30 carbon atoms, e.g., diphenylphosphinoyl); or —$SiR^{21}R^{22}R^{23}$, wherein each of $R^{21}$, $R^{22}$ and $R^{23}$ independently represents a substituted or unsubstituted alkyl group (preferably those having 1 to 30 carbon atoms, e.g., methyl), substituted or unsubstituted aryl group (preferably those having 6 to 30 carbon atoms, e.g., phenyl), substituted or unsubstituted alkoxy group (preferably those having 1 to 30 carbon atoms, e.g., methoxy), substituted or unsubstituted alkenyloxy group (preferably those having 3 to 30 carbon atoms, e.g., geranyloxy), or substituted or unsubstituted aryloxy group (preferably those having 6 to 30 carbon atoms, e.g., phenoxy).

$R^2$, $R^3$, $R^4$, $R^5$ and $R^6$ independently represent a hydrogen, or halogen atom; or an alkyl group (including cycloalkyl and bicycloalkyl groups); alkenyl group (including cycloalkenyl and bicycloalkenyl groups); alkynyl group; aryl group; heterocyclic group; cyano group; hydroxyl group; nitro group; carboxyl group; alkoxy group; aryloxy group; silyloxy group; heterocyclic oxy group; acyloxy group; carbamoyloxy group; alkoxycarbonyloxy group; aryloxycarbonyloxy group; amino group (including an anilino group); acylamino group; aminocarbonylamino group; alkoxycarbonylamino group; aryloxycarbonylamino group; sulfamoylamino group; alkyl- and arylsulfonylamino groups; mercapto group; alkylthio group; arylthio group; heterocyclic thio group; sulfamoyl group; sulfo group; alkyl- and arylsulfinyl groups; alkyl- and arylsulfonyl groups; acyl group; aryloxycarbonyl group; alkoxycarbonyl group; carbamoyl group; aryl- and heterocyclic azo groups; imido group; phosphino group; phosphinyl group; phosphinyloxy group; phosphinylamino group; or silyl group.

More specifically, $R^2$, $R^3$, $R^4$, $R^5$ and $R^6$ independently represent a hydrogen atom; or a halogen atom (e.g., a chlorine atom, bromine atom, and iodine atom); or an alkyl group {which represents a straight-chain, branched, or cyclic, substituted or unsubstituted alkyl group. Examples are an alkyl group (preferably those having 1 to 30 carbon atoms, e.g., methyl, ethyl, n-propyl, isopropyl, t-butyl, n-octyl, eicosyl, 2-chloroethyl, 2-cyanoethyl, and 2-ethylhexyl), a cycloalkyl group (preferably substituted or unsubstituted cycloalkyl group having 3 to 30 carbon atoms, e.g., cyclohexyl, cyclopentyl, and 4-n-dodecylcyclohexyl), a bicycloalkyl group (preferably a substituted or unsubstituted bicycloalkyl group having 5 to 30 carbon atoms, i.e., a monovalent group obtained by removing one hydrogen atom from a bicycloalkane having 5 to 30 carbon atoms. Examples are bicyclo[1,2,2]heptane-2-yl and bicyclo[2,2,2)octane-3-yl). Also an alkyl group having more cyclic structure such as a tricyclic alkyl group is included. The alkyl group to be described below, such as the alkyl group of an alkylthio group, also includes the concept of the alkyl group mentioned above.}.

$R^2$, $R^3$, $R^4$, $R^5$ and $R^6$ independently also represent alkenyl group {which represents a straight-chain, branched, or cyclic, substituted or unsubstituted alkenyl group. Examples are an alkenyl group (preferably a substituted or unsubstituted alkenyl group having 2 to 30 carbon atoms, e.g., vinyl, allyl, prenyl, geranyl, and oleyl), cycloalkenyl group (preferably a substituted or unsubstituted cycloalkenyl group having 3 to 30 carbon atoms, i.e., a monovalent group obtained by removing one hydrogen atom from a cycloalkene having 3 to 30 carbon atoms. Examples are 2-cyclopentene-1-yl and 2-cyclohexene-1-yl), bicycloalkenyl group (a substituted or unsubstituted bicycloalkenyl group, preferably a substituted or unsubstituted bicycloalkenyl group having 5 to 30 carbon atoms, i.e., a monovalent group obtained by removing one hydrogen atom from bicycloalkene having one double bond. Examples are bicyclo[2,2,1]hept-2-ene-1-yl and bicyclo[2,2,2]oct-2-ene-4-yl)}.

$R^2$, $R^3$, $R^4$, $R^5$ and $R^6$ independently also represent an alkynyl group (preferably a substituted or unsubstituted alkynyl group having 2 to 30 carbon atoms, e.g., ethynyl, propargyl, and trimethylsilylethynyl); aryl group (preferably a substituted or unsubstituted aryl group having 6 to 30 carbon atoms, e.g., phenyl, p-tolyl, naphthyl, m-chlorophenyl, and o-hexadecanoylaminophenyl); heterocyclic group (preferably a monovalent group obtained by removing one hydrogen atom from a 5- or 6-membered, substituted or unsubstituted, aromatic or nonaromatic heterocyclic compound, and more preferably, a 5- or 6-membered aromatic heterocyclic group having 3 to 30 carbon atoms. Examples are 2-furyl, 2-thienyl, 2-pyrimidinyl, and 2-benzothiazolyl); cyano group; hydroxyl group; nitro group; carboxyl group; and alkoxy group (preferably a substituted or unsubstituted alkoxy group having 1 to 30 carbon atoms, e.g., methoxy, ethoxy, isopropoxy, t-butoxy, n-octyloxy, and 2-methoxyethoxy).

$R^2$, $R^3$, $R^4$, $R^5$ and $R^6$ independently also represent an aryloxy group (preferably a substituted or unsubstituted aryloxy group having 6 to 30 carbon atoms, e.g., phenoxy, 2-methylphenoxy, 4-t-butylphenoxy, 3-nitrophenoxy, and 2-tetradecanoylaminophenoxy), silyloxy group (preferably a silyloxy group having 3 to 20 carbon atoms, e.g., trimethylsilyloxy and t-butyldimethylsilyloxy); heterocyclic oxy group (preferably a substituted or unsubstituted heterocyclic oxy group having 2 to 30 carbon atoms, e.g., 1-phenyltetrazole-5-oxy and 2-tetrahydropyranyloxy); and acyloxy group (preferably a formyloxy group, a substituted or unsubstituted alkylcarbonyloxy group having 2 to 30 carbon atoms, and a substituted or unsubstituted arylcarbonyloxy group having 7 to 30 carbon atoms, e.g., formyloxy, acetyloxy, pivaloyloxy, stearoyloxy, benzoyloxy, and p-methoxyphenylcarbonyloxy).

$R^2$, $R^3$, $R^4$, $R^5$ and $R^6$ independently also represent a carbamoyloxy group (preferably a substituted or unsubstituted carbamoyloxy group having 1 to 30 carbon atoms, e.g., N,N-dimethylcarbamoyloxy, N,N-diethylcarbamoyloxy, morpholinocarbonyloxy, N,N-di-n-octylaminocarbonyloxy, and N-n-octylcarbamoyloxy); alkoxycarbonyloxy group (preferably a substituted or unsubstituted alkoxycarbonyloxy group having 2 to 30 carbon atoms, e.g., methoxycarbonyloxy, ethoxycarbonyloxy, t-butoxycarbonyloxy, and n-octylcarbonyloxy); and aryloxycarbonyloxy group (preferably a substituted or unsubstituted aryloxycarbonyloxy group having 7 to 30 carbon atoms, e.g., phenoxycarbonyloxy, p-methoxyphenoxycarbonyloxy, and p-(n-hexadecyloxy) phenoxycarbonyloxy).

$R^2$, $R^3$, $R^4$, $R^5$ and $R^6$ independently also represent an amino group (preferably an unsubstituted amino group, a substituted or unsubstituted alkylamino group having 1 to 30 carbon atoms, and a substituted or unsubstituted anilino group having 6 to 30 carbon atoms, e.g., amino, methylamino, dimethylamino, anilino, N-methyl-anilino, and diphenylamino); acylamino group (preferably a formylamino group, a substituted or unsubstituted alkylcarbonylamino group having 2 to 30 carbon atoms, and a substituted or unsubstituted arylcarbonylamino group having 7 to 30 carbon atoms, e.g., formylamino, acetylamino, pivaloylamino, lauroylamino, benzoylamino, and 3,4,5-tri-(n-octyloxyphenyl)carbonylamino); and aminocarbonylamino group (preferably a substituted or unsubstituted aminocarbonylamino having 1 to 30 carbon atoms, e.g., carbamoylamino, N, N-dimethylaminocarbonylamino, N,N-diethylaminocarbonylamino, and morpholinocarbonylamino).

$R^2$, $R^3$, $R^4$, $R^5$ and $R^6$ independently also represent an alkoxycarbonylamino group (preferably a substituted or unsubstituted alkoxycarbonylamino group having 2 to 30 carbon atoms, e.g., methoxycarbonylamino, ethoxycarbonyiamino, t-butoxycarbonylamino, n-octadecyloxycarbonylamino, and N-methylmethoxycarbonylamino); aryloxycarbonylamino group (preferably a substituted or unsubstituted aryloxycarbonylamino group having 7 to 30 carbon atoms, e.g., phenoxycarbonylamino, p-chlorophenoxycarbonylamino, and m-(n-octyloxy)phenoxycarbonylamino); sulfamoylamino group (preferably a substituted or unsubstituted sulfamoylamino group having 0 to 30 carbon atoms, e.g., sulfamoylamino, N,N-dimethylaminosulfonylamino, and N-n-octylaminosulfonylamino).

$R^2$, $R^3$, $R^4$, $R^5$ and $R^6$ independently also represent an alkylsulfonylamino and arylsulfonylamino groups (preferably a substituted or unsubstituted alkylsulfonylamino having 1 to 30 carbon atoms, and a substituted or unsubstituted arylsulfonylamino having 6 to 30 carbon atoms, e.g., methylsulfonylamino, butylsulfonylamino, phenylsulfonylamino, 2,3,5-trichlorophenylsulfonylamino, and p-methylphenylsulfonylamino); mercapto group; alkylthio group (preferably a substituted or unsubstituted alkylthio group having 1 to 30 carbon atoms, e.g., methylthio, ethylthio, and n-hexadecylthio); arylthio group (preferably a substituted or unsubstituted arylthio group having 6 to 30 carbon atoms, e.g., phenylthio, p-chlorophenylthio, and m-methoxyphenylthio); and heterocyclic thio group (preferably a substituted or unsubstituted heterocyclic thio group having 2 to 30 carbon atoms, to which an aromatic ring such as a benzene ring may be condensed, e.g., 2-benzothiazolylthio and 1-phenyl-tetrazole-5-ylthio).

$R^2$, $R^3$, $R^4$, $R^5$ and $R^6$ independently also represent a sulfamoyl group (preferably a substituted or unsubstituted sulfamoyl group having 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl); sulfo group; alkylsulfinyl and arylsulfinyl groups (preferably a substituted or unsubstituted alkylsulfinyl group having 1 to 30 carbon atoms, and a substituted or unsubstituted arylsulfinyl group having 6 to 30 carbon atoms, e.g., methylsulfinyl, ethylsulfinyl, phenylsulfinyl, and p-methylphenylsulfinyl).

$R^2$, $R^3$, $R^4$, $R^5$ and $R^6$ independently also represent an alkylsulfonyl and arylsulfonyl groups (preferably a substituted or unsubstituted alkylsulfonyl group having 1 to 30 carbon atoms, and a substituted or unsubstituted arylsulfonyl group having 6 to 30 carbon atoms, e.g., methylsulfonyl, ethylsulfonyl, phenylsulfonyl, and p-methylphenylsulfonyl); acyl group (preferably a formyl group, substituted or unsubstituted alkylcarbonyl group having 2 to 30 carbon atoms, a substituted or unsubstituted arylcarbonyl group having 7 to 30 carbon atoms, and a substituted or unsubstituted heterocycliccarbonyl group, whose carbon atom in the heterocyclic ring bonds to the carbonyl group thereof, e.g., acetyl, pivaloyl, 2-chloroacetyl, stearoyl, benzoyl, p-(n-octyloxy)phenylcarbonyl, 2-pyridylcarbonyl and 2-furylcarbonyl); aryloxycarbonyl group (preferably a substituted or unsubstituted aryloxycarbonyl group having 7 to 30 carbon atoms, e.g., phenoxycarbonyl, o-chlorophenoxycarbonyl, m-nitrophenoxycarbonyl, and p-(t-butyl)phenoxycarbonyl); and an alkoxycarbonyl group (e.g., a substituted or unsubstituted alkoxycarbonyl group having 2 to 30 carbon atoms, e.g., methoxycarbonyl, ethoxycarbonyl, t-butoxycarbonyl, and n-octadecyloxycarbonyl).

$R^2$, $R^3$, $R^4$, $R^5$ and $R^6$ independently also represent a carbamoyl group (preferably a substituted or unsubstituted carbamoyl having 1 to 30 carbon atoms, e.g., carbamoyl, N-methylcarbamoyl, N,N-dimethylcarbamoyl, N,N-di-(n-octyl)carbamoyl, and N-(methylsulfonyl)carbamoyl); arylazo and heterocyclic azo groups (preferably a substituted or unsubstituted arylazo group having 6 to 30 carbon atoms, and a substituted or unsubstituted heterocyclic azo group having 3 to 30 carbon atoms, e.g., phenylazo, p-chlorophenylazo, and 5-ethylthio-1,3,4-thiadiazole-2-ylazo); imido group (preferably N-succinimido and N-phthalimido); phosphino group (preferably a substituted or unsubstituted phosphino group having 2 to 30 carbon atoms, e.g., dimethylphosphino, diphenylphosphino, and methylphenoxyphosphino); and phosphinyl group (preferably a substituted or unsubstituted phosphinyl group having 0 to 30 carbon atoms, e.g., phosphinyl, dioctyloxyphosphinyl, and diethoxyphosphinyl).

$R^2$, $R^3$, $R^4$, $R^5$ and $R^6$ independently also represent a phosphinyloxy group (preferably a substituted or unsubstituted phosphinyloxy group having 2 to 30 carbon atoms, e.g., diphenoxyphosphinyloxy and dioctyloxyphosphinyloxy); phosphinylamino group (preferably a substituted or unsubstituted phosphinylamino group having 2 to 30 carbon atoms, e.g., dimethoxyphosphinylamino and dimethylaminophosphinylamino); and silyl group (preferably a substituted or unsubstituted silyl group having 3 to 30 carbon atoms, e.g., trimethylsilyl, t-butyldimethylsilyl, and phenyldimethylsilyl).

Of the above substituents, those having a hydrogen atom may be further substituted by the above groups by removing the hydrogen atom. Examples of such substituents are an alkylcarbonylaminosulfonyl group, arylcarbonylaminosulfonyl group, alkylsulfonylaminocarbonyl group, and arylsulfonylaminocarbonyl group. Examples of these groups are methylsulfonylaminocarbonyl, p-methylphenylsulfonylaminocarbonyl, acetylaminosulfonyl, and benzoylaminosulfonyl groups.

The structures of the formula (TS-1) are preferably those where $R^1$ is a hydrogen atom, a substituted or unsubstituted alkyl group having 1 to 30 carbon atoms (including cycloalkyl and bicycloalkyl groups); substituted or unsubstituted alkenyl group having 3 to 30 carbon atoms (including cycloalkenyl and bicycloalkenyl groups); or substituted or unsubstituted aryl group having 6 to 30 carbon atoms.

—$X^1$— is preferably —O—, or —N($R^{24}$)—, wherein $R^{24}$ is preferably a substituted or unsubstituted alkyl group having 1 to 30 carbon atoms.

Preferably, $R^2$, $R^3$, $R^4$, $R^5$ and $R^6$ may be the same or different from each other, and each thereof represents a hydrogen atom, a substituted or unsubstituted alkyl group having 1 to 30 carbon atoms, substituted or unsubstituted alkoxy group having 1 to 30 carbon atoms, substituted or unsubstituted acylamino group having 1 to 30 carbon atoms, or a halogen atom. $R^4$ is preferably a substituted or unsubstituted alkyl group having 1 to 30 carbon atoms, more preferably, an alkyl group having a total carbon atoms including those of a substituent attached thereto of 4 or more.

Among the compounds of the general formula (TS-I), those represented by the following formulae (TS-I-α) and (TS-I-β) are preferred:

(TS-1-α)

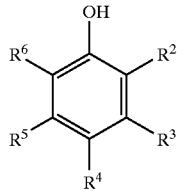

(TS-1-β)

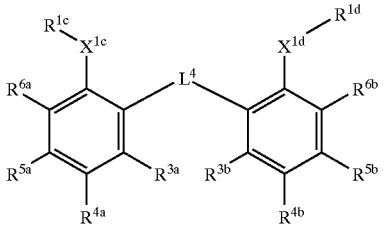

In the formula (TS-I-α), $R^2$, $R^3$, $R^5$ and $R^6$ each independently have the same meaning as the $R^2$, $R^3$, $R^5$ and $R^6$ of the general formula (TS-I).

In the formula (TS-I-β), $R^{3a}$, $R^{3b}$, $R^{4a}$, $R^{4b}$, $R^{5a}$, $R^{5b}$, $R^{6a}$ and $R^{6b}$ each independently have the same meaning as the $R^3$, $R^4$, $R^5$ and $R^6$ of the general formula (TS-I). $X^{1c}$ and $X^{1d}$ each independently have the same meaning as the $X^1$ of the general formula (TS-I). $R^{1c}$ and $R^{1d}$ each independently have the same meaning as the $R^1$ of the general formula (TS-I). $L^4$ represents a substituted or unsubstituted alkylene group having 1 to 20 carbon atoms.

Among the compounds of the formula (TS-I-α), those wherein each of $R^2$, $R^3$, $R^5$ and $R^6$ independently represents a hydrogen atom, a substituted or unsubstituted alkyl group having 1 to 20 carbon atoms, a halogen atom, a substituted or unsubstituted alkoxy group having 1 to 20 carbon atoms or an acylamino group having 1 to 20 carbon atoms are preferred. Among the preferable groups of $R^2$, $R^3$, $R^5$ and $R^6$, they independently represent more preferably a hydrogen atom, or a substituted or unsubstituted alkyl group having 1 to 8 carbon atoms.

Of the preferable structure of formula (TS-I-α), $R^6$ is preferably an unsubstitued tert-alkyl group having 3 to 8 carbon atoms, $R^5$ is a hydrogen atom, $R^4$ is a substituted or unsubstituted alkyl group having 1 to 30 carbon atoms, either $R^2$ or $R^3$ is a hydrogen atom, and the other is an alkyl group having 1 to 8 carbon atoms.

The compound having the structure of the formula (TS-I-β) is preferably those wherein each of $R^{3a}$, $R^{3b}$, $R^{4a}$, $R^{4b}$, $R^{5a}$, $R^{5b}$, $R^{6a}$ and $R^{6b}$ independently represents a hydrogen atom, a substituted or unsubstituted alkyl group having 1 to 20 carbon atoms, a halogen atom or an acylamino group having 1 to 20 carbon atoms. Preferably, each of $X^{1c}$ and $X^{1d}$ independently represents —O—. Further, preferably, each of $R^{1c}$ and $R^{1d}$ independently represents a hydrogen atom, a substituted or unsubstituted alkyl group having 1 to 20 carbon atoms, an acylamino group having 2 to 20 carbon atoms, or a substituted or unsubstituted alkenyl group having 3 to 20 carbon atoms. $L^4$ preferably represents an unsubstituted alkylene group having 1 to 20 carbon atoms.

More preferably, $R^{1c}$ and $R^{1d}$ simultaneously represent hydrogen atoms, and $R^{3a}$, $R^{3b}$, $R^{5a}$, and $R^{5b}$ simultaneously represent hydrogen atoms. $L^4$ more preferably represents an unsubstituted alkylene group having 1 to 8 carbon atoms.

More preferable compounds having the structure of formula (TS-I-β) are those in which $R^{4a}$, $R^{4b}$, $R^{6a}$, and $R^{6b}$ each independently represent unsubstituted alkyl group having 1 to 8 carbon atoms, all of $R^{1c}$, $R^{1d}$, $R^{3a}$, $R^{3b}$, $R^{5a}$ and $R^{5b}$ simultaneously represent hydrogen atoms, both of $X^{1c}$ and $X^{1d}$ represent —O—, and $L^4$ represents an unsubstituted alkylene group having 1 to 8 carbon atoms.

Among the compounds of the general formula (TS-II), those wherein each of $R^{11}$, $R^{12}$, $R^{13}$ and $R^{14}$ represents an unsubstituted alkyl group having 1 to 10 carbon atoms or an alkenyl group having 2 to 10 carbon atoms are preferred. More preferably, $R^{11}$, $R^{12}$, $R^{13}$ and $R^{14}$ are the same and represent an unsubstituted alkyl group having 1 to 3 carbon atoms. Still more preferably, $R^{11}$, $R^{12}$, $R^{13}$ and $R^{14}$ simultaneously represent a methyl group. $R^{11}$ and $R^{12}$, or $R^{13}$ and $R^{14}$, may be bonded with each other to thereby form a 5- to 7-membered ring. $X^2$ preferably represents any of a hydrogen atom, alkyl groups (including cycloalkyl and bicycloalkyl groups), alkenyl groups (including cycloalkenyl and bicycloalkenyl groups), alkoxy groups (including a cycloalkyloxy group), acyl groups, acyloxy groups, a hydroxyl group and oxy radical group. Among them, $X^2$ more preferably represents an unsubstituted alkoxy group having 1 to 20 carbon atoms (including a cycloalkyloxy group) or an oxy radical group. $X^3$ preferably represents an atom group required for forming a nitrogen-containing 6-membered ring, in which the number of the nitrogen atom is preferably 1 to 3, and more preferably 1. The cyclic ring that $X^3$ forms together with the nitrogen atom preferably have a substituent, and the position of the substituent is preferably para-position with respect to the nitrogen atom to which $X^2$ of the general formula (TS-II) attaches.

In a preferred form of the general formula (TS-II), $R^{11}$, $R^{12}$, $R^{13}$ and $R^{14}$ simultaneously represent a methyl group. $X^2$ represents an unsubstituted alkoxy group having 1 to 20 carbon atoms (including a cycloalkyloxy group) or an oxyl radical group. $X^3$ represents an atom group required for forming a nitrogen-containing 6-membered ring.

Among the compounds represented by the general formula (TS-I) or (TS-II), those represented by formula (TS-I) are preferable, and those represented by formula (TS-I-α) are more preferable.

The molecular weight of the compounds represented by general formula (TS-I) or (TS-II) is preferably 150 or more, more preferable 200 or more, and much more preferably 250 or more. Still much preferably the molecular weight is 300 or more. The molecular weight is preferably 1000 or less, more preferably 800 or less. Specific examples of the preventive agent represented by general formula (TS-I) or (TS-II) are set for the below, however the present invention is not limited to those.

S-1.
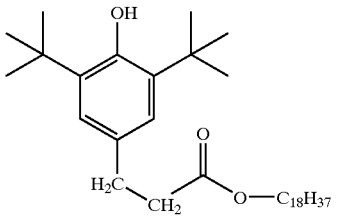
S-2.
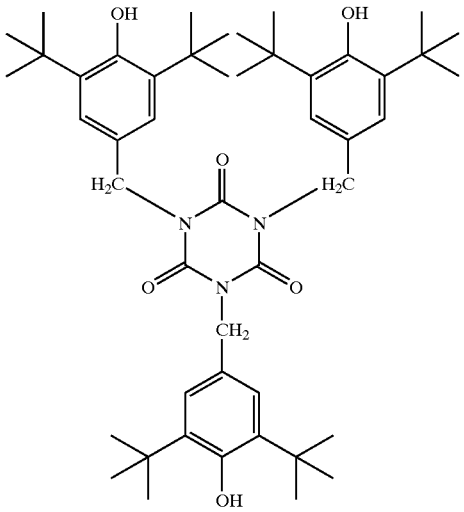
S-3.
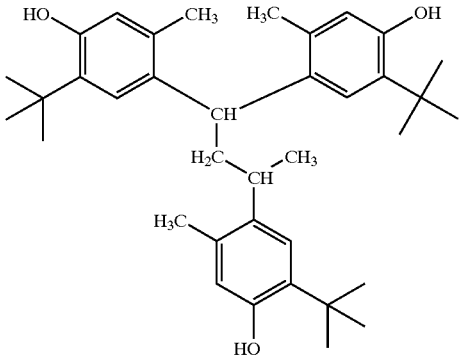
S-4.
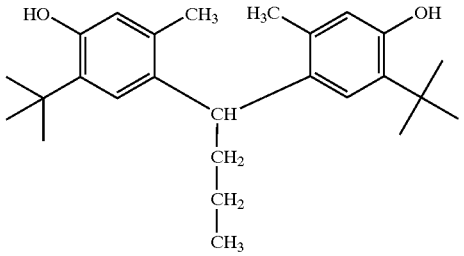
S-5.
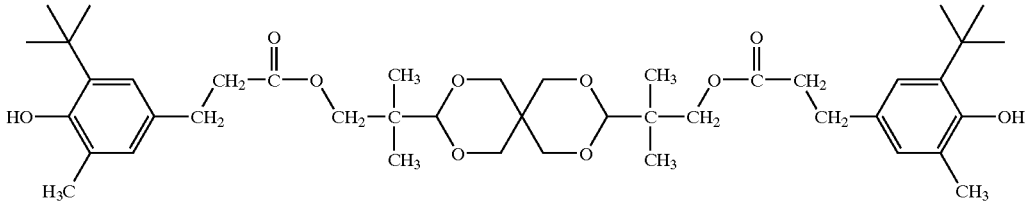
S-6.
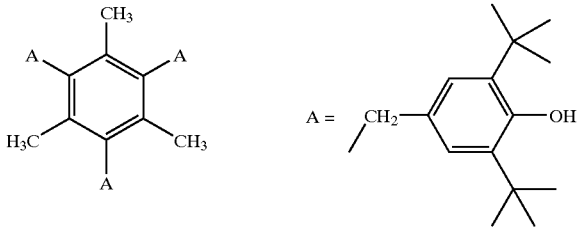
S-7.
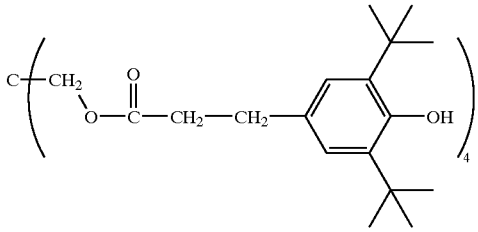
S-8.
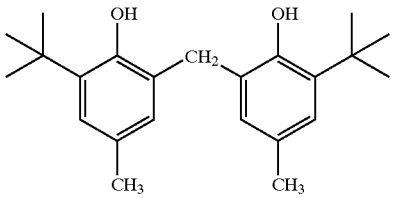
S-9.
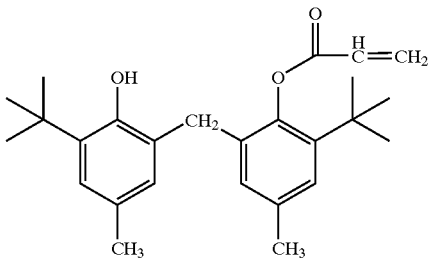

-continued
S-10.
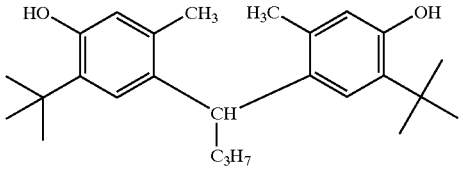
S-11.
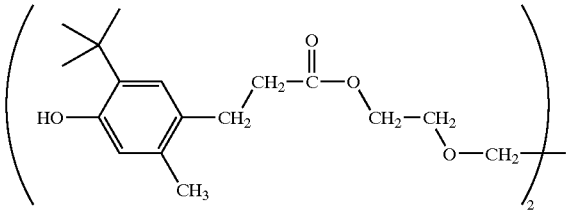
S-12.
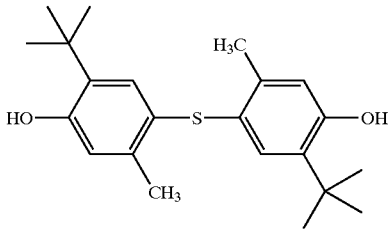
S-13.
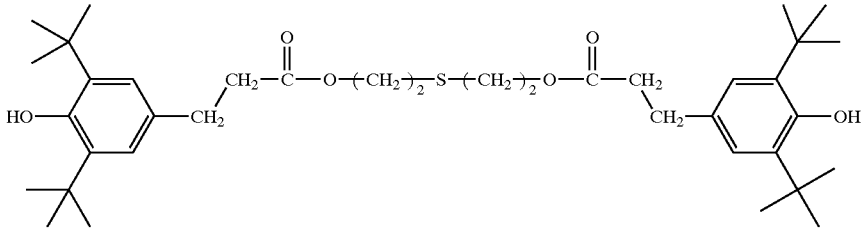
S-14.
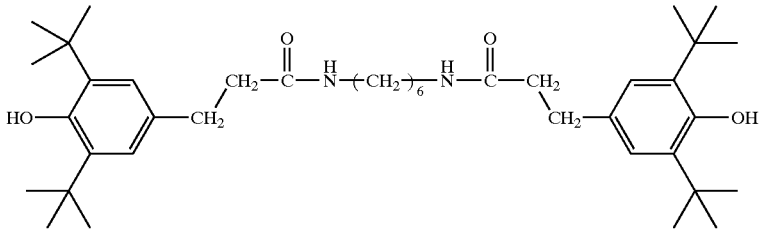
S-15.
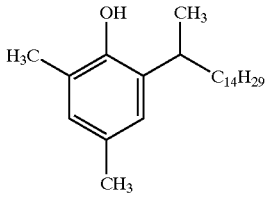
S-16.
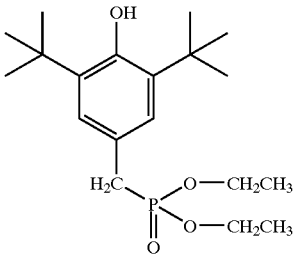
S-17.
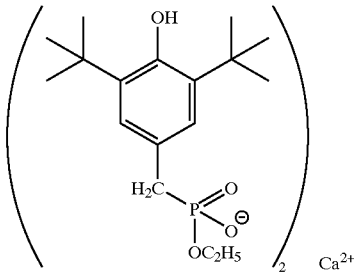
S-18.
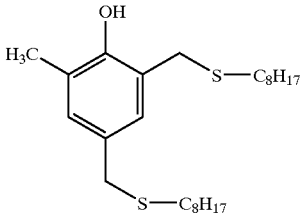

-continued

S-19.

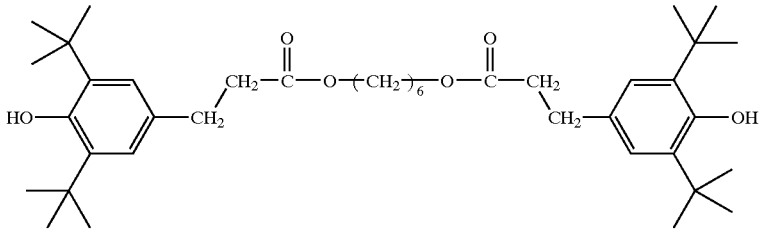

S-20.

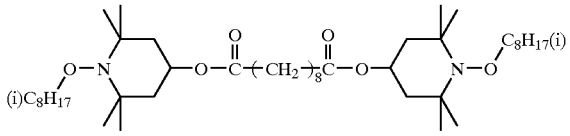

S-21.

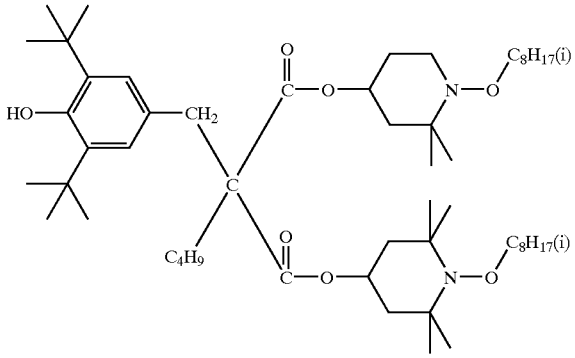

S-22.

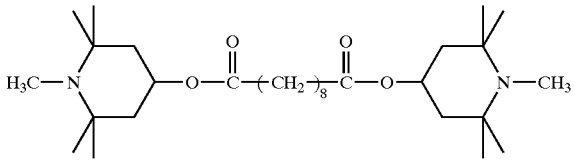

S-23.

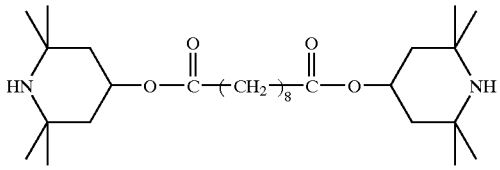

S-24.

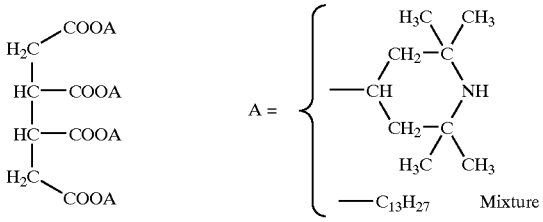

S-25.

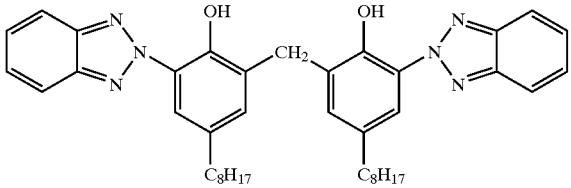

S-26.

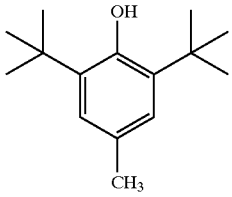

S-27.

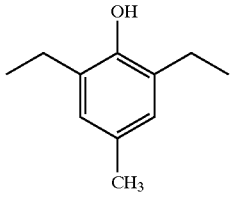

Compounds of the general formulae (TS-I) and (TS-II) are known, and relevant patents are cited in, for example, Research Disclosure Nos. 17643 (IV, items I to J), 15162, 18716 (page 650, left column), 36544 (page 527), 307105 (page 872) and 15162, all the disclosures of which are incorporated herein by reference.

These compounds are sold as industrial products on the market and hence can be easily procured. With respect to those which are commercially available, detailed description is given in "The index of ANTIOXIDANTS and ANTIOZONANTS" edited by Michael and Irene Ash and published by Gower, the disclosure of which is incorporated herein by reference.

All the compounds listed as compound examples are sold as industrial products on the market and can be procured from a plurality of companies. Representative sources and trade names are listed below.

| | | |
|---|---|---|
| S-1. | MARK AO-50 | Adeka Argus Chemical Co., Ltd. |
| | IRGANOX 1076 | Ciba Specialty Chemical |
| S-2. | MARK AO-20 | Adeka Argus Chemical Co., Ltd. |
| S-3. | MARK AO-30 | Adeka Argus Chemical Co., Ltd. |
| S-4. | MARK AO-40 | Adeka Argus Chemical Co., Ltd. |
| S-5. | MARK AO-80 | Adeka Argus Chemical Co., Ltd. |
| S-6. | MARK AO-330 | Adeka Argus Chemical Co., Ltd. |
| S-7. | SONGLIZER 1010 | Morisawa Shoji |
| S-8. | Sumilizer MDP-S | Sumitomo Chemical Co., Ltd. |
| S-9. | Sumilizer GM | Sumitomo Chemical Co., Ltd. |

-continued

| | | |
|---|---|---|
| S-10. | Sumilizer BBM-S | Sumitomo Chemical Co., Ltd. |
| S-11. | Tominox 917 | Yoshitomi Fine Chemical |
| S-12. | Sumilizer WX-R | Sumitomo Chemical Co., Ltd. |
| S-13. | IRGANOX 1035 | Ciba Specialty Chemical |
| S-14. | IRGANOX 1098 | Ciba Specialty Chemical |
| S-15. | IRGANOX 1141 | Ciba Specialty Chemical |
| S-16. | IRGANOX 1222 | Ciba Specialty Chemical |
| S-17. | IRGANOX 1425WL | Ciba Specialty Chemical |
| S-18. | IRGANOX 1520LR | Ciba Specialty Chemical |
| S-19. | IRGANOX 259 | Ciba Specialty Chemical |
| S-20. | TINUVIN 123-S | Ciba Specialty Chemical |
| S-21. | TINUVIN 144 | Ciba Specialty Chemical |
| S-22. | TINUVIN 765 | Ciba Specialty Chemical |
| S-23. | MARK LA-77 | Adeka Argus Chemical Co., Ltd. |
| S-24. | MARK LA-67 | Adeka Argus Chemical Co., Ltd. |
| S-25. | MARK LA-31 | Adeka Argus Chemical Co., Ltd. |
| S-26. | Sumilizer BHT | Sumitomo Chemical Co., Ltd. |

The addition amount of compounds represented by the general formulae (TS-I) and (TS-II) according to the present invention is in the range of 0.0005 to 5.0% by weight, preferably 0.001 to 3.0% by weight, and more preferably 0.002 to 1.0% by weight. Herein, the addition amount refers to the total usage in plastic material.

The substance capable of adsorbing substances having adverse effects on photographic properties according to the present invention will be described in detail below.

The aforementioned gases are known as substances having adverse effects on photographic properties. As a result of investigations, the inventors have found that carbon black, alumina, titanium oxide and high-silica zeolite (produced by Union Showa K.K., trade name: deodorant Abscents 3000) can preferably be employed as adsorbents of such gases. The inventors have conducted further investigations, and consequently it has become apparent that specified carbon blacks which are defined by an equilibrium adsorption amount of acetaldehyde gas are preferred in the adsorption of a variety of such gases. Specifically, the acetaldehyde gas equilibrium adsorption amount of carbon black is preferably 2 mg/g or more, more preferably 3 mg/g or more, and most preferably 6 mg/g or more.

In the use of carbon or the like, it is preferred that the adsorption amount be large. Accordingly, it is preferred that the adsorbent have a small particle diameter and be porous.

The acetaldehyde gas equilibrium adsorption amount mentioned in the present invention is measured in the following manner.

2.5 to 3.5 g of carbon black is weighed and charged in a glass tube (20 mm in inside diameter and 20 mm in length). In a 25° C. atmosphere, an air containing acetaldehyde gas in a concentration of 100 ppm (hereinafter referred to as "mixed gas") is passed through the glass tube charged with carbon black at a gas flow rate of 0.417 normal liter/min (the normal liter refers to a volume in terms of 1 atm and 0° C.). The acetaldehyde gas concentration of the mixed gas having passed through the glass tube charged with carbon black is measured by means of an acetaldehyde gas detector tube (No. 92, manufactured by Gastec Corporation) until the acetaldehyde gas concentration comes to agree with the acetaldehyde gas concentration (100 ppm) of the mixed gas before being passed through the glass tube. The amount of acetaldehyde gas having been adsorbed up to the time at which the acetaldehyde gas concentrations agree with each other is referred to as "acetaldehyde gas equilibrium adsorption amount".

As examples of preferred commercially available carbon blacks for use in the present invention, there can be mentioned furnace carbon blacks #950 and #2600 produced by Mitsubishi Chemical Corporation. The aforementioned thermoplastic resin material member for use in the present invention preferably contains carbon black exhibiting an acetaldehyde gas equilibrium adsorption amount of 2 mg/g or more, in dispersed form, in an amount of 0.05 to 15% by weight. Herein, the terminology "contain" refers to the total amount after the supplemental addition to the plastic material.

In the present invention, the supplemental addition of the compound of the general formula (TS-I) or (TS-II) and/or the substance capable of adsorbing substances having adverse effects on photographic properties can be performed when crushed resin is pelletized by means of an extruder, when the thus pelletized resin alone or in combination with another resin is molded, and when crushed resin per se is mixed with another molding resin and molded, and the timing of supplemental addition is not particularly limited.

The molding can be performed by injection molding and also by vacuum forming, blow molding or extrusion, and the molding method is not particularly limited. Further, extrusion can be performed by various ways which are also not particularly limited.

In the performing of injection molding, the known injection molding method can be employed. The production of thermoplastic resin compositions for use in the injection molding can be performed by various methods, including the compound method, the powder method, the master batch method and the liquid method. In particular, from the viewpoint of cost, prevention of contamination during operations and homogeneous dispersion of carbon black, it is preferred to employ the compound method or the master batch method.

The thermoplastic resin material member may contain various additives, such as a chelating substance, a coupling agent, a dripproof substance and a surfactant, as described in JP-A's-6-67356 and 8-118394, the disclosure of which is incorporated herein by reference.

Although the substances capable of adsorbing substances having adverse effects on photographic properties, such as carbon black, for use in the present invention include those capable of imparting lightshielding properties as pigments, carbon black not having any specific capability of adsorbing substances having adverse effects on photographic properties, or pigments such as silica and titanium oxide may further be added in the event that enhanced lightshielding properties must be exhibited.

The thermoplastic resin material members for use in the present invention are not limited to those accommodated together with a lightsensitive material in a container, such as a spool and a core, and include the container wherein the lightsensitive material is accommodated per se. Also, members constituted of materials (e.g., a metal) other than the thermoplastic resin materials can be jointly accommodated in the photographic lightsensitive material packaging unit of the present invention.

As the thermoplastic resin for use in the present invention, there can be mentioned known resins, such as polyethylene resins, polystyrene resins, ABS resin, polyvinyl chloride resin, acrylic resin, polycarbonate resin, polyphenylene oxide modified resin, polysulfone resin, polyether sulfone resin and polyallylate resin. Of these resins, polystyrene resins are preferred from the viewpoint of cost and thermal stability. Especially, a polystyrene resin (medium-impact polystyrene resin) obtained by mixing a rubber-containing polystyrene resin (HIPS: high impact resisting polystyrene) with common polystyrene resin (GS: general-purpose polystyrene) is preferred.

Furthermore, if necessary, a resin for property modification other than the thermoplastic reclaimed resins can be added in the present invention.

The reclaimed resin of the present invention may contain additives, for example, various silicone oils added for low friction, fatty acid metal salts for mold release improvement and surfactants for antistatic properties.

Details of applicable resins, adsorbents, additives, etc. are given in JP-A-6-67356, the discloser of which is incorporated herein by reference, which however in no way limit the present invention.

The color photographic lightsensitive material of the present invention has, on a support, a red-sensitive silver halide emulsion layer, a green-sensitive silver halide emulsion layer and a blue-sensitive silver halide emulsion layer. The photographic speed of the lightsensitive material of the present invention is preferably 640 or more in terms of ISO. The use of conventional reclaimed resin has caused the lightsensitive material of 640 or more ISO speed to suffer adverse effects on photographic properties, thereby disenabling practical photographing. However, the supplemental addition, at reclamation, of the substance capable of adsorbing substances having adverse effects on photographic properties and/or the compound of the general formula (TS-I) or (TS-II) according to the present invention has enabled employing reclaimed resin members for the light-sensitive material of 640 or more ISO speed.

With respect to the ISO speed of the color photographic lightsensitive material of the present invention, a distance effect is striking when it is 800 or more.

The silver content of the color photographic lightsensitive material of the present invention is preferably in the range of 6 to 10 g/m$^2$, more preferably 6 to 9 g/m$^2$. The terminology "silver content" used herein means the total amount, in terms of silver, of contained silvers such as silver halides and metallic silver. Some methods are known for analyzing the silver content of lightsensitive material. Although any of the methods can be employed, for example, the elemental analysis using fluorescent X-ray technique is easy to apply. It has been found that the substances having adverse effects on photographic properties affect silver halides. Therefore, the present invention has enabled employing reclaimed resin members for the lightsensitive material of large silver coating amount as well.

The film thickness of color photographic lightsensitive material mentioned in the present invention refers to the sum of all thicknesses of hydrophilic colloid layers arranged on the support on its side of lightsensitive silver halide emulsion layers. The film thickness is preferably 22 $\mu$m or more, more preferably in the range of 23 to 35 $\mu$m.

The film thickness is measured by effecting a magnified photographing of a section of lightsensitive material by means of a scanning electron microscope.

Although the composition of tabular silver halide emulsions for use in the present invention is not particularly limited, preferred use can be made of tabular grain emulsions of silver iodobromide or silver chloroiodobromide.

With respect to the tabular silver halide grains (hereinafter also simply referred to as "tabular grains"), the terminology "aspect ratio" means the ratio of diameter to thickness of the silver halide. That is, it is a quotient of the diameter divided by the thickness of each individual silver halide grain. The terminology "diameter" used herein refers to the diameter of a circle having an area equal to the projected area of grain as obtained when observing silver halide grains through a microscope or an electron microscope.

The color photographic lightsensitive material for use in the present invention has a support and, superimposed thereon, a red-sensitive silver halide emulsion layer, a green-sensitive silver halide emulsion layer and a blue-sensitive silver halide emulsion layer. It is preferred that each color-sensitive silver halide emulsion be in the form of a plurality of silver halide emulsion layers differing from each other in photographic speed. 60% or more (preferably 70% or more, and more preferably 80% or more) of the total projected area of silver halide grains contained in at least one of these emulsion layers is occupied by tabular silver halide grains having an aspect ratio of 8.0 or more. The aspect ratio is more preferably 10 or more, and most preferably 12 or more. The upper limit of the aspect ratio is preferably 100. When the aspect ratio is smaller than the above, the photographic speed would be unfavorably low. On the other hand, when the aspect ratio is larger than the above, an intrinsic desensitization by dye would unfavorably cause lowering of photographic speed and deteriorations of pressure resistance and storage stability.

The method of taking a transmission electron micrograph by the replica technique and measuring the equivalent circular diameter and thickness of each individual grain can be mentioned as an example of aspect ratio determining method. In the mentioned method, the thickness is calculated from the length of replica shadow.

The equivalent circle diameter of tabular grains for use in the present invention is preferably in the range of 0.3 to 5.0 $\mu$m, more preferably 1.0 to 4.0 $\mu$m.

The equivalent circle diameter preferably has such a monodispersity that the variation coefficient of distribution of grain size expressed by the equivalent circle diameter (quotient of dispersion (standard deviation) divided by average grain size) is 20% or less, more preferably 18% or less. The thickness of tabular grains for use in the present invention is preferably less than about 0.8 $\mu$m. It is more preferably in the range of 0.05 to 0.6 $\mu$m, most preferably 0.1 to 0.5 $\mu$m. The thickness of tabular grains preferably has such a monodispersity that the variation coefficient of grain thickness distribution is 20% or less.

The configuration of tabular grains of the present invention is generally hexagonal. The terminology "hexagonal configuration" means that the shape of the principal plane of tabular grains is hexagonal, the neighboring side ratio (maximum side length/minimum side length) thereof being 2 or less. The neighboring side ratio is preferably 1.6 or less, more preferably 1.2 or less. That the lower limit thereof is 1.0 is needless to mention. In the grains of high aspect ratio, especially, triangular tabular grains are increased in the tabular grains. The triangular tabular grains are produced when the Ostwald ripening has excessively been advanced. From the viewpoint of obtaining substantially hexagonal tabular grains, it is preferred that the period of this ripening be minimized. For this purpose, it is requisite to endeavor to raise the tabular grain ratio by nucleation. It is preferred that one or both of an aqueous silver ion solution and an aqueous bromide ion solution contain gelatin for the purpose of raising the probability of occurrence of hexagonal tabular grains at the time of adding silver ions and bromide ions to a reaction mixture according to the double jet technique, as described in JP-A-63-11928 by Saito, the disclosure of which is incorporated herein by reference.

The hexagonal tabular grains for use in the present invention are formed through the steps of nucleation, Ostwald ripening and growth. Although all of these steps are important for suppressing the spread of grain size distribution, especial attention should be paid so as to prevent the spread of size distribution at the first nucleation step because the spread of size distribution brought about in a previous step cannot be narrowed by an ensuing step. What is important in the nucleation step is the relationship between the temperature of reaction mixture and the period of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al describes that the suitable temperature at nucleation is 60° C. or below.

Gelatin may be further added during the grain formation in order to obtain monodisperse tabular grains of high aspect ratio. The added gelatin preferably consists of a chemically modified gelatin as described in JP-A-10-148897 and JP-A-11-143002 (gelatin in which at least two —COOH groups have newly been introduced at a chemical modification of —$NH_2$ group contained in the gelatin), the disclosures of which are incorporated herein by reference. Although this chemically modified gelatin is a gelatin characterized in that at least two carboxyl groups have newly been introduced at a chemical modification of amino group contained in the gelatin, it is preferred that gelatin trimellitate be used as the same. Also, gelatin succinate is preferably used. The chemically modified gelatin is preferably added prior to the growth step, more preferably immediately after the nucleation. The addition amount thereof is preferably at least 60%, more preferably at least 80%, and most preferably at least 90%, based on the total weight of dispersion medium used in grain formation.

The tabular grain emulsion is preferably constituted of silver iodobromide or silver chloroiodobromide. Although silver chloride may be contained, the silver chloride content is preferably 8 mol % or less, more preferably 3 mol % or less, or 0 mol %. The silver iodide content is preferably 20 mol % or less since the variation coefficient of the grain size distribution of the tabular grain emulsion is preferably 30% or less. The lowering of the variation coefficient of the distribution of equivalent circular diameter of the tabular grain emulsion can be facilitated by lowering the silver iodide content. The variation coefficient of the grain size distribution of the tabular grain emulsion is more preferably 20% or less, and the silver iodide content is more preferably 10 mol % or less.

It is preferred that the tabular grain emulsion have some intragranular structure with respect to the silver iodide distribution. The silver iodide distribution may have a double structure, a treble structure, a quadruple structure or a structure of higher order.

In the present invention, the tabular grains preferably have dislocation lines. The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 3, 5, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the principal planes.

The number of dislocation lines of the tabular grains according to the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof. There are instances when hundreds of dislocation lines are observed.

Dislocation lines can be introduced in, for example, the vicinity of the periphery of tabular grains. In this instance, the dislocation is nearly perpendicular to the periphery, and each dislocation line extends from a position corresponding to x % of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel principal planes of tabular grains. In the case where dislocation lines are formed over the entire regions of the principal planes, the dislocation lines may crystallographically be oriented approximately in the (211) direction when viewed in the direction perpendicular to the principal planes, and the formation of the dislocation lines may be effected either in the (110) direction or randomly. Further, the length of each dislocation line may be random, and the dislocation lines may be observed as short lines on the principal planes or as long lines extending to the side (periphery). The dislocation lines may be straight or often meander. In many instances, the dislocation lines cross each other.

The position of dislocation lines may be localized on the periphery, principal planes or local points as mentioned above, or the formation of dislocation lines may be effected on a combination thereof. That is, dislocation lines may be concurrently present on both the periphery and the principal planes.

The introduction of dislocation lines in the tabular grains can be accomplished by disposing a specified phase of high silver iodide content within the grains. In the dislocation line introduction, the phase of high silver iodide content may be provided with discontinuous regions of high silver iodide content. Practically, the phase of high silver iodide content within the grains can be obtained by first preparing base grains, providing them with a phase of high silver iodide content and covering the outside thereof with a phase of silver iodide content lower than that of the phase of high silver iodide content. The silver iodide content of the base tabular grains is lower than that of the phase of high silver iodide content, and is preferably 0 to 20 mol %, more preferably 0 to 15 mol % of the silver halide in the base.

The terminology "phase of high silver iodide content within the grains" refers to a silver halide solid solution containing silver iodide. The silver halide of this solid solution is preferably silver iodide, silver iodobromide or silver chloroiodobromide, more preferably silver iodide or silver iodobromide (the silver iodide content is in the range of 10 to 40 mol % based on the silver halides contained in the phase of high silver iodide content). For selectively causing the phase of high silver iodide content within the grains (hereinafter referred to as "internal high silver iodide phase") to be present on any place of the sides, corners and faces of the base grains, it is desirable to control forming conditions for the base grains, forming conditions for the internal high silver iodide phase and forming conditions for the phase covering the outside thereof. With respect to the forming conditions for the base grains, the pAg (logarithm of inverse number of silver ion concentration), the presence or absence, type and amount of silver halide solvent and the temperature are important factors. Regulating the pAg at base grain growth to 8.5 or less, preferably 8 or less, enables selectively causing the internal high silver iodide phase to be present near the apex or on the face of the base grains in the subsequent step of forming the internal high silver iodide phase. On the other hand, regulating the pAg at base grain growth to at least 8.5, preferably at least 9, enables causing the internal high silver iodide phase to be present on the side of the base grains in the subsequent step of forming the internal high silver iodide phase. The threshold value of the pAg is changed upward or downward depending on the temperature and the presence or absence, type and amount of silver halide solvent. When, for example, a thiocyanate is used as the silver halide solvent, the threshold value of the pAg is deviated toward a higher value. What is most important as the pAg at growth is the pAg at the termination of growth of base grains. On the other hand, even when the pAg at growth does not satisfy the above value, the selected position of the internal high silver iodide phase can be controlled by carrying out, after the growth of base grains, the regulation to the above pAg and a ripening. During the period, ammonia, an amine compound, a thiourea derivative or a thiocyanate salt is effective as the silver halide solvent. For the formation of the internal high silver iodide phase, use can be made of the so-called conversion methods. These conversion methods include one in which, during grain formation, halide ions whose salts formed with silver ions exhibit a solubility lower than that of the salts formed with the halide ions that are forming the grains or the vicinity of the surface of the grains occurring at the time of grain formation, are added. In the present invention, it is preferred that the amount of added low-solubility halide ions be at least some value (relating to halogen composition) relative to the surface area of grains occurring at the time of the addition.

For example, it is preferred that, during grain formation, KI be added in an amount not smaller than some amount relative to the surface area of silver halide grains occurring at the time of the grain formation. Specifically, it is preferred that an iodide salt be added in an amount of at least $8.2\times10^{-5}$ mol/$m^2$.

Preferred process for forming the internal high silver iodide phase comprises adding an aqueous solution of a silver salt simultaneously with the addition of an aqueous solution of halide salts containing an iodide salt.

For example, an aqueous solution of $AgNO_3$ is added simultaneously with the addition of an aqueous solution of KI by the double jet. The addition initiating times and addition completing times of the aqueous solution of KI and the aqueous solution of $AgNO_3$ may be differed from each other, that is, the one may be earlier or later than the other. The addition molar ratio of an aqueous solution of $AgNO_3$ to an aqueous solution of KI is preferably at least 0.1, more preferably at least 0.5, and most preferably at least 1. The total addition molar amount of an aqueous solution of $AgNO_3$ relative to halide ions within the system and added iodide ions may fall in a silver excess region. It is preferred that the pAg exhibited when the aqueous solution of halide containing such iodide ions and the aqueous solution of silver salt are added by the double jet be decreased in accordance with the passage of double jet addition time. The pAg prior to the addition initiation is preferably in the range of 6.5 to 13, more preferably 7.0 to 11. The pAg at the time of addition completion is most preferably in the range of 6.5 to 10.0.

In the performing of the above process, it is preferred that the solubility in the mixture system be as low as possible. Accordingly, the temperature of the mixture system exhibited at the time of formation of the high silver iodide phase is preferably in the range of 30 to 80° C., more preferably 30 to 70° C.

Furthermore, the formation of the internal high silver iodide phase can preferably be performed by adding fine grains of silver iodide, fine grains of silver iodobromide, fine grains of silver chloroiodide or fine grains of silver chloroiodobromide. It is especially preferred that the formation be effected by 5 adding fine grains of silver iodide. Although these fine grains generally have a size of 0.01 to 0.1 $\mu$m, use can also be made of fine grains with a size of not greater than 0.01 $\mu$m, or 0.1 $\mu$m or more. With respect to the process for preparing these fine grains of silver halide, reference can be made to descriptions of JP-A's-1-183417, 2-44335, 1-183644, 1-183645, 2-43534 and 2-43535. The internal high silver iodide phase can be provided by adding these fine grains of silver halide and conducting a ripening. When the fine grains are dissolved by ripening, use can be made of the aforementioned silver halide solvent. It is not needed that all these added fine grains be immediately dissolved and disappear. It is satisfactory if, when the final grains have been completed, they are dissolved and disappear.

The position of the internal high silver iodide phase, as measured from the center of, for example, a hexagon resulting from grain projection, is preferably present in the range of 5 to less than 100 mol %, more preferably 20 to less than 95 mol %, and most preferably 50 to less than 90 mol %, based on the amount of silver of the whole grain. The amount of silver halide forming this internal high silver iodide phase, in terms of the amount of silver, is 50 mol % or less, preferably 20 mol % or less, based on the amount of silver of the whole grain. With respect to the above high silver iodide phase, there are provided recipe values of the production of silver halide emulsion, not values obtained by measuring the halogen composition of final grains according to various analytical methods. The internal high silver iodide phase is often caused to completely disappear in final grains by, for example, recrystallization during the shell covering step, and all the above silver amounts relate to recipe values thereof.

Therefore, although the observation of dislocation lines can be easily performed in the final grains by the above method, the internal silver iodide phase introduced for the introduction of dislocation lines often cannot be confirmed as a clear phase because the boundary silver iodide composition is continuously changed. The halogen composition at each grain part can be determined by a combination of X-ray diffractometry, the EPMA method (also known as the XMA method, in which silver halide grains are scanned by electron beams to thereby detect the silver halide composition), the ESCA method (also known as the XPS method, in which X rays are irradiated and photoelectrons emitted from grain surface are separated into spectra), etc.

The outside phase which covers the internal high silver iodide phase has a silver iodide content lower than that of the internal high silver iodide phase.

The silver iodide content of the covering outside phase is preferably in the range of 0 to 30 mol %, more preferably 0 to 20 mol %, and most preferably 0 to 10 mol %, based on the silver halide contained in the covering outside phase.

Although the temperature and pAg employed at the formation of the outside phase which covers the internal high silver iodide phase are arbitrary, the temperature preferably ranges from 30 to 80° C., most preferably from 35 to 70° C., and the pAg preferably ranges from 6.5 to 11.5. The use of the aforementioned silver halide solvent is occasionally preferred, and the most preferred silver halide solvent is a thiocyanate salt.

Another method of introducing dislocation lines in the tabular grains comprises using an iodide ion-releasing agent as described in JP-A-6-11782, which can preferably be employed.

Also, dislocation lines can be introduced by appropriately combining this method of introducing dislocation lines with the aforementioned method of introducing dislocation lines.

The terminology "twin plane spacing of silver halide grains" used herein means the distance between two twin planes with respect to the grains having two twin planes within each tabular grain, and means the largest of the twin plane distances with respect to the grains having three or more twin planes.

The twin plane can be observed through a transmission electron microscope. Specifically, a support is coated with an emulsion comprising tabular grains to thereby prepare a sample in which the tabular grains are arranged approximately in parallel to the support. The sample is cut with a diamond knife to thereby prepare a 0.1 μm thick section. The twin planes of the tabular grains can be detected by observing the section through a transmission electron microscope. When electron beams pass through the twin planes, a phase shift occurs in the electron waves. Thus, the presence of the twin planes can be recognized.

For obtaining an estimate of the twin plane thickness of tabular grains, although reference can be made to the method described by J. F. Hamilton, L. F. Brady et al. in J. Appl. Phys. 35, 414–421 (1964), the above specified method is easier than the same.

With respect to the silver halide grains for use in the present invention, especially the tabular silver halide grains for use in the present invention, it is preferred that the twin plane spacing thereof be 0.020 μm or less. The twin plane spacing is more preferably in the range of 0.007 to 0.017 μm, and most preferably 0.007 to 0.015 μm. When the twin plane spacing exceeds 0.02 μm, the photographic speed would unfavorably be low.

The variation coefficient of the intergranular iodine distribution of silver halide grains for use in the present invention is preferably 20% or less, more preferably 15% or less, and much more preferably 10% or less. When the variation coefficient of the iodine content distribution of each silver halide is greater than 20%, unfavorably, a high contrast is not realized and a sensitivity lowering is intense when a pressure is applied.

Any known processes such as the process of adding fine grains as described, for example, in JP-A-1-183417 and the process of using an iodide ion-releasing agent as described in JP-A-2-68538 can be employed either individually or in combination for the production of silver halide grains whose intergranular iodine distribution is narrow for use in the present invention. The silver halide grains for use in the present invention preferably have a variation coefficient of intergranular iodine distribution of 20% or less. The process described in JP-A-3-213845 can be used as the most suitable process for converting the intergranular iodine distribution to a monodispersion. That is, a monodisperse intergranular iodine distribution can be accomplished by a process in which fine silver halide grains containing silver iodide in an amount of at least 95 mol % are formed by mixing together an aqueous solution of a water soluble silver salt and an aqueous solution of a water soluble halide (containing at least 95 mol % of iodide ions) by means of a mixer provided outside a reactor vessel for crystal growth and, immediately after the formation, fed in the reactor vessel. The terminology "reactor vessel" used herein means the vessel in which the nucleation and/or crystal growth of tabular silver halide grains is carried out.

With respect to the above process of mixer preparation followed by adding procedure and the preparatory means for use therein, the following three techniques can be employed as described in JP-A-3-213845:

(i) immediately after formation of fine grains in a mixer, the fine grains are transferred into a reactor vessel;

(ii) powerful and effective agitation is carried out in the mixer; and (iii) an aqueous solution of protective colloid is injected into the mixer.

The protective colloid used in technique (iii) above may be separately injected in the mixer, or may be incorporated in the aqueous solution of silver halide or the aqueous solution of silver nitrate before the injection in the mixer. The concentration of protective colloid is at least 1% by weight, preferably in the range of 2 to 5% by weight. Examples of polymeric compounds exhibiting a protective colloid function to the silver halide grains for use in the present invention include polyacrylamide polymers, amino polymers, polymers having thioether groups, polyvinyl alcohol, acrylic polymers, hydroxyquinoline having polymers, cellulose, starch, acetal, polyvinylpyrrolidone and ternary polymers. Low-molecular-weight gelatin can preferably be used as the above polymeric compound. The molecular weight of low-molecular-weight gelatin is preferably 30,000 or less, more preferably 10,000 or less.

The grain formation temperature in the preparation of fine silver halide grains is preferably 35° C. or below, more preferably 25° C. or below. The temperature of the reactor vessel in which fine silver halide grains are incorporated is at least 50° C., preferably at least 60° C., and more preferably at least 70° C.

The grain size of fine-size silver halide for use in the present invention can be determined by placing grains on a mesh and making a direct observation through a transmission electron microscope. The size of fine grains of the present invention is 0.3 μm or less, preferably 0.1 μm or less, and more preferably 0.01 μm or less. This fine silver halide may be added simultaneously with the addition of other halide ions and silver ions, or may be separately added. The fine silver halide grains are mixed in an amount of 0.005 to 20 mol %, preferably 0.01 to 10 mol %, based on the total silver halide.

The silver iodide content of each individual grain can be measured by analyzing the composition of each individual grain by means of an X-ray microanalyzer. The terminology "variation coefficient of intergranular iodine distribution" means a value defined by the formula:

variation coefficient=(standard deviation/av. silver iodide content)×100 wherein the standard deviation, specifically the standard deviation of silver iodide content, and the average silver iodide content are obtained by measuring the silver iodide contents of at least 100, preferably at least 200, and more preferably at least 300 emulsion grains. The measuring of the silver iodide content of each individual grain is described in, for example, EP No. 147,868. There are cases in which a correlation exists between the silver iodide content Yi (mol %) of each individual grain and the equivalent spherical diameter Xi ($\mu$m) of each individual grain and cases in which no such correlation exists. It is preferred that no correlation exist therebetween. The structure associated with the silver halide composition of grains of the present invention can be identified by, for example, a combination of X-ray diffractometry, the EPMA method (also known as the XMA method, in which silver halide grains are scanned by electron beams to thereby detect the silver halide composition) and the ESCA method (also known as the XPS method, in which X rays are irradiated and photoelectrons emitted from grain surface are separated into spectra). In the measuring of silver iodide content in the present invention, the terminology "grain surface" refers to the region whose depth from surface is about 50 Å, and the terminology "grain internal part" refers to the region other than the above surface. The halogen composition of such a grain surface can generally be measured by the ESCA method.

The emulsions for use in the silver halide lightsensitive material of the present invention are preferably subjected to selenium sensitization. Selenium compounds disclosed in hitherto published patents can be used as the selenium sensitizer in the present invention. In the use of unstable selenium compound and/or nonunstable selenium compound, generally, it is added to an emulsion and the emulsion is agitated at high temperature, preferably 40° C. or above, for a given period of time. Compounds described in, for example, Jpn. Pat. Appln. KOKOKU Publication No. (hereinafter referred to as JP-B-) 44-15748, JP-B-43-13489, JP-A's-4-25832 and 4-109240 are preferably used as the unstable selenium compound.

Selenium sensitization may effectively be performed in the presence of a silver halide solvent.

Examples of the silver halide solvents which can be employed in the present invention include (a) organic thioethers described in U.S. Pat. Nos. 3,271,157, 3,531,289, and 3,574,628, and JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) sulfites and (f) thiocyanates.

Thiocyanates and tetramethylthiourea can be mentioned as especially preferred silver halide solvents. The amount of added solvent, although varied depending on the type thereof, is, for example, preferably in the range of $1\times10^{-4}$ to $1\times10^{-2}$ mol per mol of silver halide.

The emulsion for use in the present invention is preferably subjected to gold sensitization in combination with the selenium sensitization. The oxidation number of gold of the gold sensitizer used in the gold sensitization may be either +1 or +3, and gold compounds customarily used as gold sensitizers can be employed. Representative examples thereof include chloroauric acid salts, potassium chloroaurate, auric trichloride, potassium auric thiocyanate, potassium iodoaurate, tetracyanoauric acid, ammonium aurothiocyanate, pyridyltrichlorogold, gold sulfide and gold selenide. The addition amount of gold sensitizer, although varied depending on various conditions, is preferably between $1\times10^{-7}$ mol and $5\times10^{-5}$ mol per mol of silver halide as a yardstick.

With respect to the emulsion for use in the present invention, it is desired to perform the chemical sensitization in combination with sulfur sensitization.

The sulfur sensitization is generally performed by adding a sulfur sensitizer and agitating the emulsion at high temperature, preferably 40° C. or above, for a given period of time.

In the above sulfur sensitization, those known as sulfur sensitizers can be used. For example, use can be made of thiosulfates, allylthiocarbamidothiourea, allyl isothiacyanate, cystine, p-toluenethiosulfonates and rhodanine. Use can also be made of other sulfur sensitizers described in, for example, U.S. Pat. Nos. 1,574,944, 2,410,689, 2,278,947, 2,728,668, 3,501,313, and 3,656,955, and DE No. 1,422,869, JP-B-56-24937 and JP-A-55-45016. The addition amount of sulfur sensitizer is satisfactory if it is sufficient to effectively increase the sensitivity of the emulsion. This amount, although varied to a large extent under various conditions such as the pH, temperature and size of silver halide grains, is preferably in the range of $1\times10^{-7}$ to $5\times10^{-5}$ mol per mol of silver halide.

The silver halide emulsion for use in the lightsensitive material of the present invention can be subjected to a reduction sensitization during the grain formation, or after the grain formation but before the chemical sensitization, during the chemical sensitization or after the chemical sensitization.

The reduction sensitization can be performed by a method selected from among the method in which a reduction sensitizer is added to the silver halide emulsion, the method commonly known as silver ripening in which growth or ripening is carried out in an environment of pAg as low as 1 to 7 and the method commonly known as high-pH ripening in which growth or ripening is carried out in an environment of pH as high as 8 to 11. At least two of these methods can be used in combination.

The above method in which a reduction sensitizer is added is preferred from the viewpoint that the level of reduction sensitization can be finely regulated.

Examples of known reduction sensitizers include stannous salts, ascorbic acid and derivatives thereof, amines and polyamines, hydrazine derivatives, formamidinesulfinic acid, silane compounds and borane compounds. In the reduction sensitization according to the present invention, appropriate one may be selected from among these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide.

Each reduction sensitizer is dissolved in water or any of organic solvents such as alcohols, glycols, ketones, esters and amides and added during the grain growth. Although the reduction sensitizer may be put in a reaction vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the resultant aqueous solution. Alternatively, the reduction sensitizer solution may preferably be either divided and added a plurality of times in accordance with the grain growth or continuously added over a prolonged period of time.

An oxidizer capable of oxidizing silver is preferably used during the process of producing the emulsion for use in the lightsensitive material of the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced nay form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH\ .SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones.

The use of the silver oxidizer in combination with the above reduction sensitization is preferred. This combined use can be effected by performing the reduction sensitization after the use of the oxidizer or vice versa or by simultaneously performing the reduction sensitization and the use of the oxidizer. These methods can be performed during the step of grain formation or the step of chemical sensitization.

The emulsion for use in the present invention can effectively exhibit it advantages by subjecting it to a spectral sensitization with a methine dye or the like. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5- or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,763,301, 3,814,609, 3,837,862, and 4,026,707, GB Nos. 1,344,281 and 1,507,803, JP-B's-43-4936 and 53-12375, and JP-A's-52-110618 and 52-109925.

The emulsion used in the present invention may contain with a dye which itself exerts no spectral sensitizing effect or a substance which absorbs substantially none of visible radiation and exhibits supersensitization, together with the above spectral sensitizing dye.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

Although the sensitizing dye can be used in an amount of $4\times10^{-6}$ to $8\times10^{-3}$ mol per mol of silver halide contained in the addition layer, the use thereof in an amount of about $5\times10^{-5}$ to $2\times10^{-3}$ mol per mol of silver halide is more effective when the size of silver halide grains is in the preferred range of 0.2 to 1.2 $\mu$m.

The fogging during aging of the silver halide emulsion for use in the present invention can be improved by adding and dissolving a previously prepared silver iodobromide emulsion at the time of chemical sensitization. Although the timing of the addition is arbitrary as long as it is performed during chemical sensitization, it is preferred that the silver iodobromide emulsion be first added and dissolved and, thereafter, a sensitizing dye and a chemical sensitizer be added in this order. The employed silver iodobromide emulsion has an iodine content lower than the surface iodine content of host grains, which is preferably a pure silver bromide emulsion. This silver iodobromide emulsion, although the size thereof is not limited as long as it is completely dissolvable, preferably has an equivalent spherical diameter of 0.1 $\mu$m or less, more preferably 0.05 $\mu$m or less. Although the addition amount of silver iodobromide emulsion depends on employed host grains, basically, it preferably ranges from 0.005 to 5 mol %, more preferably from 0.1 to 1 mol %, based on the mole of silver.

The emulsion for use in the present invention is preferably doped with hexacyanoiron (II) complex or hexacyanoruthenium complex (hereinafter also referred to simply as "metal complex"). The addition amount of the metal complex is preferably in the range of $10^{-7}$ to $10^{-3}$ mol per mol of silver halide, more preferably $1.0\times10^{-5}$ to $5\times10^{-4}$ mol per mol of silver halide.

The addition and incorporation of the metal complex for use in the present invention may be performed at any stage through the process of preparing silver halide grains which consists of nucleation, growth, physical ripening and chemical sensitization. Also, the addition and incorporation may be performed in some divisions. However, it is preferred that at least 50% of the total content of metal complex contained in each silver halide grain be contained in a layer underlying the outermost surface of silver halide grain where ½ or less of the silver content from the surface is present. The layer containing the metal complex may be overlaid with a layer which does not contain any metal complex.

The incorporation of the above metal complex is preferably accomplished by dissolving the metal complex in water or a suitable solvent and directly adding the solution to the reaction mixture during the formation of silver halide grains, or by adding the metal complex is solution to the aqueous solution of halide, aqueous solution of silver salt or other solution for preparation of silver halide grains and thereafter conducting grain formation. Alternatively, the incorporation of metal complex is also preferably accomplished by adding silver halide grains in which the metal complex has been introduced in advance, dissolving them and depositing them on other silver halide grains.

With respect to the hydrogen ion concentration of the reaction mixture to which the metal complex is added, the pH value is preferably in the range of 1 to 10, more preferably 3 to 7.

In the lightsensitive material of the present invention, it is only required that at least one red-sensitive, at least one green-sensitive and at least one blue-sensitive lightsensitive layer be formed on a support. A typical example thereof is a silver halide photographic lightsensitive material having, on its support, at least one lightsensitive layer constituted by a plurality of silver halide emulsion layers which have substantially the same color sensitivity but have different speeds. Each of the lightsensitive layers is a unit lightsensitive layer which is sensitive to any of blue light, green light and red light. In a multilayered silver halide color photographic lightsensitive material, these unit lightsensitive layers are generally arranged in the order of red-, green- and blue-sensitive layers from a support side. However, according to the intended use, this arrangement order may be reversed, or an arrangement order can be employed in which a different lightsensitive layer is interposed between the layers of the same color sensitivity. Nonlightsensitive layers can be formed between the silver halide lightsensitive layers and as the uppermost layer and the lowermost layer. These may contain, e.g., couplers, DIR compounds and color mixing inhibitors described later. As a plurality of silver halide emulsion layers constituting each unit lightsensitive layer, a two-layered structure of high- and low-speed emulsion layers is preferably arranged so that the sensitivity is sequentially decreased toward a support as described in DE No. 1,121,470 or GB No. 923,045, the disclosures of which are incorporated herein by reference. Also, as described in JP-A's-57-112751, 62-200350, 62-206541 and 62-206543, the disclosures of which are incorporated herein by reference, layers can be arranged so that a low-speed emulsion layer is formed on a side apart from a support while a high-speed emulsion layer is formed on a side close to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is incorporated herewith by reference, layers can be arranged, from the farthest side from a support, in the order of blue-sensitive layer/GH/RH/GL/RL. Furthermore, as described in JP-A's-56-25738 and 62-63936, the disclosures of which are incorporated herein by reference, layers can be arranged, from the farthest side from a support, in the order of blue-sensitive layer/GL/RL/GH/RH.

As described in JP-B-49-15495, the disclosures of which are incorporated herein by reference, three layers can be arranged so that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged so that the sensitivity is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in a layer sensitive to one color as described in JP-A-59-202464 the disclosures of which are incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

It is preferable to utilize an interlayer inhibitory effect as means for improving a color reproduction. It is preferred that the weight-average sensitivity wavelength ($\lambda_{-R}$) of spectral sensitivity distribution of interlayer effect exerted on the red-sensitive silver halide emulsion layer (in the event of a plurality of layers, the plurality of layers as a whole) from other layers at 500 nm to 600 nm satisfy the relationship: 500 nm$<\lambda_{-R}\leqq$560 nm; the weight-average sensitivity wavelength ($\lambda_G$) of spectral sensitivity distribution of the green-sensitive silver halide emulsion layer (in the event of a plurality of layers, the plurality of layers as a whole) satisfy the relationship: 520 nm$<\lambda_G\leqq$580 nm; and $\lambda_G-\lambda_{-R}\geqq$5 nm.

The sensitizing dye and solid disperse dye for use in the above utilization of interlayer inhibitory effect can be those described in JP-A-11-305396, the disclosure of which is incorporated herein by reference. Further, the above specified sensitivity and weight-average sensitivity wavelength of spectral sensitivity distribution of interlayer effect exerted on the red-sensitive silver halide emulsion layer from other layers can be determined by the method described in JP-A-11-305396.

The silver halide photographic lightsensitive material for use in the present invention preferably contains at least one compound which reacts with developing agent oxidation products obtained by development to thereby release a development inhibitor or a precursor thereof. For example, use can be made of DIR (development inhibitor releasing) couplers, DIR-hydroquinone and couplers capable of releasing DIR-hydroquinone or a precursor thereof.

Although, for example, the size and configuration of silver halide grains for use in the layer capable of exerting an interlayer effect on the red-sensitive layer are not particularly limited, it is preferred to use so-called tabular grains of high aspect ratio, a monodisperse emulsion having uniform grain size, or silver iodobromide grains having an iodine layer structure. Further, for extending an exposure latitude, it is preferred to mix a plurality of emulsions whose grain sizes are different from each other.

Although the donor layer capable of exerting the interlayer effect on the red-sensitive layer may be provided by coating on any position on the support, it is preferred that the donor layer be provided by coating at a position which is closer to the support than the blue-sensitive layer and which is more remote from the support than the red-sensitive layer. It is further preferred that the donor layer be positioned closer to the support than the yellow filter layer.

It is more preferred that the donor layer capable of exerting the interlayer effect on the red-sensitive layer be provided at a position which is closer to the support than the green-sensitive layer and which is more remote from the support than the red-sensitive layer. The donor layer is most preferably arranged at a position neighboring to a side of the green-sensitive layer close to the support. The terminology "neighboring" used herein means that an inter layer or any other layer is not interposed therebetween.

There may be a plurality of layers capable of exerting the interlayer effect on the red-sensitive layer. These layers may be positioned so that they neighbor to each other or are apart from each other.

The emulsion for use in the lightsensitive material of the present invention may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740, whose productive process is described in JP-A-59-133542. The thickness of the shell of this emulsion, although varied depending on development processing, etc., is preferably in the range of 3 to 40 nm, more preferably 5 to 20 nm.

The silver halide emulsion is generally subjected to physical ripening, chemical sensitization and spectral sensitization before use. Additives employed in these steps are described in RD Nos. 17643, 18716 and 307105. Positions where the description is made are listed in the following table.

With respect to the lightsensitive material of the present invention, at least two emulsions which are different from each other in at least one of the characteristics, specifically the grain size, grain size distribution, halogen composition, grain configuration and sensitivity of lightsensitive silver halide emulsion, can be mixed together and used in one layer.

It is preferred that silver halide grains having a grain surface fogged as described in U.S. Pat. No. 4,082,553, silver halide grains having a grain internal portion fogged as described in U.S. Pat. No. 4,626,498 and JP-A-59-214852 and colloidal silver be used in lightsensitive silver halide emulsion layers and/or substantially nonlightsensitive hydrophilic colloid layers. The expression "silver halide grains having a grain surface or grain internal portion fogged" refers to silver halide grains which can be developed uniformly (nonimagewise) irrespective of the nonexposed or exposed zone of lightsensitive material. The process for producing the grains is described in U.S. Pat. No. 4,626,498 and JP-A-59-214852. The silver halides constituting internal nuclei of co-e/shell silver halide grains having a grain internal portion fogged may have different halogen composition. Any of silver chloride, silver chlorobromide, silver iodobromide and silver chloroiodobromide can be used as the silver halide having a grain surface or grain internal portion fogged. The average grain size of these fogged silver halide grains is preferably in the range of 0.01 to 0.75 $\mu$m, more preferably 0.05 to 0.6 $\mu$m. With respect to grain configuration, regular grains may be used and although a polydisperse emulsion can be used, monodispersity (at least 95% of the weight or number of silver halide grains have grain sizes falling within ±40% of the average grain size) is preferred.

In the present invention, it is preferred to use nonlightsensitive fine grain silver halide. The expression "nonlightsensitive fine grain silver halide" refers to silver halide fine grains which are not sensitive at the time of imagewise exposure for obtaining dye image and which are substantially not developed at the time of development processing thereof. Those not fogged in advance are preferred. The fine grain silver halide has a silver bromide content of 0 to 100 mol %, and, if necessary, may contain silver chloride and/or silver iodide. Preferably, silver iodide is contained in an amount of 0.5 to 10 mol %. The average grain size (average of equivalent circular diameter of projected area) of fine grain silver halide is preferably in the range of 0.01 to 0.5 $\mu$m, more preferably 0.02 to 0.2 $\mu$m.

The fine grain silver halide can be prepared by the same process as used in the preparation of common lightsensitive silver halide. It is not needed to optically sensitize the surface of silver halide grains. Further, a spectral sensitization thereof is also not needed. However, it is preferred to add known stabilizers such as triazole, azaindene, benzothiazolium and mercapto compounds and zinc compounds thereto prior to the addition thereof to a coating liquid. Colloidal silver can be contained in the fine grain silver halide containing layers.

The above various additives can be used in the lightsensitive material according to the present technology, to which other various additives can also be added in conformity with the object.

The additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| Types of additives | RD17643 | RD18716 | RD308119 |
|---|---|---|---|
| 1 Chemical sensitizers | page 23 | page 648 right column | page 996 |
| 2 Sensitivity-increasing agents | | page 648 right column | |
| 3 Spectral sensitizers, super-sensitizers | pages 23–24 | page 648, right column to page 649, right column | page 996, right column to page 998, right column |
| 4 Brighteners | page 24 | | page 998 right column |
| 5 Antifoggants, stabilizers | pages 24–25 | page 649 right column | page 998, right column to page 1000, right column |
| 6 Light absorbents, filter dyes, ultraviolet absorbents | pages 25–26 | page 649, right column to page 650, left column | page 1003, left column to page 1003, right column |
| 7 Stain preventing agents | page 25, right column | page 650, left to right columns | page 1002, right column |
| 8 Dye image stabilizers | page 25 | | page 1002, right column |
| 9 Film hardeners | page 26 | page 651, left column | page 1004, right column page 1005, left column |
| 10 Binders | page 26 | page 651, left column | page 1003, right column to page 1004, right column |
| 11 Plasticizers, lubricants | page 27 | page 650, right column | page 1006, left to right columns |
| 12 Coating aids, surfactants | pages 26–27 | page 650, right column | page 1005, left column to page 1006, left column |
| 13 Antistatic agents | page 27 | page 650, right column | page 1006, right column to page 1007, left column |
| 14 Matting agents | | | page 1008, left column to page 1009, left column. |

With respect to the photographic lightsensitive material of the present invention and the emulsion suitable for use in the photographic lightsensitive material and also with respect to layer arrangement and related techniques, silver halide emulsions, dye forming couplers, DIR couplers and other functional couplers, various additives and development processing which can be used in the photographic lightsensitive material, reference can be made to EP 0565096A1 (published on Oct. 13, 1993) and patents cited therein, the disclosures of which are incorporated herein by reference. Individual particulars and the locations where they are described will be listed below.

1. Layer arrangement: page 61 lines 23 to 35, page 61 line 41 to page 62 line 14,
2. Interlayers: page 61 lines 36 to 40,
3. Interlayer effect imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical sensitization of emulsion: page 63 lines 6 to 9,
13. Emulsion mixing: page 63 lines 10 to 13,
14. Fogging emulsions: page 63 lines 14 to 31,
15. Nonlightsensitive emulsions: page 63 lines 32 to 43,
16. Silver coating amounts: page 63 lines 49 to 50,
17. Formaldehyde scavengers: page 64 lines 54 to 57,
18. Mercapto antifoggants: page 65 lines 1 to 2,
19. Fogging agent, etc.-releasing agents: page 65 lines 3 to 7,
20. Dyes: page 65, lines 7 to 10,
21. Color coupler summary: page 65 lines 11 to 13,
22. Yellow, magenta and cyan couplers: page 65 lines 14 to 25,
23. Polymer couplers: page 65 lines 26 to 28,
24. Diffusive dye forming couplers: page 65 lines 29 to 31,
25. Colored couplers: page 65 lines 32 to 38,
26. Functional coupler summary: page 65 lines 39 to 44,
27. Bleaching accelerator-releasing couplers: page 65 lines 45 to 48,
28. Development accelerator-releasing couplers: page 65 lines 49 to 53,
29. Other DIR couplers: page 65 line 54 to page 66 to line 4,
30. Method of dispersing couplers: page 66 lines 5 to 28,
31. Antiseptic and mildewproofing agents: page 66 lines 29 to 33,
32. Types of sensitive materials: page 66 lines 34 to 36,
33. Thickness of lightsensitive layer and swell speed: page 66 line 40 to page 67 line 1,
34. Back layers: page 67 lines 3 to 8,
35. Development processing summary: page 67 lines 9 to 11,
36. Developing solution and developing agents: page 67 lines 12 to 30,
37. Developing solution additives: page 67 lines 31 to 44,
38. Reversal processing: page 67 lines 45 to 56,
39. Processing solution open ratio: page 67 line 57 to page 68 line 12,
40. Development time: page 68 lines 13 to 15,
41. Bleach-fix, bleaching and fixing: page 68 line 16 to page 69 line 31,
42. Automatic processor: page 69 lines 32 to 40,
43. Washing, rinse and stabilization: page 69 line 41 to page 70 line 18,
44. Processing solution replenishment and recycling: page 70 lines 19 to 23,
45. Developing agent built-in sensitive material: page 70 lines 24 to 33,
46. Development processing temperature: page 70 lines 34 to 38, and
47. Application to film with lens: page 70 lines 39 to 41.

Moreover, preferred use can be made of a bleaching solution containing 2-pyridinecarboxylic acid or 2,6-pyridinedicarboxylic acid, a ferric salt such as ferric nitrate and a persulfate as described in EP No. 602,600. When this bleaching solution is used, it is preferred that the steps of stop and water washing be conducted between the steps of color development and bleaching. An organic acid such as acetic acid, succinic acid or maleic acid is preferably used as a stop solution. For pH adjustment and bleaching fog, it is preferred that the bleaching solution contains an organic acid such as acetic acid, succinic acid, maleic acid, glutaric acid or adipic acid in an amount of 0.1 to 2 mol/liter (hereinafter liter referred to as "L").

A magnetic recording layer usable in the present invention will be described below.

This magnetic recording layer is formed by coating the surface of a support with an aqueous or organic solvent-based coating solution which is prepared by dispersing magnetic grains in a binder.

As the magnetic grains, it is possible to use grains of, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferable. The grain can take the shape of any of, e.g., a needle, rice grain, sphere, cube, and plate. The specific area is preferably 20 $m^2/g$ or more, and more preferably 30 $m^2/g$ or more as $S_{BET}$, The saturation magnetization ($\sigma s$) of the ferromagnetic substance is preferably $3.0\times10^4$ to $3.0\times10^5$ A/m, and especially preferably $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032. A ferromagnetic grain whose surface is coated with an inorganic or organic substance described in JP-A-4-259911 or JP-A-5-81652 can also be used.

As a binder used together with the magnetic grains, it is possible to use a thermoplastic resin described in JP-A-4-219569, thermosetting resin, radiation-curing resin, reactive resin, acidic, alkaline, or biodegradable polymer, natural polymer (e.g., a cellulose derivative and sugar derivative), and their mixtures. The Tg of the resin is −40° C. to 300° C., and its weight average molecular weight is 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferable. Cellulosedi(tri)acetate is particularly preferable. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenedlisocyanate and 1 mol of trimethylolpropane), and polyisocyanate produced by condensation of any of these isocyanates. These examples are described in JP-A-6-59357.

As a method of dispersing the magnetic substance in the binder, as described in JP-A-6-35092, a kneader, pin type mill, and annular mill are preferably used singly or together. Dispersants described in JP-A-5-088283 and other known dispersants can be used. The thickness of the magnetic recording layer is 0.1 to 10 $\mu$m, preferably 0.2 to 5 $\mu$m, and more preferably 0.3 to 3 $\mu$m. The weight ratio of the magnetic grains to the binder is preferably 0.5:100 to 60:100, and more preferably 1:100 to 30:100. The coating amount of the magnetic grains is 0.005 to 3 $g/m^2$, preferably 0.01 to 2 $g/m^2$, and more preferably 0.02 to 0.5 $g/m^2$. The transmitting yellow density of the magnetic recording layer is preferably 0.01 to 0.50, more preferably 0.03 to 0.20, and especially preferably 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436 is preferable.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferable. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Sensitive materials having the magnetic recording layer are described in U.S. Pat. Nos. 5,336,589, 5,250,404, 5,229,259, 5,215,874, and EP466,130.

A polyester support used in the present invention will be described below. Details of the polyester support and sensitive materials, processing, cartridges, and examples (to be described later) are described in Journal of Technical Disclosure No. 94-6023 (JIII; 1994, March 15). Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is especially preferable among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of 40° C. to less than Tg, more preferably Tg −20° C. to less than Tg. The heat treatment can be performed at a fixed temperature within this range or can be performed together with cooling. The heat treatment time is 0.1 to 1500 hrs, more preferably 0.5 to 200 hrs. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A preferable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferable.

An undercoating layer can include a single layer or two or more layers. Examples of an undercoating layer binder are copolymers formed by using, as a starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-s-triazine), epichlorohydrin resin, and active vinylsulfone compound. $SiO_2$, $TiO_2$, inorganic fine grains, or polymethylmethacrylate copolymer fine grains (0.01 to 10 $\mu$m) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is especially preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of $10^7\Omega\cdot$cm or less, more preferably $10^5$ $\Omega\cdot$cm or less and a grain size of 0.001 to 1.0 $\mu$m, fine grains of composite oxides (e.g., Sb, P, B, In, S, Si, and C) of these metal oxides, fine grains of sol metal oxides, or fine grains of composite oxides of these sol metal oxides.

The content in a sensitive material is preferably 5 to 500 mg/m$^2$, and especially preferably 10 to 350 mg/m$^2$. The ratio of a conductive crystalline oxide or its composite oxide to the binder is preferably 1/300 to 100/1, and more preferably 1/100 to 100/5.

A sensitive material of the present invention preferably has a slip property. Slip agent-containing layers are preferably formed on the surfaces of both a sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferable.

A sensitive material of the present invention preferably contains a matting agent. This matting agent can be added to either the emulsion surface or back surface and is especially preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid=9/1 or 5/5 (molar ratio)) grains, and polystyrene grains. The grain size is preferably 0.8 to 10 $\mu$m, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 $\mu$m or smaller. Examples are polymethylmethacrylate grains (0.2 $\mu$m), poly(methylmethacrylate/methacrylic acid=9/1 (molar ratio, 0.3 $\mu$m) grains, polystyrene grains (0.25 $\mu$m), and colloidal silica grains (0.03 $\mu$m).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538. It is particularly preferable that the resistance be $10^{12}\Omega$ or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 cm$^3$ or less, preferably 25 cm$^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613. Photographic films used in the present invention can be so-called raw films before being developed or developed photographic films. Also, raw and developed photographic films can be accommodated in the same new cartridge or in different cartridges.

A color photographic lightsensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z. A color light sensitive film of the present invention is also suited 15 as a film-fitted lens such as Fuji Film FUJICOLOR UTSURUNDESU (Quick Snap) SUPER SLIM.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper (preferably Fuji Film SUPER FA8])
(6) Collation and shipment (the cartridge and the index print are collated by an ID number and shipped together with the prints)

As these systems, the Fuji Film MINILABO CHAMPION SUPER FA-298, FA-278, FA-258, FA-238 and Fuji Film DIGITALLABO SYSTEM, FRONTIER are preferable. Examples of a film processor for the MINILABO CHAMPION are the FP922AL/FP562B/FP562B, AL/F362B/FP362BL AL and a recommended processing chemical is the FUJICOLOR JUST-IT CN-16L and CN-16Q. Examples of a printer processor are the PP3008AR/PP3008A/PP1828AR/PP1828A/PP1258AR/PP1258A/PP728AR/PP728A, and a recommended processing chemical is the FUJICOLOR JUST-IT CP-47L and CP-40FAII. In the FRONTIER SYSTEM, SCANNER & IMAGE-PROCESSOR SP-1000 and LASER PRINTER & PAPER PROCESSOR LP-1000P, or LASER PRINTER LP-1000W are used. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

EXAMPLE

The present invention will be described in greater detail below by way of its examples. However, the present invention is in no way limited to these examples.

Example 1

A color lightsensitive material to be charged in a lens-fitted lightsensitive material packaging unit was produced in the following manner.

Silver halide emulsions were produced in the following manner. The structures of compounds employed in the production will be listed afterward.

Preparation of emulsion Em-X (comparative emulsion)

1300 milliliters (hereinafter referred to as "mL") of an aqueous solution containing 30.0 g of KBr, 23.7 g of KI, 18.0 g of ammonium nitrate and 28.5 g of gelatin was maintained at 76° C. and vigorously agitated. An aqueous solution containing 59.0 g of silver nitrate and an aqueous solution containing 11.0 g of KBr were added thereto at constant rates over a period of 9 min.

Subsequently, 14.8 g of ammonia was added, and the mixture was allowed to stand still for 20 min. The pH value thereof was adjusted to 6 with the use of acetic acid, and further $1.5\times10^{-5}$ mol of thiourea dioxide and $1\times10^{-5}$ mol of oxidizer (F-14) defined below were added. Further, 724 mL of an aqueous solution containing 119.0 g of silver nitrate was added at a constant flow rate of 9.05 mL/min over a period of 12 min, and thereafter, while maintaining the flow rate, added together with an aqueous solution containing 90.0 g of KBr by the double jet method at a constant rate over a period of 56 min. During the addition, a constant potential of −10 mV in terms of saturated calomel electrode was maintained. Thereafter, the potential was changed to −20 mV, and the addition was continued for 12 min.

Common washing was carried out, and gelatin was added so as to adjust the pH and pAg values at 40° C. to 5.8 and 8.8, respectively. The thus obtained emulsion contained tabular grains having an average equivalent sphere diameter of 1.80 $\mu$m, an average equivalent circle diameter of 2.30 $\mu$m and an average aspect ratio of 3.5. The ratio in projected area of grains having an aspect ratio of 8 or more to all the grains was 10%. The twin plane spacing was measured in the aforementioned manner, and it was found that the twin plane spacing was 0.065 $\mu$m.

This emulsion was heated to 56° C., and the optimum chemical sensitization thereof was effected by the addition of sensitizing dye ExS-12, chloroauric acid, potassium thiocyanate, sodium thiosulfate and compound (F-3) defined later. After the completion of chemical sensitization, compound (F-12) was added.

Preparation of emulsions Em-Y/Z (comparative emulsions)

1500 mL of an aqueous solution containing 19.5 g of KBr, 15.0 g of KI, 18.0 g of ammonium nitrate and 30.0 g of gelatin was maintained at 76° C. and vigorously agitated. An aqueous solution containing 60.0 g of silver nitrate and an aqueous solution containing 23.0 g of KBr were added thereto at constant rates over a period of 8 min.

Subsequently, 28 g of ammonia was added, and the mixture was allowed to stand still for 10 min. The pH value thereof was adjusted to 6 with the use of acetic acid, and further $1.5\times10^{-5}$ mol of thiourea dioxide and $1\times10^{-5}$ mol of oxidizer (F-14) defined below were added. Further, an aqueous solution containing 120.0 g of silver nitrate and an aqueous solution containing 82.5 g of KBr and 5.0 g of KI were added by the double jet method at constant rates over a period of 30 min.

Common washing was carried out, and gelatin was added so as to adjust the pH and pAg values at 40° C. to 5.8 and 8.8, respectively.

The thus obtained emulsion contained tabular grains having an average equivalent sphere diameter of 1.40 μm, an average equivalent circle diameter of 1.77 μm and an average aspect ratio of 3. The ratio in projected area of grains having an aspect ratio of 8 or more to all the grains was 10%.

The twin plane spacing was measured in the aforementioned manner, and it was found that the twin plane spacing was 0.060 μn.

(Preparation of Emulsion Em-Y)

This emulsion was heated to 56° C., and the optimum chemical sensitization thereof was effected by the addition of sensitizing dyes ExS-1, ExS-2 and ExS-3, chloroauric acid, potassium thiocyanate, sodium thiosulfate and compound (F-3) defined later. After the completion of chemical sensitization, compound (F-3) was added. Thus, emulsion Em-Y was obtained.

(Preparation of Emulsion Em-Z)

Emulsion Em-Z was prepared in the same manner as the emulsion Em-Y, except that the chemical sensitization was carried out with the use of sensitizing dyes ExS-5, ExS-6 and ExS-7 in place of the above sensitizing dyes.

Preparation of emulsion Em-1 (emulsion of the present invention)

(Preparation of Seed Emulsion)

1200 mL of an aqueous solution containing 1.0 g of a low-molecular-weight oxidized gelatin whose weight average molecular weight was 15,000 and 0.9 g of KBr was vigorously agitated while maintaining the temperature thereof at 35° C. 40 mL of an aqueous solution containing 1.85 g of $AgNO_3$ and 35 mL of an aqueous solution containing 1.82 g of KBr and 1.0 g of a low-molecular-weight gelatin whose weight average molecular weight was 15,000 were added by the double jet method over a period of 30 sec to thereby effect a nucleation. Immediately after the completion of addition, 5.4 g of KBr was added and heated to 75° C., and the mixture was ripened. After the completion of ripening, 35 g of gelatin obtained by chemically modifying an alkali-processed gelatin of 100 thousand weight average molecular weight with succinic anhydride was added. Thereafter, the pH was adjusted to 5.5. 250 mL of an aqueous solution containing 36 g of $AgNO_3$ and 282 mL of an aqueous solution containing 21.2 g of KBr and 2.81 g of KI were added by the double jet method over a period of 25 min, while maintaining the silver potential at −5 mV. Thereafter, 650 mL of an aqueous solution containing 200 g of $AgNO_3$ and 900 mL of an aqueous solution containing 134.1 g of KBr and 13.9 g of KI were added by the double jet method over a period of 100 min while increasing the flow rate so that the final flow rate was 1.4 times the initial flow rate. During this period, the silver potential was maintained at +5 mV against saturated calomel electrode. The thus obtained emulsion was washed, and gelatin was added so that the pH was adjusted to 5.7, the pAg to 8.8, the weight in terms of silver per kg of emulsion to 139.0 g and the gelatin weight to 56 g. Thus, a seed emulsion was obtained.

1200 mL of an aqueous solution containing 33 g of g of lime-processed gelatin having a calcium concentration of 1 ppm and 3.4 g of KBr was vigorously agitated while maintaining the temperature thereof at 75° C. 89 g of the above seed emulsion was added, and further 0.3 of modified silicone oil (L7602, produced by Nippon Unicar Company, Limited) was added. $H_2SO_4$ was added to thereby adjust the pH value to 5.8. 2 mg of sodium benzenethiosulfonate and 2 mg of thiourea dioxide were added. 600 mL of an aqueous solution containing 51.0 g of $AgNO_3$ and 600 mL of an aqueous solution containing 36.2 g of KBr and 3.49 g of KI were added by the double jet method over a period of 85 min while increasing the flow rate so that the final flow rate was 1.1 times the initial flow rate. During this period, the silver potential was maintained at −35 mV against saturated calomel electrode. Further, 300 mL of an aqueous solution containing 44.7 g of $AgNO_3$ and 300 mL of an aqueous solution containing 30.6 g of KBr and 3.06 g of KI were added by the double jet method over a period of 56 min while increasing the flow rate so that the final flow rate was 1.1 times the initial flow rate. During this period, the silver potential was maintained at —35 mV against saturated calomel electrode. Subsequently, an aqueous solution of KBr and 180 ml of an aqueous solution containing 36.9 g of $AgNO_3$ were added over a period of 40 min. During this period, the silver potential was maintained at +10 mV against saturated calomel electrode. KBr was added so as to adjust the silver potential to −70 mV. Thereafter, 1.38 g, in terms of the weight of KI, of AgI fine grain emulsion of 0.037 μm grain size was added. Immediately after the completion of addition, 100 mL of an aqueous solution containing 17.4 g of $AgNO_3$ was added over a period of 15 min. The mixture was washed with water, and gelatin was added so as to adjust the pH and pAg at 40° C. to 5.8 and 8.7, respectively. This emulsion was heated to 60° C., and compound 2 and sensitizing dyes ExS-10 and ExS-13 were added. The optimum chemical sensitization thereof was effected by the addition of potassium thiocyanate, chloroauric acid, sodium thiosulfate, hexafluorophenyldiphenylphosphine selenide, compound (F-11) and compound 3. At the completion of chemical sensitization, compound (F-3) defined later was added.

The thus obtained emulsion contained tabular grains having an average equivalent sphere diameter of 1.65 μm, an average equivalent circle diameter of 3.10 μm, a variation coefficient of equivalent circle diameter of 20% and an average aspect ratio of 10.0. The ratio in projected area of grains having an aspect ratio of 8 or more to all the grains was 90%. The twin plane spacing, measured in the aforementioned manner, was 0.015 μm.

The thus obtained grains were observed through a transmission electron microscope while cooling the same with liquid nitrogen. As a result, it was found that grains each having no dislocation line in a region extending from the grain center to 80% of its projected area constituted about 98% of all the grains, and that there were 10 or more dislocation lines per grain on grain peripheral portions extending from the grain extreme periphery to 20% of the projected area.

Preparation of Emulsions Em-2/3 (Emulsions of the Present Invention)

1300 mL of an aqueous solution containing 1.6 g of a low-molecular-weight oxidized gelatin whose weight average molecular weight was 15,000 and 1.0 g of KBr was vigorously agitated while maintaining the temperature at 58 and adjusting the pH to 9.

An aqueous solution containing 1.3 g of $AgNO_3$ and an aqueous solution containing 1.1 g of KBr and 0.7 g of a low-molecular-weight gelatin whose weight average molecular weight was 15,000 were added by the double jet method over a period of 30 sec to thereby effect a nucleation. 6.6 g of KBr was added and heated to 78° C., and the mixture was ripened. After the completion of ripening, 15.0 g of gelatin obtained by chemically modifying an alkali-processed gelatin of 100 thousand weight average molecular weight with succinic anhydride was added. Thereafter, the pH was adjusted to 5.5. An aqueous solution containing 15.8 g of KBr and 1.92 g of KI and 230 mL of an aqueous solution containing 29.3 g of $AgNO_3$ were added by the double jet method over a period of 30 min. During this period, the silver potential was maintained at −20 mV against saturated calomel electrode. Thereafter, an aqueous solution containing 64.5 g of $AgNO_3$ and 233 mL of an aqueous solution containing 42.3 g of KBr and 5.14 g of KI were added by the double jet method over a period of 37 min while increasing the flow rate so that the final flow rate was 1.33 times the initial flow rate. During this period, while the addition was being effected, the silver potential was maintained at −20 mV. Thereafter, an aqueous solution containing 70.8 g of $AgNO_3$ and an aqueous solution of KBr were added by the double jet method over a period of 35 min, while maintaining the silver potential at −10 mV.

The mixture was cooled to 40° C., and 4.9 g of compound 1 was added. Further, 32 mL of a 0.8 M aqueous sodium sulfite solution was added. The mixture had its pH value adjusted to 9.0 with the use of an aqueous solution of NaOH and was held still for 5 min. The resultant mixture was heated to 55° C., and the pH value thereof was adjusted to 5.5 with $H_2SO_4$. 1 mg of sodium benzenethiosulfonate was added, and further 13 g of lime-processed gelatin having a calcium concentration of 1 ppm was added. After the completion of addition, an aqueous solution of KBr and 250 mL of an aqueous solution containing 71.0 g of $AgNO_3$ were added over a period of 20 min, while maintaining the silver potential at +75 mV. During this period, $1.0\times10^{-5}$ mol of yellow prussiate of potash was added per mol of silver, and $1\times10^{-8}$ mol of $K_2IrCl_6$ added per mol of silver. The mixture was washed with water, and gelatin was added so as to adjust the pH and pAg at 40° C. to 6.5 and 8.8, respectively.

The thus obtained emulsion contained tabular grains having an average equivalent sphere diameter of 1.33 μm, an average equivalent circle diameter of 2.63 μm and an average aspect ratio of 11.4. The ratio in projected area of grains having an aspect ratio of 8 or more to all the grains was 95%, and the twin plane spacing of tabular grains was 0.012 μm.

The thus obtained grains were observed through a transmission electron microscope while cooling the same with liquid nitrogen. As a result, it was found that grains each having no dislocation line in a region extending from the grain center to 80% of its projected area constituted about 90% of all the grains, and that there were 10 or more dislocation lines per grain on grain peripheral portions extending from the grain extreme periphery to 20% of the projected area.

(Preparation of Emulsion Em-2)

The obtained emulsion was heated to 56° C., and compound 2 and sensitizing dyes ExS-1, ExS-2 and ExS-3 were added. Thereafter, the optimum chemical sensitization thereof was effected by the addition of potassium thiocyanate, chloroauric acid, sodium thiosulfate, hexafluorophenyldiphenylphosphine selenide, compound (F-11) defined later and compound 3. At the completion of chemical sensitization, compound (F-2) defined later was added.

(Preparation of Emulsion Em-3)

Emulsion Em-3 was prepared in the same manner as the emulsion Em-2, except that the chemical sensitization was carried out with the sensitizing dyes changed to sensitizing dyes ExS-7, ExS-8 and ExS-9.

(Preparation of Emulsion Em-N)

1250 mL of an aqueous solution containing 48 g of deionized gelatin and 0.75 g of KBr was vigorously agitated while maintaining the temperature at 70° C.

276 mL of an aqueous solution containing 12.0 g of $AgNO_3$) and an equimolar-concentration aqueous solution of KBr were added to the aqueous solution by the double jet method over a period of 7 min while maintaining the pAg at 7.26. Subsequently, 600 mL of an aqueous solution containing 108.0 g of AgNO3 and an equimolar-concentration aqueous solution of a mixture of KBr and KI (2.0 mol % KI) were added by the double jet method over a period of 18 min 30 sec while maintaining the pAg at 7.30. Further, 18.0 mL of a 0.1% by weight aqueous thiosulfonic acid solution was added 5 min before the completion of the addition. The obtained emulsion was desalted and washed by the customary flocculation method, and re-dispersed. At 40° C., the pH and pAg were adjusted to 6.2 and 7.6, respectively. The temperature of the emulsion was controlled at 40° C., and compound 2 and sensitizing dyes ExS-10 and ExS-12 were added. Further, potassium thiocyanate, chloroauric acid, sodium thiosulfate, hexafluorophenyldiphenylphosphine selenide, compound (F-11) and compound 3 were added to the emulsion, and heated to 68C to thereby effect the optimum chemical sensitization thereof. At the completion of chemical sensitization, compound (F-2) defined later was added.

The obtained emulsion contained cubic grains having an equivalent sphere diameter of 0.19 μn and a variation coefficient of equivalent sphere diameter of 14%.

Emulsions Em-B to D, Em-F to J, Em-L and M and Em-O to R were prepared in the same manner as the above emulsions Em-1, 2 and 3, except that the temperature, pH, silver potential, amount of silver nitrate, amount of KI, amount of compounds, type of sensitizing dyes, amount of seed emulsion, etc. were appropriately changed.

Lists of the thus obtained emulsions are given in Tables 1 and 2.

TABLE 1

| | Av. ECD (μm) | Av. Aspect ratio | Av. ESD (μm) | Grain shape | Dislocation line (number per grain) | Twin plane spacing (μm) | Ratio of grains having aspect ratio of 8 or more to the total projected area (%) |
|---|---|---|---|---|---|---|---|
| Em-B | 1.50 | 6.0 | 0.80 | Tabular | 10 or more | 0.012 | 45 |
| Em-C | 0.85 | 7.1 | 0.51 | Tabular | 10 or more | 0.012 | 55 |
| Em-D | 0.40 | 2.7 | 0.35 | Tabular | 10 or more | 0.011 | 10 or less |
| Em-F | 2.00 | 3.0 | 0.92 | Tabular | 10 or more | 0.013 | 10 |
| Em-G | 1.60 | 7.0 | 0.79 | Tabular | 10 or more | 0.012 | 50 |

TABLE 1-continued

| | Av. ECD (μm) | Av. Aspect ratio | Av. ESD (μm) | Grain shape | Dislocation line (number per grain) | Twin plane spacing (μm) | Ratio of grains having aspect ratio of 8 or more to the total projected area (%) |
|---|---|---|---|---|---|---|---|
| Em-H | 0.85 | 7.1 | 0.51 | Tabular | 10 or more | 0.012 | 55 |
| Em-I | 0.58 | 3.2 | 0.45 | Tabular | 10 or more | 0.010 | 15 |
| Em-J | 2.00 | 7.0 | 0.92 | Tabular | 10 or more | 0.012 | 50 |
| Em-L | 1.25 | 4.3 | 0.89 | Tabular | 10 or more | 0.011 | 15 |
| Em-M | 0.55 | 4.6 | 0.37 | Tabular | 10 or more | 0.010 | 20 |
| Em-N | — | — | 0.19 | Cubic | — | — | 10 or less |
| Em-O | 1.76 | 9.5 | 0.95 | Tabular | 10 or more | 0.012 | 85 |
| Em-P | 2.20 | 6.9 | 1.33 | Tabular | 10 or more | 0.013 | 50 |
| Em-Q | 1.50 | 6.0 | 0.80 | Tabular | 10 or more | 0.012 | 45 |
| Em-R | 0.85 | 7.1 | 0.51 | Tabular | 10 or more | 0.012 | 50 |
| Em-X | 2.30 | 3.5 | 1.80 | Thick plate twin crystal | Could not determine | 0.065 | 10 |
| Em-Y | 1.77 | 3.0 | 1.40 | Thick plate twin crystal | Could not determine | 0.060 | 10 |
| Em-Z | 1.77 | 3.0 | 1.40 | Thick plate twin crystal | Could not determine | 0.060 | 10 |

ECD = Equivalent circle diameter
ESD = Equivalent sphere diameter

TABLE 2

| | ECD (μm) | Aspect ratio | ESD (μm) | Grain shape | Dislocation line (number per grain) | Twin plane spacing (μm) | Ratio of grains having aspect ratio of 8 or more to the total projected area (%) |
|---|---|---|---|---|---|---|---|
| Em-1 | 3.10 | 10.0 | 1.65 | Tabular | 10 or more | 0.015 | 90 |
| Em-2 | 2.63 | 11.4 | 1.33 | Tabular | 10 or more | 0.012 | 95 |
| Em-3 | 2.63 | 11.4 | 1.33 | Tabular | 10 or more | 0.012 | 95 |

ECD = Equivalent circle diameter
ESD = Equivalent sphere diameter

Preparation of Coating Sample

A support of cellulose triacetate film furnished with a substratum was coated with a plurality of layers of the following compositions, thereby preparing multilayer color lightsensitive material sample 101.

(Composition of Lightsensitive Layer)

Main materials for use in each layer are classified as follows:

ExC: cyan coupler; ExS: spectral sensitizing dye
UV: ultraviolet absorber;
ExM: magenta coupler; HBS: high-boiling organic Solvent;
ExY: yellow coupler; H: gelatin hardener (For each specific compound, in the following description, numeral is assigned after the character, and the formula is shown later).

The figure given beside the description of each component is for the coating amount expressed in the unit of g/m$^2$. With respect to a silver halide, the coating amount is in terms of silver. With respect to a spectral sensitizing dye, the coating amount is expressed in the unit of mol per mol of silver halide present in the same layer.

| | | |
|---|---|---|
| 1st layer (1st antihalation layer) | | |
| Black colloidal silver | silver | 0.070 |
| Gelatin | | 0.660 |
| ExM-1 | | 0.048 |
| Cpd-2 | | 0.001 |
| F-8 | | 0.001 |
| HBS-1 | | 0.090 |
| HBS-2 | | 0.010 |
| 2nd layer (2nd antihalation layer) | | |
| Black colloidal silver | silver | 0.090 |
| Gelatin | | 0.830 |
| ExM-1 | | 0.057 |
| ExF-1 | | 0.002 |
| F-8 | | 0.001 |
| HBS-1 | | 0.090 |
| HBS-2 | | 0.010 |
| 3rd layer (Interlayer) | | |
| ExC-2 | | 0.010 |
| Cpd-1 | | 0.086 |
| UV-2 | | 0.029 |
| UV-3 | | 0.052 |
| UV-4 | | 0.011 |
| HBS-1 | | 0.100 |
| Gelatin | | 0.580 |
| 4th layer (Low-speed red-sensitive emulsion layer) | | |
| Em-D | silver | 0.57 |
| Em-C | silver | 0.47 |

-continued

| | | |
|---|---|---|
| ExC-1 | | 0.222 |
| ExC-2 | | 0.010 |
| ExC-3 | | 0.072 |
| ExC-4 | | 0.148 |
| ExC-5 | | 0.005 |
| ExC-6 | | 0.008 |
| ExC-8 | | 0.071 |
| ExC-9 | | 0.010 |
| ExS-1 | | $1.4 \times 10^{-3}$ |
| ExS-2 | | $6.0 \times 10^{-4}$ |
| ExS-3 | | $2.0 \times 10^{-5}$ |
| UV-2 | | 0.036 |
| UV-3 | | 0.067 |
| UV-4 | | 0.014 |
| Cpd-2 | | 0.010 |
| Cpd-4 | | 0.012 |
| HBS-1 | | 0.240 |
| HBS-5 | | 0.010 |
| Gelatin | | 1.630 |
| 5th layer (Medium-speed red-sensitive emulsion layer) | | |
| Em-B | silver | 0.63 |
| ExC-1 | | 0.111 |
| ExC-2 | | 0.039 |
| ExC-3 | | 0.018 |
| ExC-4 | | 0.074 |
| ExC-5 | | 0.019 |
| ExC-6 | | 0.024 |
| ExC-8 | | 0.010 |
| ExC-9 | | 0.005 |
| ExS-1 | | $6.3 \times 10^{-4}$ |
| ExS-2 | | $2.6 \times 10^{-4}$ |
| ExS-3 | | $8.7 \times 10^{-6}$ |
| Cpd-2 | | 0.020 |
| Cpd-4 | | 0.021 |
| HBS-1 | | 0.129 |
| Gelatin | | 0.900 |
| 6th layer (High-speed red-sensitive emulsion layer) | | |
| Em-Y | silver | 1.27 |
| ExC-1 | | 0.122 |
| ExC-6 | | 0.032 |
| ExC-8 | | 0.110 |
| ExC-9 | | 0.005 |
| ExC-10 | | 0.159 |
| ExS-1 | | $3.2 \times 10^{-4}$ |
| ExS-2 | | $2.6 \times 10^{-4}$ |
| ExS-3 | | $8.8 \times 10^{-6}$ |
| Cpd-2 | | 0.068 |
| Cpd-4 | | 0.015 |
| HBS-1 | | 0.440 |
| Gelatin | | 1.610 |
| 7th layer (Interlayer) | | |
| Cpd-1 | | 0.081 |
| Cpd-6 | | 0.002 |
| Solid disperse dye ExF-4 | | 0.015 |
| HBS-1 | | 0.049 |
| Polyethyl acrylate latex | | 0.088 |
| Gelatin | | 0.759 |
| 8th layer (Layer capable of exerting interlayer effect on red-sensitive layer) | | |
| Em-J | silver | 0.40 |
| Cpd-4 | | 0.010 |
| ExM-2 | | 0.082 |
| ExM-3 | | 0.006 |
| ExM-4 | | 0.026 |
| ExY-1 | | 0.010 |
| ExY-4 | | 0.040 |
| ExC-7 | | 0.007 |
| ExS-4 | | $7.0 \times 10^{-4}$ |
| ExS-5 | | $2.5 \times 10^{-4}$ |
| HBS-1 | | 0.203 |
| HBS-3 | | 0.003 |
| HBS-5 | | 0.010 |
| Gelatin | | 0.570 |

-continued

| | | |
|---|---|---|
| 9th layer (Low-speed green-sensitive emulsion layer) | | |
| Em-H | silver | 0.23 |
| Em-G | silver | 0.15 |
| Em-I | silver | 0.26 |
| ExM-2 | | 0.388 |
| ExM-3 | | 0.040 |
| ExY-1 | | 0.003 |
| ExY-3 | | 0.002 |
| ExC-7 | | 0.009 |
| ExS-5 | | $3.0 \times 10^{-4}$ |
| ExS-6 | | $8.4 \times 10^{-5}$ |
| ExS-7 | | $1.1 \times 10^{-4}$ |
| ExS-8 | | $4.5 \times 10^{-4}$ |
| ExS-9 | | $1.3 \times 10^{-4}$ |
| HBS-1 | | 0.337 |
| HBS-3 | | 0.018 |
| HBS-4 | | 0.260 |
| HBS-5 | | 0.110 |
| Cpd-5 | | 0.010 |
| Gelatin | | 1.470 |
| 10th layer (Medium-speed green-sensitive emulsion layer) | | |
| Em-F | silver | 0.42 |
| ExM-2 | | 0.084 |
| ExM-3 | | 0.012 |
| ExM-4 | | 0.005 |
| ExY-3 | | 0.002 |
| ExC-6 | | 0.003 |
| ExC-7 | | 0.007 |
| ExC-8 | | 0.008 |
| ExS-7 | | $1.0 \times 10^{-4}$ |
| ExS-8 | | $7.1 \times 10^{-4}$ |
| ExS-9 | | $2.0 \times 10^{-4}$ |
| HBS-1 | | 0.096 |
| HBS-3 | | 0.002 |
| HBS-5 | | 0.002 |
| Cpd-5 | | 0.004 |
| Gelatin | | 0.382 |
| 11th layer (High-speed green-sensitive emulsion layer) | | |
| Em-Z | silver | 0.95 |
| ExC-6 | | 0.002 |
| ExC-8 | | 0.010 |
| ExM-1 | | 0.014 |
| ExM-2 | | 0.023 |
| ExM-3 | | 0.023 |
| ExM-4 | | 0.005 |
| ExM-5 | | 0.040 |
| ExY-3 | | 0.003 |
| ExS-7 | | $8.4 \times 10^{-4}$ |
| ExS-8 | | $5.9 \times 10^{-4}$ |
| ExS-9 | | $1.7 \times 10^{-4}$ |
| Cpd-3 | | 0.004 |
| Cpd-4 | | 0.007 |
| Cpd-5 | | 0.010 |
| HBS-1 | | 0.259 |
| HBS-5 | | 0.020 |
| Polyethyl acrylate latex | | 0.099 |
| Gelatin | | 0.781 |
| 12th layer (Yellow filter layer) | | |
| Cpd-1 | | 0.088 |
| Solid disperse dye ExF-2 | | 0.051 |
| Solid disperse dye ExF-8 | | 0.010 |
| HBS-1 | | 0.049 |
| Gelatin | | 0.593 |
| 13th layer (Low-speed blue-sensitive emulsion layer) | | |
| Em-N | silver | 0.12 |
| Em-M | silver | 0.09 |
| Em-L | silver | 0.50 |
| ExC-1 | | 0.024 |
| ExC-7 | | 0.011 |
| ExY-1 | | 0.002 |
| ExY-2 | | 0.956 |
| ExY-4 | | 0.091 |
| ExS-10 | | $8.5 \times 10^{-5}$ |

-continued

| | | |
|---|---|---|
| ExS-11 | | $6.4 \times 10^{-4}$ |
| ExS-12 | | $8.5 \times 10^{-5}$ |
| ExS-13 | | $5.0 \times 10^{-4}$ |
| Cpd-2 | | 0.037 |
| Cpd-3 | | 0.004 |
| HBS-1 | | 0.372 |
| HBS-5 | | 0.047 |
| Gelatin | | 2.201 |
| 14th layer (High-speed blue-sensitive emulsion layer) | | |
| Em-X | silver | 1.22 |
| ExY-2 | | 0.235 |
| ExY-4 | | 0.018 |
| ExS-10 | | $1.5 \times 10^{-4}$ |
| ExS-13 | | $2.0 \times 10^{-4}$ |
| Cpd-2 | | 0.075 |
| Cpd-3 | | 0.001 |
| HBS-1 | | 0.087 |
| Gelatin | | 1.156 |
| 15th layer (1st protective layer) | | |
| 0.07 μm silver iodobromide emulsion | silver | 0.28 |
| UV-1 | | 0.358 |
| UV-2 | | 0.179 |
| UV-3 | | 0.254 |
| UV-4 | | 0.025 |
| F-11 | | 0.0081 |
| SC-1 | | 0.078 |
| ExF-5 | | 0.0024 |
| ExF-6 | | 0.0012 |
| ExF-7 | | 0.0010 |
| HBS-1 | | 0.175 |
| HBS-4 | | 0.050 |
| Gelatin | | 2.231 |
| 16th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| SC-1 | | 0.200 |
| Gelatin | | 0.711. |

In addition to the above components, W-1 to W-6, B-4 to B-6, F-1 to F-17, a lead salt, a platinum salt, an iridium salt and a rhodium salt were appropriately added to the above individual layers in order to improve the storage life, processability, resistance to pressure, antiseptic and mildew-proofing properties, antistatic properties and applicability thereof.

Preparation of dispersion of organic solid disperse dye:

The ExF-2 of the 12th layer was dispersed by the following method. Specifically,

| | |
|---|---|
| Wet cake of ExF-2 (contg. 17.6 wt. % water) | 2.800 kg |
| Sodium octylphenyldiethoxymethanesulfonate (31 wt. % aq. soln.) | 0.376 kg |
| F-15 (7% aq. soln.) | 0.011 kg |
| Water | 4.020 kg |
| Total | 7.210 kg |

(adjusted to pH = 7.2 with NaOH).

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-8 were obtained in similar manners. The average particle diameters of these dye particulates were 0.28 μm and 0.49 μm, respectively.

The compounds employed in the emulsion preparation and compounds incorporated in the above layers in the preparation of coating sample will be specified below.

ExS-1

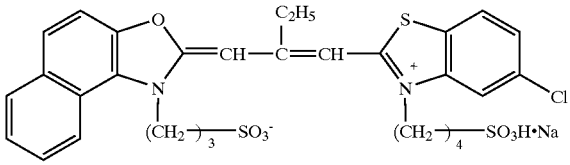

ExS-2

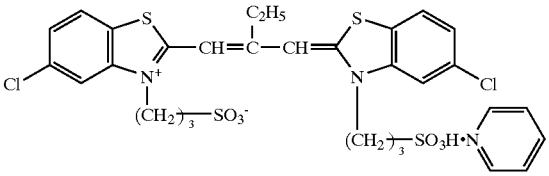

ExS-3

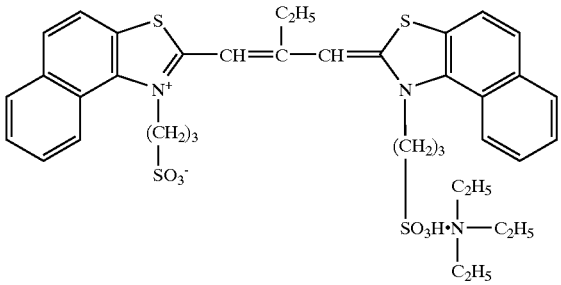

ExS-4

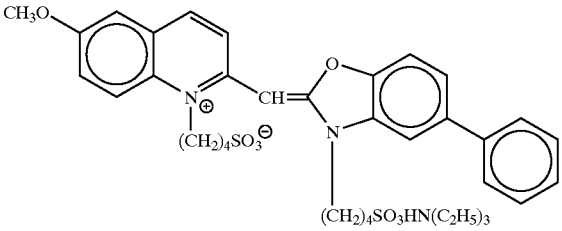

Compound 1

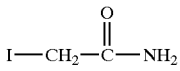

-continued
Compound 2
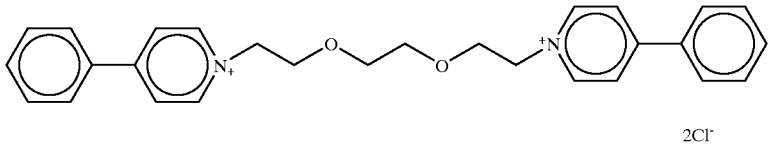
Compound 3
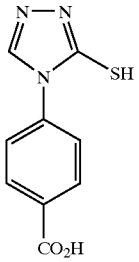
ExS-5
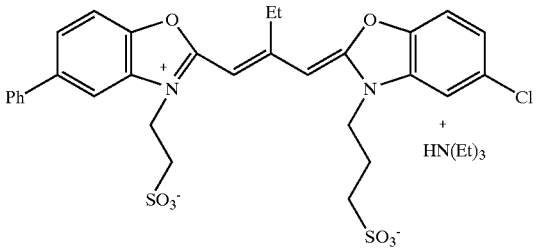
ExS-6
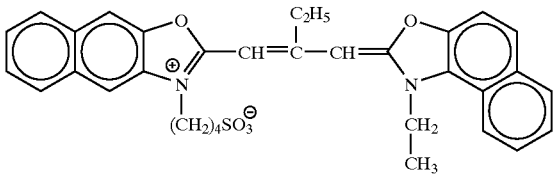
ExS-7
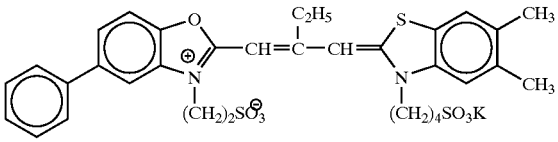
ExS-8
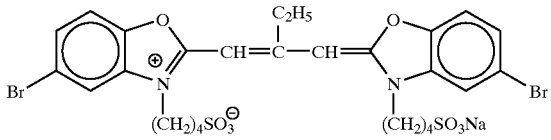
ExS-9
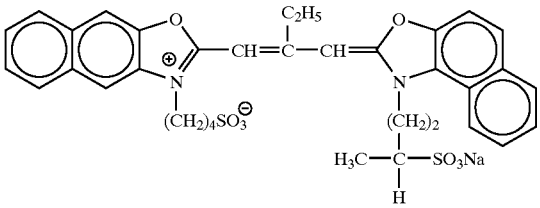
ExS-10
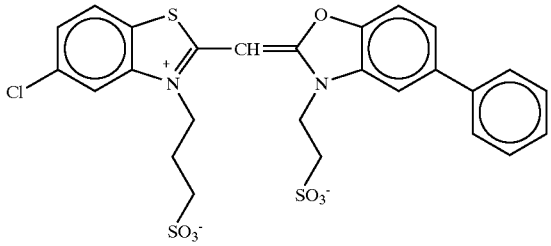
ExS-11
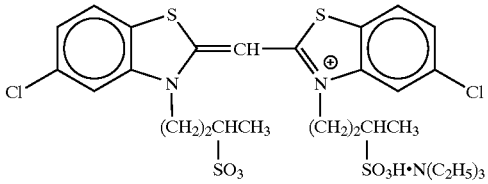
ExS-12
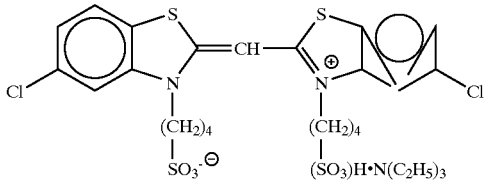
ExS-13
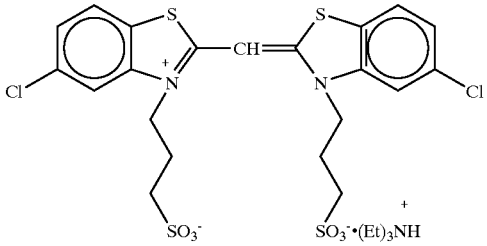

-continued
ExC-1
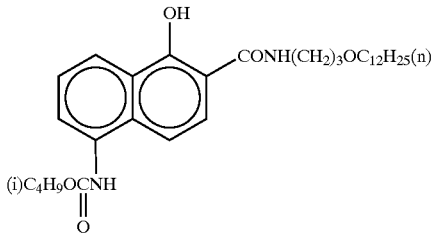
ExC-2
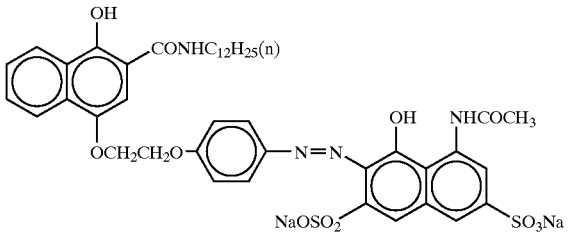
ExC-3
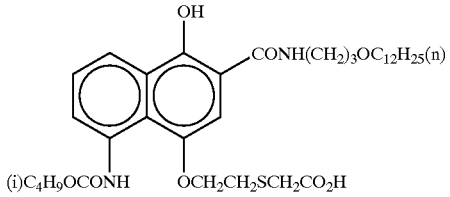
ExC-4
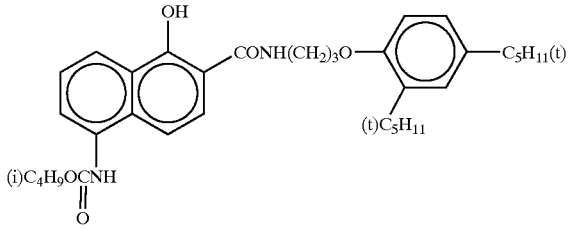
ExC-5
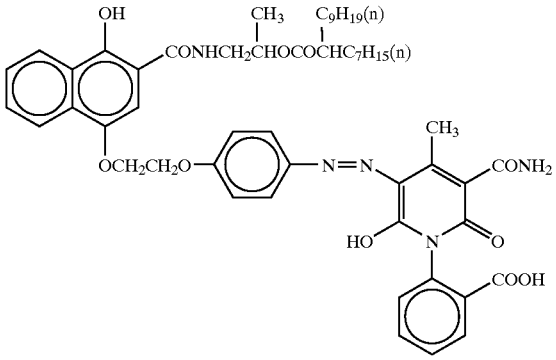
ExC-6
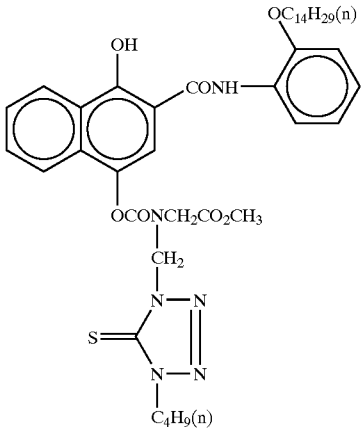
ExM-1
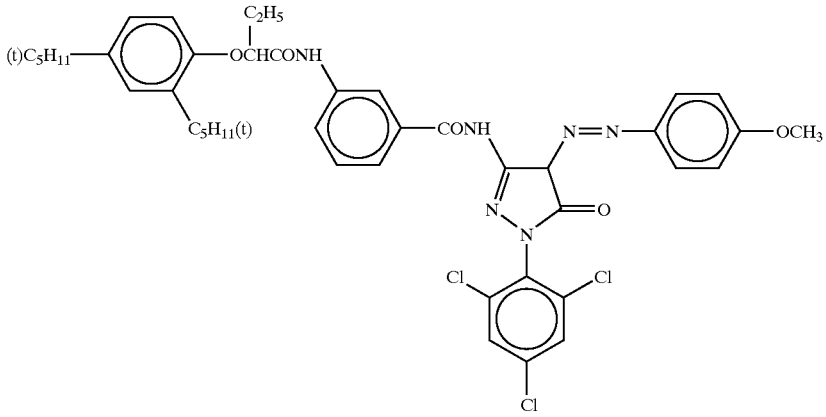

-continued
ExM-2
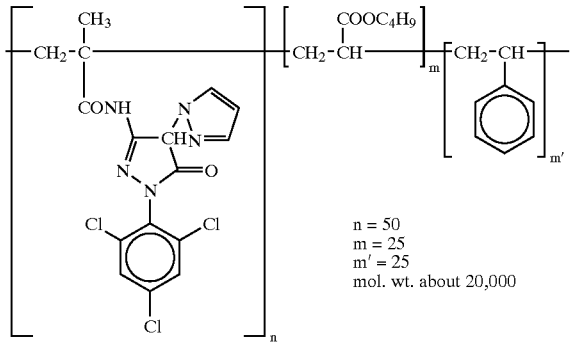
ExM-3
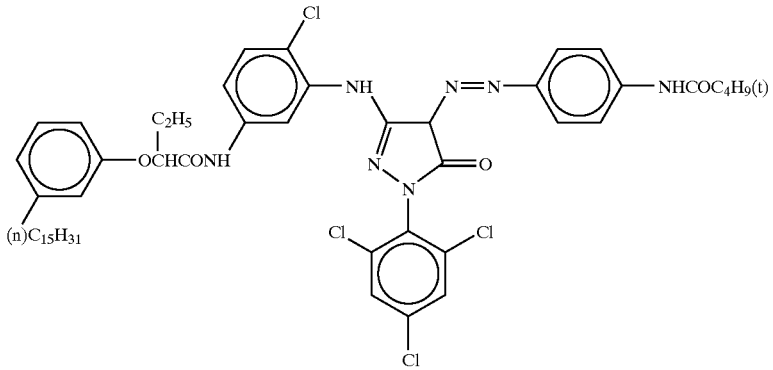
ExM-4
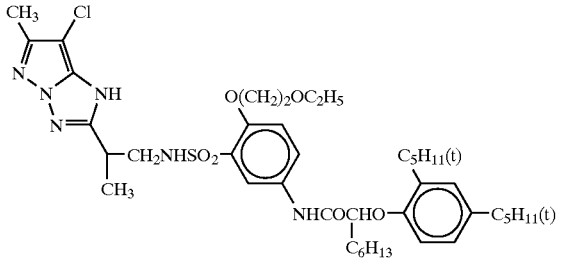
ExM-5
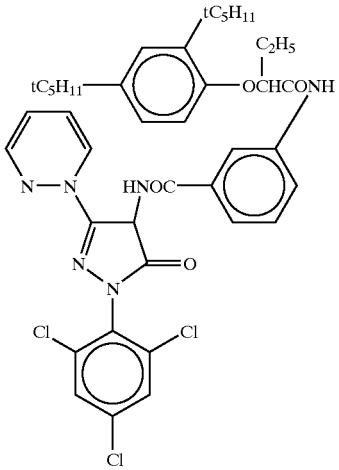
ExY-1
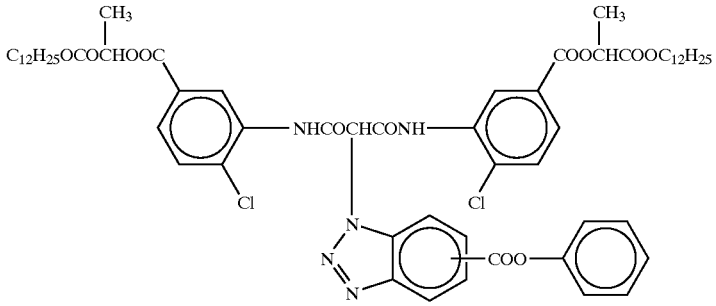

-continued
ExY-2
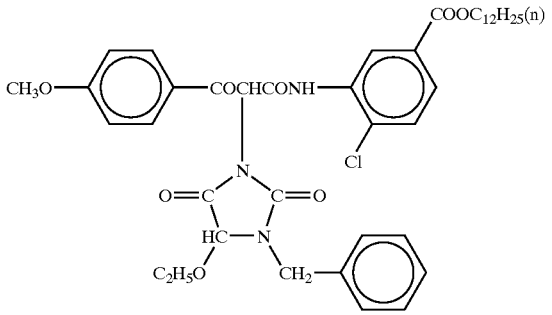
ExY-3
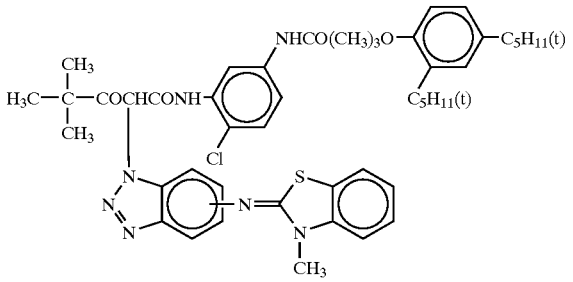
ExY-4
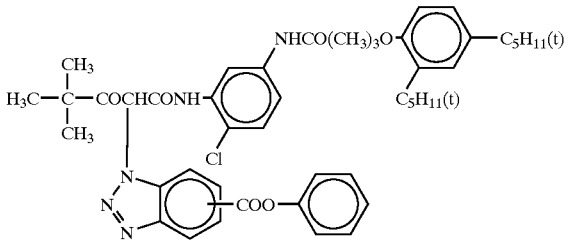
Cpd-1
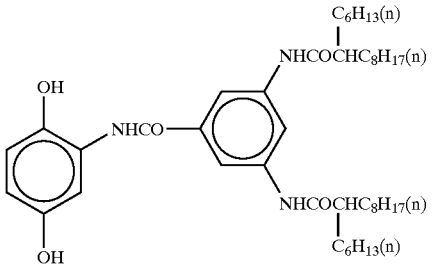
Cpd-2
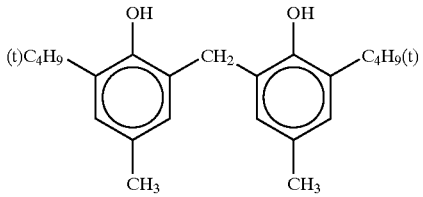
Cpd-3
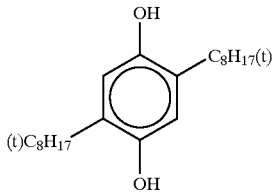
Cpd-4
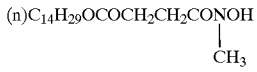
Cpd-5
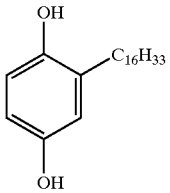
Cpd-6
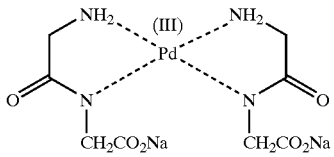
UV-1
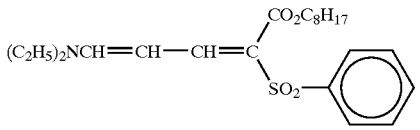
UV-2
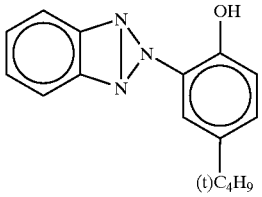
UV-3
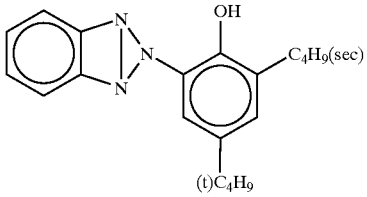
UV-4
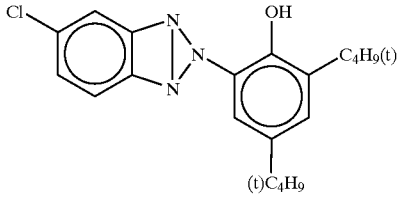
B-1
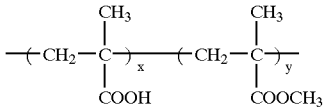
x/y = 10/90 (Weight ratio)
Av. Molecular wt. : about 35,000

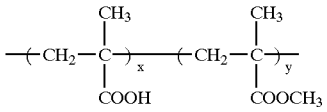
x/y = 40/60 (Weight ratio)
Av. Molecular wt. : about 20,000
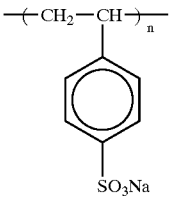
Av. Molecular wt. : about 750,000
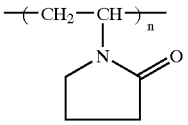
Av. molecular wt. : about 10,000
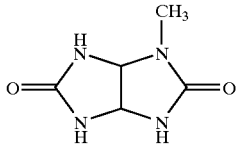
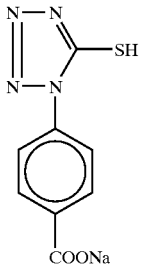
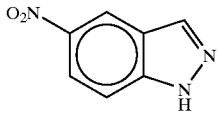
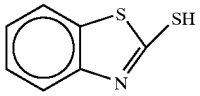
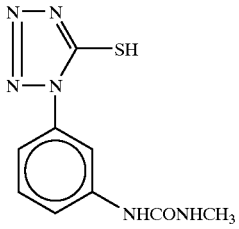
-continued
B-2
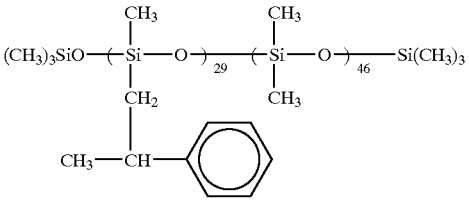
(Molar ratio)
Av. Molecular wt. : about 8,000
B-3
B-4
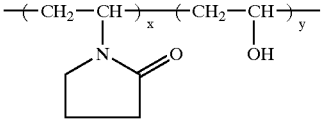
x/y = 70/30 (Weight ratio)
Av. Molecular wt. : about 17,000
B-5
B-6
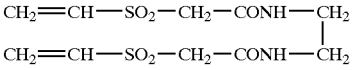
H-1
SC-1
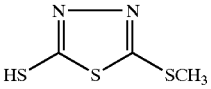
F-1
F-2
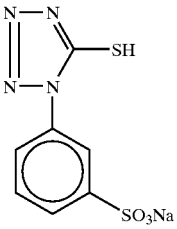
F-3
F-4
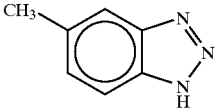
F-5
F-6
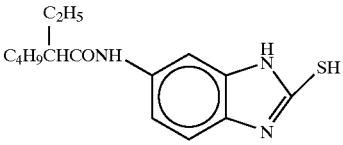
F-7
F-8
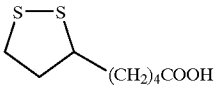
F-9

-continued
F-10
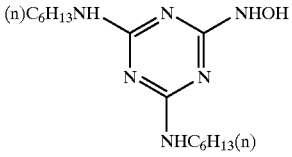
F-11
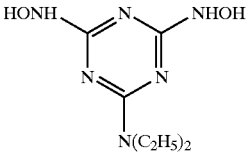
F-12
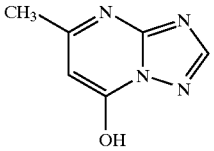
F-13
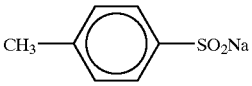
F-14
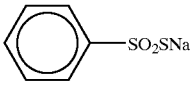
F-15
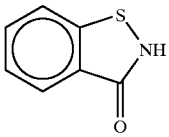
F-16
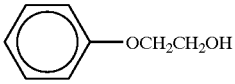
F-17
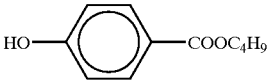
W-1
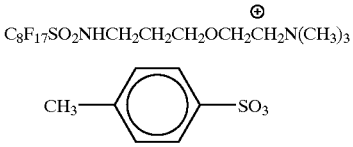
W-2
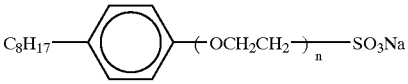
n = 2-4
W-3
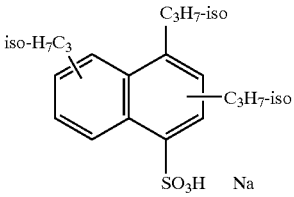
W-4
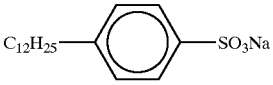
W-5
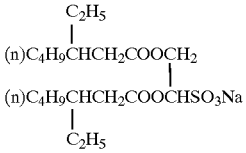
W-6
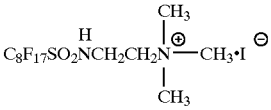
HBS-1
Tricresyl phosphate
HBS-2
Di-n-butyl phthalate
HBS-3
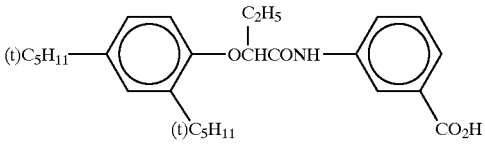
HBS-4
Tri(2-ethylhexyl) phosphate
HBS-5
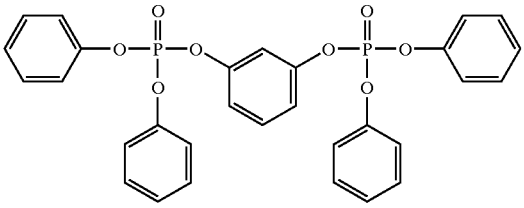
ExC-7
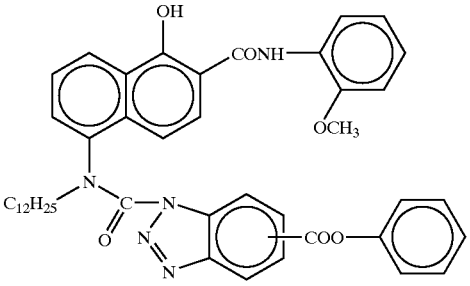

-continued
Exc-8
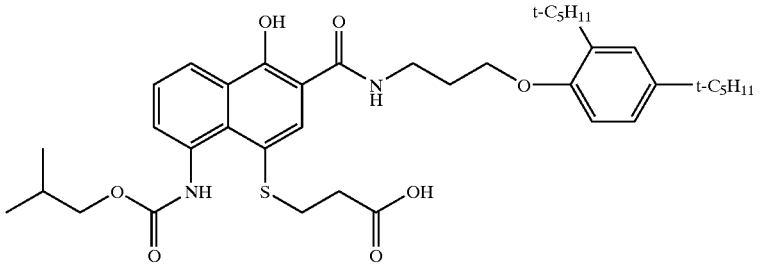
ExC-9
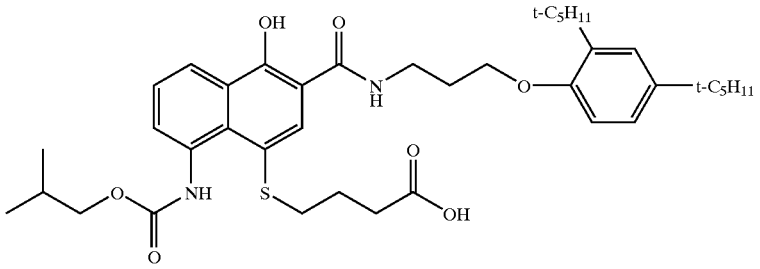
ExC-10
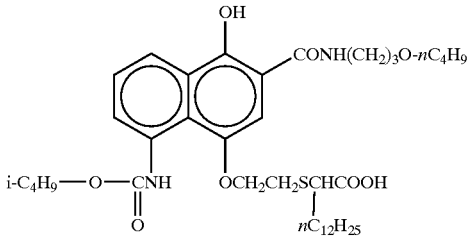
ExF-1
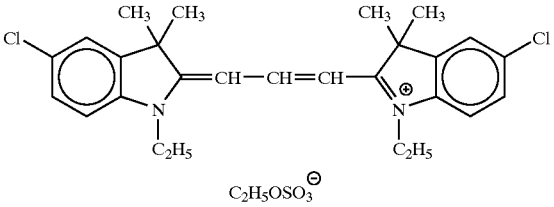
ExF-2
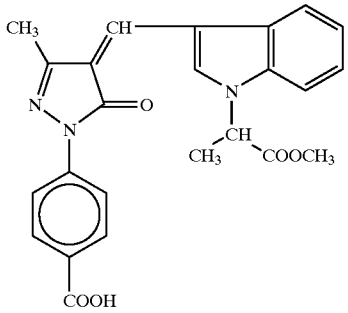
ExF-4
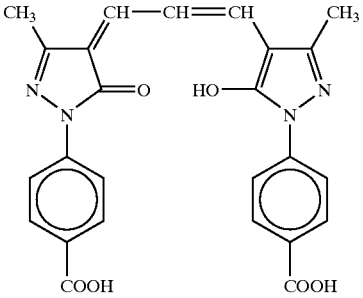
ExF-5
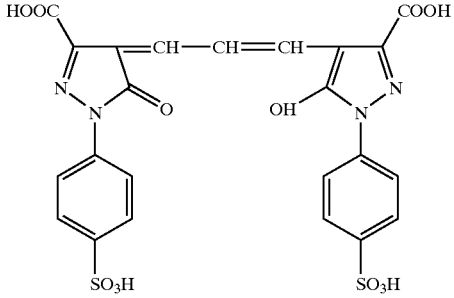

-continued

ExF-6

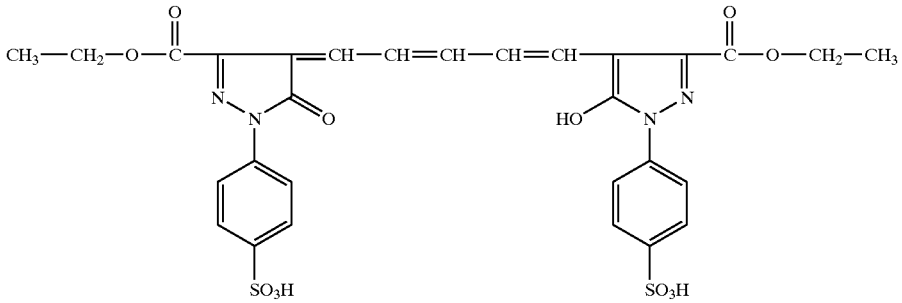

ExF-7

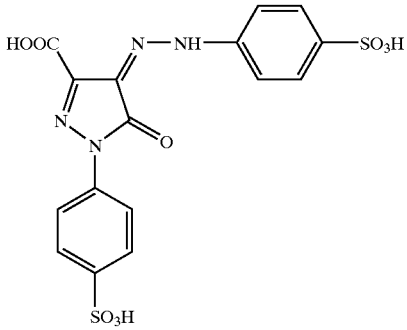

ExF-8

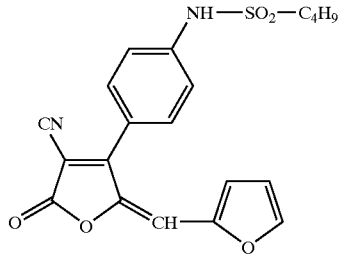

Sample 102 was prepared in the same manner as the above sample 101, except that only the silver halide emulsions of the 6th, 11th and 14th layers were changed as specified in Table 3. The ISO speed of each of the samples was measured by the method according to JIS K 7614-1981. Results of this measurement together with the photographic speed values of individual layers determined relative to those of the sample 101 are listed in Table 3. With respect to the sample 102 wherein emulsions of the present invention are employed, a photographic speed increase over that of the sample 101 can be recognized.

The relative photographic speed was determined by the above method of measuring ISO photographic speed.

Specifically, the fog was defined as the minimum values of yellow density, magenta density and cyan density (DYmin, DMmin and DCmin). The phonographic speed of each color-sensitive layer was defined as the logarithm of inverse number of exposure quantity required for realizing a density which was 0.15 higher than each of DYmin, DMmin and DCmin. The photographic speed of the sample 102 was expressed by a value relative to that of the sample 101 postulated as being 100.

TABLE 3

Emulsion constitution and sensitivity

| Sample No. | Emulsion of 6th layer | Emulsion of 11th layer | Emulsion of 14th layer | ISO speed | Relative sensitivity (red) | Relative sensitivity (green) | Relative sensitivity (blue) | Remarks |
|---|---|---|---|---|---|---|---|---|
| 101 | Em-Y | Em-Z | Em-X | 1400 | 100 | 100 | 100 | Comp. |
| 102 | Em-2 | Em-3 | Em-1 | 1600 | 130 | 122 | 114 | Inv. |

Subsequently, lens-fitted packaging units were molded using each of the following sample resins. These were loaded with the samples 101 and 102, thereby obtaining lens-fitted photographic lightsensitive material packaging units.

Single FIGURE is a perspective view of a fabricated lens-fitted film unit. Now, the molding of a cartridge and the assembly of a unit will be described. Referring to Single FIGURE, three members designated as front cover 4, body base 3 and back cover were formed by means of hot-runner-type metal molds. Other parts, including exposure unit 6, strobe unit 7, patrone chamber 10 with an opening 10*a*, film role chamber 11, patrone 12, a photographic film 13, base tap 25, stopper pins 26*a* and 26*b*, were assembled into the body 2, followed by assembly of the front cover. The thus obtained unit was loaded with the above prepared samples 101 and 102. Finally, the back cover was assembled thereinto, thereby obtaining a lens-fitted lightsensitive material packaging unit. This lens-fitted lightsensitive material packaging unit together with a separately supplied explanatory pasteboard was packaged by a packaging machine with the use of a packaging film produced by laminating a polyethylene film with an aluminum foil. The packaging was well-known pillow type packaging whereby a bag configuration was formed with three-way hot melt seal, thereby obtaining a sealed package inhibiting the infiltration of external air.

Sample resins 1 to 21 were produced in the following manner, molded into unit members, and assembled into lens-fitted lightsensitive material packaging units, which were packaged with a packaging film. The photographic performance of obtained lens-fitted lightsensitive material packaging units was tested. Each of the resins was molded into the front cover 4, body base 3 and back cover 5.

The sample resins were produced according to the following procedures. The extruder employed in the production of sample resins was a vent type single-screw extruder of 100 mm screw diameter and of L/D=28. The extrusion temperature was 230° C.

(Preparation of Sample Resin 1)

A carbon master batch was produced by the known process as described in the Example portion of JP-A-6-130565. Specifically, 49% by weight of carbon black of 1.5 mg/g acetaldehyde gas equilibrium adsorption amount, 8.0 pH and 24 nm average particle diameter, 1% by weight of zinc stearate and 50% by weight of PS natural resin were mixed together and kneaded by means of a Banbury mixer. The mixture was milled by means of mixing rolls, thereby obtaining a rectangular high carbon content resin. Subsequently, 49% by weight of obtained high carbon content resin, 48.5% by weight of PS natural resin, 1.5% by weight of compound S-8 mentioned above and 1% by weight of zinc stearate were mixed together, and melted and kneaded by means of the above vent type single-screw extruder. Thus, cylindrical carbon master batch M1 was obtained. The carbon master batch M1 and PS natural resin were mixed at a ratio of 1:35 and extruded once through an extruder, thereby obtaining sample resin 1.

(Preparation of Sample Resin 2)

Sample resin 2 was prepared in the same manner as the above sample resin 1, except that, in place of the carbon master batch M1, carbon master batch M2 was produced using a carbon black of 2.1 mg/g acetaldehyde gas equilibrium adsorption amount, 7.5 pH and 16 nm average particle diameter.

(Preparation of Sample Resin 3)

Sample resin 3 was prepared in the same manner as the above sample resin 1, except that the above compound S-1 was employed in place of the compound S-8.

(Preparation of Sample Resin 4)

Sample resin 4 was prepared in the same manner as the above sample resin 2, except that the above compound S-1 was employed in place of the compound S-8.

(Preparation of Sample Resin 5)

Sample resin 5 was prepared in the same manner as the above sample resin 1, except that the extrusion by means of the same extruder was carried out five times to thereby effect a resin reclamation.

(Preparation of Sample Resin 6)

Sample resin 6 was prepared in the same manner as the above sample resin 2, except that, as in the preparation of the sample resin 5, the extrusion by means of the extruder was carried out five times to thereby effect a resin reclamation.

(Preparation of Sample Resin 7)

Sample resin 7 was prepared in the same manner as the above sample resin 3, except that, as in the preparation of the sample resin 5, the extrusion by means of the extruder was carried out five times to thereby effect a resin reclamation.

(Preparation of Sample Resin 8)

Sample resin 8 was prepared in the same manner as the above sample resin 4, except that, as in the preparation of the sample resin 5, the extrusion by means of the extruder was carried out five times to thereby effect a resin reclamation.

(Preparation of Sample Resin 9)

Sample resin 9 was prepared in the same manner as the above sample resin 1, except that the extrusion by means of the same extruder was carried out four times, followed by 1/30 supplemental addition of the carbon master batch resin M1 and by further extrusion performed once, to thereby effect a resin reclamation.

(Preparation of Sample Resin 10)

Sample resin 10 was prepared in the same manner as the above sample resin 2, except that the extrusion by means of the same extruder was carried out four times, followed by 1/30 supplemental addition of the carbon master batch resin M1 and by further extrusion performed once, to thereby effect a resin reclamation.

(Preparation of Sample Resin 11)

Sample resin 11 was prepared in the same manner as the above sample resin 1, except that, in place of the carbon master batch M1, a carbon master batch was produced using a carbon black of 0.6 mg/g acetaldehyde gas equilibrium adsorption amount and 28 nm average particle diameter, thereby obtaining a precursor resin, and except that the extrusion of the precursor resin by means of the same extruder was carried out four times, followed by 1/30 supplemental addition of the carbon master batch resin and by further extrusion performed once, to thereby effect a resin reclamation.

(Preparation of Sample Resin 12)

Sample resin 12 was prepared in the same manner as the above sample resin 1, except that, in place of the carbon master batch M1, a carbon master batch was produced using a carbon black of 3.2 mg/g acetaldehyde gas equilibrium adsorption amount and 12 nm average particle diameter, thereby obtaining a precursor resin, and except that the extrusion of the precursor resin by means of the same extruder was carried out four times, followed by 1/30 supplemental addition of the carbon master batch resin and by further extrusion performed once, to thereby effect a resin reclamation.

(Preparation of Sample Resin 13)

Sample resin 13 was prepared in the same manner as the above sample resin 1, except that the extrusion by means of the same extruder was carried out four times, followed by supplemental addition of the compound S-8 in the same amount as the reduction thereof caused by pyrolysis during the extrusions and followed by further extrusion performed once, to thereby effect a resin reclamation.

(Preparation of Sample Resin 14)

Sample resin 14 was prepared in the same manner as the above sample resin 3, except that the extrusion by means of the same extruder was carried out four times, followed by supplemental addition of the compound S-1 in the same amount as the reduction thereof caused by pyrolysis during the extrusions and followed by further extrusion performed once, to thereby effect a resin reclamation.

(Preparation of Sample Resin 15)

Sample resin 15 was prepared in the same manner as the above sample resin 1, except that antioxidant S-26 was added and that the extrusion of thus obtained precursor resin by means of the same extruder was carried out four times, followed by supplemental addition of the antioxidant S-26 in the same amount as the reduction thereof caused by pyrolysis during the extrusions and followed by further extrusion performed once, to thereby effect a resin reclamation.

(Preparation of Sample Resin 16)

Sample resin 16 was prepared in the same manner as the above sample resin 1, except that the above compound S-12 was used in place of the compound S-8 and that the extrusion of thus obtained precursor resin by means of the same extruder was carried out four times, followed by supplemental addition of the compound S-12 in the same amount as the reduction thereof caused by pyrolysis during the extrusions and followed by further extrusion performed once, to thereby effect a resin reclamation.

(Preparation of Sample Resin 17)

Sample resin 17 was prepared in the same manner as the above sample resin 1, except that the extrusion by means of the same extruder was carried out four times, followed by 1/30 supplemental addition of the carbon master batch resin M1 and further supplemental addition of the compound S-8 in the same amount as the reduction thereof caused by pyrolysis during the extrusions and followed by further extrusion performed once, to thereby effect a resin reclamation.

(Preparation of Sample Resin 18)

Sample resin 18 was prepared in the same manner as the above sample resin 2, except that the extrusion by means of the same extruder was carried out four times, followed by 1/30 supplemental addition of the carbon master batch resin M2 and further supplemental addition of the compound S-8 in the same amount as the reduction thereof caused by pyrolysis during the extrusions and followed by further extrusion performed once, to thereby effect a resin reclamation.

(Preparation of Sample Resin 19)

Sample resin 19 was prepared in the same manner as the above sample resin 3, except that the extrusion by means of the same extruder was carried out four times, followed by 1/30 supplemental addition of the carbon master batch resin M1 and further supplemental addition of the compound S-1 in the same amount as the reduction thereof caused by pyrolysis during the extrusions and followed by further extrusion performed once, to thereby effect a resin reclamation.

(Preparation of Sample Resin 20)

Sample resin 20 was prepared in the same manner as the above sample resin 4, except that the extrusion by means of the same extruder was carried out four times, followed by 1/30 supplemental addition of the carbon master batch resin M2 and further supplemental addition of the compound S-1 in the same amount as the reduction thereof caused by pyrolysis during the extrusions and followed by further extrusion performed once, to thereby effect a resin reclamation.

(Preparation of Sample Resin 21)

Sample resin 21 was prepared in the same manner as the above sample resin 14, except that the extrusion by means of the same extruder was carried out four times, followed by 1/30 supplemental addition of the carbon master batch resin M2 and further supplemental addition of the compound S-1 in the same amount as the reduction thereof caused by pyrolysis during the extrusions and followed by further extrusion performed once, to thereby effect a resin reclamation.

The particulars of these sample resins 1 to 21 are listed in Table 4. There, the adsorptive capacity of adsorbent (carbon black) was evaluated on the basis of the above equilibrium adsorption amount of acetaldehyde gas.

TABLE 4

Particularities of resins used in package unit

*Screened portion indicate the addition during reclaiming

| | Sample resin No. | | | | | | | | | |
|---|---|---|---|---|---|---|---|---|---|---|
| | 1 | 2 | 3 | 4 | 5 | 6 | 7 | 8 | 9 | 10 |
| Adsorbing ability (mg/g) | 1.5 | 2.1 | 1.5 | 2.1 | 1.5 | 2.1 | 1.5 | 2.1 | 1.5 | 2.1 |
| Compound added (M.W.) | S-8 (341) | S-8 (341) | S-1 (531) | S-1 (531) | S-8 (341) | S-8 (341) | S-1 (531) | S-1 (531) | S-8 (341) | S-8 (341) |
| History of extrusion (extrusion time) | 1 | 1 | 1 | 1 | 5 | 5 | 5 | 5 | 5 | 5 |
| Adsorbing ability of supplementally added resin (mg/g) | - | - | - | - | - | - | - | - | 1.5 | 1.5 |
| M.W. of supplementally added compound during reclaiming | - | - | - | - | - | - | - | - | - | - |
| Remarks | Comp. | Comp. | Comp. | Comp. | Comp. | Comp. | Comp. | Comp. | Inv. | Inv. |

TABLE 4-continued

Particularities of resins used in package unit
*Screened portion indicate the addition during reclaiming

| | Sample resin No. | | | | | | | | | | |
|---|---|---|---|---|---|---|---|---|---|---|---|
| | 11 | 12 | 13 | 14 | 15 | 16 | 17 | 18 | 19 | 20 | 21 |
| Adsorbing ability (mg/g) | 0.6 | 3.2 | 1.5 | 1.5 | 1.5 | 1.5 | 1.5 | 2.1 | 1.5 | 2.1 | 1.5 |
| compound added (M.W.) | S-8 (341) | S-8 (341) | S-8 (341) | S-1 (531) | S-26 (220) | S-12 (359) | S-8 (341) | S-8 (341) | S-1 (531) | S-1 (531) | S-1 (531) |
| History of extrusion (extrusion time) | 5 | 5 | 5 | 5 | 5 | 5 | 5 | 5 | 5 | 5 | 5 |
| Adsorbing ability of supplementally added resin (mg/g) | 0.6 | 1.2 | - | - | - | - | 1.5 | 2.1 | 1.5 | 2.1 | 2.1 |
| M.W. of supplementally added compound during reclaiming | - | - | S-8 (341) | S-1 (531) | S-26 (220) | S-12 (359) | S-8 (341) | S-8 (341) | S-1 (531) | S-1 (531) | S-1 (531) |
| Remarks | Inv. | Inv. | Inv. | Inv. | Inv. | Inv. | Inv. | Inv. | Inv. | Inv. | Inv. |

M.W. = Molecular weight

Subsequently, these sample resins were molded and assembled into lens-fitted packaging units, which were loaded with the samples 101 and 102. Thus, 42 types of lens-fitted lightsensitive material packaging units were obtained, and the photographic performance thereof was tested.

In particular, with respect to these lens-fitted lightsensitive material packaging units, the difference (Δfog) between minimum density exhibited when the following development processing was carried out immediately after the preparation and minimum density exhibited when, after storage in an atmosphere of 45° C. and 60% humidity for 30 days, the package was opened and the film was taken out from the unit and subjected to the development processing was determined. The smaller the value of difference, the favorably lower the degree of deterioration of photographic performance.

The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-3608 processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |

-continued (Processing steps)

| Step | Time | Temperature | Replenishment rate* | Tank volume |
|---|---|---|---|---|
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | [Tank solution] (g) | [Replenisher] (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |

-continued

| | [Tank solution] (g) | [Replenisher] (g) |
|---|---|---|
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixer (1) Tank Solution)

A 5:95 mixture (v/v) of the above bleaching tank solution and the below fixing tank solution pH 6.8

| (Fixer (2)) | [Tank solution] (g) | [Replenisher] (g) |
|---|---|---|
| Ammonium thiosulfate (750 g/L) | 240 mL | 720 mL |
| Imidazole | 7 | 21 |
| Ammonium Methanthiosulfonate | 5 | 15 |

-continued

| (Fixer (2)) | [Tank solution] (g) | [Replenisher] (g) |
|---|---|---|
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Sodium 1,2-benzisothiazoline-3-on | 0.10 |
| Disodium ethylenediamine tetraacetate | 0.05 |
| 1,2,4-triazole | 1.3 |
| 1,4-bis(1,2,4-triazole-l-ylmethyl) piperazine | 0.75 |
| Water to make | 1.0 L |
| pH | 8.5 |

With regard to the 42 types of the lens-fitted unit, difference in minimum value of each of yellow density, magenta density and cyan density are set forth in Table 5.

TABLE 5

Δ fogging of lens-fitted package unit

*Screened portion indicate the lens-fitted unit of the invention

| Photographic lightsensitive material No. (ISO speed) | | Sample resin No. | | | | | | | | | |
|---|---|---|---|---|---|---|---|---|---|---|---|
| | | 1 | 2 | 3 | 4 | 5 | 6 | 7 | 8 | 9 | 10 |
| 101 (1400) | R | 0.03 | 0.03 | 0.03 | 0.04 | 0.15 | 0.15 | 0.14 | 0.16 | 0.03 | 0.03 |
| | G | 0.04 | 0.04 | 0.04 | 0.04 | 0.17 | 0.18 | 0.16 | 0.19 | 0.04 | 0.04 |
| | B | 0.03 | 0.03 | 0.03 | 0.03 | 0.13 | 0.14 | 0.13 | 0.14 | 0.03 | 0.03 |
| 102 (1600) Emulsion of the invention was used | R | 0.05 | 0.06 | 0.04 | 0.05 | 0.25 | 0.26 | 0.22 | 0.27 | 0.05 | 0.06 |
| | G | 0.06 | 0.07 | 0.06 | 0.06 | 0.29 | 0.31 | 0.28 | 0.31 | 0.07 | 0.07 |
| | B | 0.04 | 0.05 | 0.04 | 0.05 | 0.21 | 0.24 | 0.21 | 0.18 | 0.04 | 0.06 |

TABLE 5-continued

Δ fogging of lens-fitted package unit
*Screened portion indicate the lens-fitted unit of the invention

| Photographic lightsensitive material No. (ISO speed) | | Sample resin No. | | | | | | | | | | |
|---|---|---|---|---|---|---|---|---|---|---|---|---|
| | | 11 | 12 | 13 | 14 | 15 | 16 | 17 | 18 | 19 | 20 | 21 |
| 101 (1400) | R | 0.04 | 0.03 | 0.03 | 0.03 | 0.04 | 0.03 | 0.03 | 0.03 | 0.03 | 0.03 | 0.03 |
| | G | 0.06 | 0.04 | 0.04 | 0.04 | 0.05 | 0.04 | 0.05 | 0.04 | 0.04 | 0.04 | 0.04 |
| | B | 0.03 | 0.03 | 0.04 | 0.03 | 0.03 | 0.03 | 0.03 | 0.03 | 0.03 | 0.03 | 0.03 |
| 102 (1600) Emulsion of the invention was used | R | 0.06 | 0.04 | 0.06 | 0.05 | 0.07 | 0.04 | 0.06 | 0.03 | 0.04 | 0.04 | 0.04 |
| | G | 0.07 | 0.05 | 0.07 | 0.06 | 0.08 | 0.06 | 0.06 | 0.04 | 0.06 | 0.04 | 0.06 |
| | B | 0.05 | 0.03 | 0.05 | 0.04 | 0.06 | 0.04 | 0.04 | 0.03 | 0.04 | 0.03 | 0.03 |

It is apparent from Table 5 that, in the use of a lightsensitive material highly sensitized with an emulsion of high aspect ratio such as the photographic lightsensitive material 101, fog occurs with the passage of storage time even if use is made of virgin resins such as sample resins 1 to 4. The deterioration of storage fog by reclaimed resins such as sample resins 5 to 8, although recognized with respect to samples including the photographic lightsensitive material 101, is far conspicuous with respect to the photographic lightsensitive material 102 including an emulsion of high aspect ratio.

However, with respect to the lens-fitted packaging units wherein the sample resins 9 to 21 of the present invention are combined with the photographic lightsensitive material 102, it is apparent that this problem is remedied. Hence, even if the reclaimed resins are to be employed, lens-fitted packaging units which are lessened in the storage life deterioration as compared with the use of virgin resins can be provided.

First, with respect to sample resins 9 to 12, there is recognized an improvement by the addition of carbon black as a substance capable of adsorbing substances having adverse effects on photographic properties at the time of reclamation. The effect of improvement is most conspicuous with respect to sample resin 12 exhibiting an acetaldehyde gas equilibrium adsorption amount of 2 mg/g or more.

Further, with respect to sample resins 13 to 16, an improvement is attained by the addition of a compound represented by the general formula (TS-I) or (TS-II) at the time of reclamation. The effect of improvement is more conspicuous in the use of sample resins 13, 14 and 16 wherein the molecular weight of compound is 300 or more than in the use of sample resin 15 wherein the molecular weight of compound is less than 300.

It is apparent from the results of sample resins 17 to 21 that adding both carbon black and a compound represented by the general formula (TS-I) or (TS-II) at the time of reclamation is especially preferred.

Example 2

Samples 201 to 206 with respective ISO speeds were prepared in the same manner as the sample 102 of Example 1, except that, in the emulsion layers, silver halide emulsions Em-B to D, F to J and L to 0 were used in the silver quantities as specified in Table 6.

TABLE 6

| | Sample No. | | | | | | |
|---|---|---|---|---|---|---|---|
| ISO Speed | 201 100 | 202 200 | 203 400 | 204 500 | 205 640 | 206 800 | 102 1600 |
| 4th layer | D 0.64 | D 0.67 | D 0.64 | D 0.44<br>C 0.35 | D 0.46<br>C 0.39 | D 0.50<br>C 0.42 | D 0.47<br>C 0.57 |
| 5th layer | C 0.76 | C 0.82 | C 0.87 | B 0.88 | B 0.90 | B 0.93 | B 0.63 |
| 6th layer | B 1.51 | B 1.70 | O 0.79<br>B 0.79 | O 1.20 | O 1.25 | O 1.29 | Em-2 1.27 |
| 8th layer | R 0.54 | R 0.55 | R 0.59 | Q 0.30 | Q 0.30 | Q 0.31 | J 0.40 |
| 9th layer | H 0.2<br>I 0.31 | H 0.30<br>I 0.32 | H 0.39<br>I 0.39 | H 0.18<br>G 0.27<br>I 0.48 | H 0.20<br>G 0.30<br>I 0.45 | H 0.22<br>G 0.45<br>I 0.31 | H 0.23<br>G 0.15<br>I 0.26 |
| 10th layer | H 0.31 | H 0.41 | G 0.23<br>H 0.23 | G 0.30<br>H 0.18 | G 0.41 | G 0.40 | F 0.42 |
| 11th layer | G 0.86 | G 0.90 | G 0.47<br>F 0.47 | F 0.83 | F 0.85 | F 0.87 | Em-3 0.95 |

TABLE 6-continued

| | Sample No. | | | | | | |
|---|---|---|---|---|---|---|---|
| ISO Speed | 201 100 | 202 200 | 203 400 | 204 500 | 205 640 | 206 800 | 102 1600 |
| 13th layer | N 0.12<br>M 0.23 | N 0.10<br>M 0.28 | N 0.16<br>M 0.21<br>L 0.05 | N 0.16<br>M 0.19<br>L 0.22 | N 0.15<br>M 0.20<br>L 0.24 | N 0.13<br>M 0.12<br>L 0.39 | N 0.12<br>M 0.09<br>L 0.50 |
| 14th layer | L 0.72 | L 0.75 | L 0.79 | P 0.50<br>L 0.40 | P 0.80<br>L 0.10 | P 0.91 | Em-1 1.22 |

Subsequently, the samples 201 to 206 were charged into the same lens-fitted packaging units as fabricated in Example 1, and the photographic performance thereof was tested. The same evaluation as in Example 1 was carried out, that is, the evaluation was made on the basis of the difference between minimum density before storage and minimum density after storage. Results represented by magenta density are listed in Table 7.

640 ISO speed. It is also apparent that the fog variation is reduced by the supplemental addition of carbon black or a compound capable of suppressing the generation of harmful gases to reclaimed resins, and that, although the individual use of carbon black and the compound is favorably effective in reducing the fog variation, it is preferred to effect the supplemental addition of both of them.

TABLE 7

| Photographic material | | Difference in fogging of each sample resin | | | | | | | | | |
|---|---|---|---|---|---|---|---|---|---|---|---|
| Sample NO. | ISO speed | 1 | 2 | 3 | 4 | 5 | 6 | 7 | 8 | 9 | 10 |
| 201 | 100 | 0.03 | 0.04 | 0.03 | 0.02 | 0.05 | 0.03 | 0.02 | 0.03 | 0.03 | 0.02 |
| 202 | 200 | 0.02 | 0.03 | 0.02 | 0.01 | 0.03 | 0.03 | 0.03 | 0.03 | 0.03 | 0.03 |
| 203 | 400 | 0.02 | 0.02 | 0.01 | 0.02 | 0.04 | 0.04 | 0.03 | 0.02 | 0.03 | 0.02 |
| 204 | 500 | 0.03 | 0.04 | 0.02 | 0.03 | 0.05 | 0.05 | 0.03 | 0.03 | 0.03 | 0.03 |
| 205 | 640 | 0.03 | 0.03 | 0.03 | 0.02 | 0.13 | 0.12 | 0.10 | 0.09 | 0.04 | 0.05 |
| 206 | 800 | 0.04 | 0.02 | 0.02 | 0.02 | 0.24 | 0.21 | 0.19 | 0.19 | 0.06 | 0.06 |
| 102 | 1600 | 0.06 | 0.07 | 0.06 | 0.06 | 0.29 | 0.31 | 0.28 | 0.31 | 0.07 | 0.07 |

| Photographic material | | Difference in fogging of each sample resin | | | | | | | | | | |
|---|---|---|---|---|---|---|---|---|---|---|---|---|
| Sample NO. | ISO speed | 11 | 12 | 13 | 14 | 15 | 16 | 17 | 18 | 19 | 20 | 21 |
| 201 | 100 | 0.04 | 0.04 | 0.04 | 0.02 | 0.03 | 0.04 | 0.03 | 0.03 | 0.02 | 0.02 | 0.02 |
| 202 | 200 | 0.04 | 0.03 | 0.02 | 0.02 | 0.04 | 0.03 | 0.03 | 0.02 | 0.02 | 0.02 | 0.02 |
| 203 | 400 | 0.06 | 0.04 | 0.03 | 0.02 | 0.04 | 0.03 | 0.02 | 0.03 | 0.03 | 0.02 | 0.01 |
| 204 | 500 | 0.07 | 0.03 | 0.03 | 0.03 | 0.04 | 0.03 | 0.02 | 0.02 | 0.02 | 0.02 | 0.02 |
| 205 | 640 | 0.06 | 0.04 | 0.05 | 0.05 | 0.04 | 0.05 | 0.03 | 0.04 | 0.02 | 0.02 | 0.02 |
| 206 | 800 | 0.07 | 0.05 | 0.07 | 0.07 | 0.06 | 0.07 | 0.04 | 0.04 | 0.03 | 0.02 | 0.0 |
| 102 | 1600 | 0.07 | 0.05 | 0.07 | 0.06 | 0.08 | 0.06 | 0.06 | 0.04 | 0.06 | 0.04 | 0.06 |

Preferred embodiment of the invention

It is apparent from Table 7 that, when reclaimed resins are employed, the fog variation is extremely large with respect to the samples of 640 or more ISO speed, but the effect of fog variation is slight with respect to the samples of less than It is further apparent that carbon black exhibiting an acetaldehyde gas equilibrium adsorption amount of 2 mg/g or more is preferred and that the molecular weight of compound is preferably 300 or more.

Example 3

Samples 301 to 313 as specified in Table 8 were produced in the same manner as the sample 204 of Example 2, except that the silver content was changed by changing the amount of emulsion in the 4th, 5th, 6th, 8th, 9th, 10th, 11th, 13th and 14th layers.

In the production thereof, the silver content and gelatin quantity in each of the layers were altered so as to attain desired ISO speed and film thickness.

The samples 301 to 313 were charged into lens-fitted packaging units wherein the same sample resins as in Example 1 were employed to thereby obtain lens-fitted lightsensitive material packaging units, and the same photographic performance evaluation as in Example 2 was conducted, thereby determining fog variations. The measuring results are listed in Table 8.

TABLE 8

| Photographic material | | | | Difference in fogging of each sample resin | | | | | | | | | |
|---|---|---|---|---|---|---|---|---|---|---|---|---|---|
| Sample No. | Silver content g/m$^2$ | ISO speed | Layer thickness μm | 1 | 2 | 3 | 4 | 5 | 6 | 7 | 8 | 9 | 10 |
| 301 | 4.52 | 400 | 21.8 | 0.03 | 0.02 | 0.03 | 0.02 | 0.02 | 0.03 | 0.02 | 0.03 | 0.03 | 0.02 |
| 302 | 5.01 | 400 | 21.8 | 0.02 | 0.03 | 0.02 | 0.02 | 0.03 | 0.04 | 0.03 | 0.03 | 0.03 | 0.03 |
| 303 | 5.95 | 500 | 21.9 | 0.02 | 0.02 | 0.03 | 0.02 | 0.03 | 0.02 | 0.03 | 0.02 | 0.03 | 0.02 |
| 304 | 6.03 | 500 | 21.9 | 0.02 | 0.03 | 0.03 | 0.02 | 0.11 | 0.10 | 0.10 | 0.09 | 0.06 | 0.05 |
| 305 | 6.90 | 500 | 21.9 | 0.04 | 0.02 | 0.02 | 0.02 | 0.16 | 0.16 | 0.15 | 0.14 | 0.09 | 0.07 |
| 306 | 7.72 | 500 | 21.9 | 0.03 | 0.02 | 0.02 | 0.02 | 0.19 | 0.19 | 0.18 | 0.18 | 0.11 | 0.08 |
| 307 | 8.12 | 500 | 21.9 | 0.03 | 0.03 | 0.02 | 0.03 | 0.24 | 0.24 | 0.23 | 0.23 | 0.15 | 0.12 |
| 308 | 9.03 | 500 | 21.9 | 0.04 | 0.03 | 0.03 | 0.03 | 0.31 | 0.36 | 0.30 | 0.30 | 0.21 | 0.18 |
| 309 | 9.95 | 500 | 21.9 | 0.03 | 0.03 | 0.02 | 0.02 | 0.48 | 0.42 | 0.41 | 0.41 | 0.34 | 0.30 |
| 310 | 6.90 | 640 | 21.9 | 0.03 | 0.02 | 0.02 | 0.02 | 0.21 | 0.20 | 0.19 | 0.19 | 0.12 | 0.10 |
| 311 | 6.90 | 640 | 23.4 | 0.03 | 0.02 | 0.02 | 0.02 | 0.21 | 0.20 | 0.19 | 0.19 | 0.12 | 0.09 |
| 312 | 7.72 | 800 | 23.8 | 0.03 | 0.02 | 0.02 | 0.02 | 0.22 | 0.20 | 0.20 | 0.21 | 0.12 | 0.09 |
| 313 | 10.21 | 500 | 21.9 | 0.05 | 0.04 | 0.04 | 0.04 | 0.59 | 0.51 | 0.49 | 0.50 | 0.49 | 0.49 |

| Photographic material | | | | Difference in fogging of each sample resin | | | | | | | | | | |
|---|---|---|---|---|---|---|---|---|---|---|---|---|---|---|
| Sample No. | Silver content g/m$^2$ | ISO speed | Layer thickness μm | 11 | 12 | 13 | 14 | 15 | 16 | 17 | 18 | 19 | 20 | 21 |
| 301 | 4.52 | 400 | 21.8 | 0.03 | 0.02 | 0.03 | 0.02 | 0.02 | 0.03 | 0.02 | 0.03 | 0.02 | 0.03 | 0.02 |
| 302 | 5.01 | 400 | 21.8 | 0.03 | 0.03 | 0.04 | 0.02 | 0.04 | 0.03 | 0.03 | 0.02 | 0.03 | 0.02 | 0.02 |
| 303 | 5.95 | 500 | 21.9 | 0.02 | 0.02 | 0.03 | 0.02 | 0.02 | 0.02 | 0.02 | 0.05 | 0.03 | 0.02 | 0.02 |

TABLE 8-continued

| | | | | | | | | | | | | | | |
|---|---|---|---|---|---|---|---|---|---|---|---|---|---|---|
| 304 | 6.03 | 500 | 21.9 | 0.06 | 0.04 | 0.07 | 0.05 | 0.07 | 0.05 | 0.03 | 0.03 | 0.02 | 0.02 | 0.02 |
| 305 | 6.90 | 500 | 21.9 | 0.08 | 0.06 | 0.08 | 0.06 | 0.09 | 0.05 | 0.03 | 0.03 | 0.02 | 0.02 | 0.02 |
| 306 | 7.72 | 500 | 21.9 | 0.10 | 0.08 | 0.10 | 0.07 | 0.11 | 0.06 | 0.04 | 0.05 | 0.03 | 0.02 | 0.02 |
| 307 | 8.12 | 500 | 21.9 | 0.15 | 0.10 | 0.14 | 0.10 | 0.19 | 0.09 | 0.05 | 0.04 | 0.04 | 0.03 | 0.03 |
| 308 | 9.03 | 500 | 21.9 | 0.28 | 0.17 | 0.24 | 0.15 | 0.22 | 0.16 | 0.10 | 0.08 | 0.08 | 0.06 | 0.06 |
| 309 | 9.95 | 500 | 21.9 | 0.35 | 0.27 | 0.33 | 0.27 | 0.32 | 0.25 | 0.21 | 0.18 | 0.15 | 0.12 | 0.12 |
| 310 | 6.90 | 640 | 21.9 | 0.10 | 0.09 | 0.12 | 0.07 | 0.11 | 0.13 | 0.04 | 0.03 | 0.03 | 0.02 | 0.02 |
| 311 | 6.90 | 640 | 23.4 | 0.10 | 0.09 | 0.14 | 0.07 | 0.11 | 0.08 | 0.04 | 0.03 | 0.03 | 0.02 | 0.02 |
| 312 | 7.72 | 800 | 23.8 | 0.15 | 0.08 | 0.12 | 0.07 | 0.11 | 0.08 | 0.04 | 0.03 | 0.03 | 0.02 | 0.02 |
| 313 | 10.21 | 500 | 21.9 | 0.55 | 0.55 | 0.57 | 0.48 | 0.58 | 0.56 | 0.56 | 0.54 | 0.48 | 0.48 | 0.49 |

Preferred embodiment of the invention

It is apparent from Table 8 that, when reclaimed resins are employed, the fog variation is extremely large with respect to the samples of 6 g/m$^2$ or more silver content, but the effect of fog variation is slight with respect to the samples of less silver content.

It is also apparent that, with respect to the samples of 6 to 10 g/m$^2$ silver content, the fog variation is reduced by the same supplemental addition of carbon black and a compound capable of suppressing the generation of harmful gases as in Example 1.

Example 4

Samples 401 to 414 having different film thicknesses as specified in Table 9 were produced in the same manner as the sample 303 of Example 3, except that the amount of gelatin was altered in each of the layers.

The silver content of each of the layers was altered so as to attain desired ISO speed and silver quantity.

The samples 401 to 414 were charged into lens-fitted packaging units wherein the same sample resins as in Example 1 were employed to thereby obtain lens-fitted lightsensitive material packaging units, and the same photographic performance evaluation as in Example 2 was conducted, thereby determining fog variations and further determining fog unevenness.

The fog unevenness was determined by visually inspecting the samples after processing. The measuring results are listed in Table 9.

TABLE 9

| Photographic material | | | | Difference in fogging of each sample resin | | | | | | | | | |
|---|---|---|---|---|---|---|---|---|---|---|---|---|---|
| Sample No. | Layer thickness | ISO speed | Silver content g/m$^2$ | 1 | 2 | 3 | 4 | 5 | 6 | 7 | 8 | 9 | 10 |
| 401 | 18.0 | 400 | 5.94 | ◎ | ◎ | ◎ | ◎ | ○ | ○ | ○ | ○ | ○ | ○ |
| 402 | 19.9 | 400 | 5.95 | ◎ | ◎ | ◎ | ◎ | ○ | ○ | ○ | ○ | ○ | ○ |
| 403 | 20.9 | 500 | 5.95 | ◎ | ◎ | ◎ | ◎ | ○ | ○ | ○ | ○ | ○ | ○ |
| 404 | 21.8 | 500 | 5.94 | ◎ | ◎ | ◎ | ◎ | ○ | ○ | ○ | ○ | ○ | ○ |

TABLE 9-continued

| | | | | | | | | | | | | | |
|---|---|---|---|---|---|---|---|---|---|---|---|---|---|
| 405 | 22.1 | 500 | 5.96 | ◎ | ◎ | ◎ | ◎ | × | × | × | × | ○ | ○ |
| 406 | 23.2 | 500 | 5.96 | ◎ | ◎ | ◎ | ◎ | × | × | × | × | ○ | ○ |
| 407 | 23.8 | 500 | 5.99 | ◎ | ◎ | ◎ | ◎ | × | × | × | × | ○ | ○ |
| 408 | 24.8 | 500 | 5.95 | ◎ | ◎ | ◎ | ◎ | × | × | × | × | ○ | ○ |
| 409 | 25.5 | 500 | 5.95 | ◎ | ◎ | ◎ | ◎ | × | × | × | × | ○ | ○ |
| 410 | 26.8 | 500 | 5.97 | ◎ | ◎ | ◎ | ◎ | × | × | × | × | ○ | ○ |
| 411 | 28.3 | 500 | 5.98 | ◎ | ◎ | ◎ | ◎ | × | × | × | × | ○ | ○ |
| 412 | 23.8 | 640 | 6.40 | ◎ | ◎ | ◎ | ◎ | × | × | × | × | ○ | ○ |
| 413 | 24.1 | 800 | 7.72 | ◎ | ◎ | ◎ | ◎ | × | × | × | × | ○ | ○ |
| 414 | 24.8 | 1600 | 8.12 | ◎ | ◎ | ◎ | ◎ | × | × | × | × | ○ | ○ |

| Photographic material | | | | Difference in fogging of each sample resin | | | | | | | | | | |
|---|---|---|---|---|---|---|---|---|---|---|---|---|---|---|
| Sample No. | Layer thick-ness | ISO speed | Silver content g/m$^2$ | 11 | 12 | 13 | 14 | 15 | 16 | 17 | 18 | 19 | 20 | 21 |
| 401 | 18.0 | 400 | 5.94 | ○ | ○ | ○ | ○ | ○ | ○ | ◎ | ◎ | ◎ | ◎ | ◎ |
| 402 | 19.9 | 400 | 5.95 | ○ | ○ | ○ | ○ | ○ | ○ | ◎ | ◎ | ◎ | ◎ | ◎ |
| 403 | 20.9 | 500 | 5.95 | ○ | ○ | ○ | ○ | ○ | ○ | ◎ | ◎ | ◎ | ◎ | ◎ |
| 404 | 21.8 | 500 | 5.94 | ○ | ○ | ○ | ○ | ○ | ○ | ◎ | ◎ | ◎ | ◎ | ◎ |
| 405 | 22.1 | 500 | 5.96 | ○ | ○ | ○ | ○ | ○ | ○ | ◎ | ◎ | ◎ | ◎ | ◎ |
| 406 | 23.2 | 500 | 5.96 | ○ | ○ | ○ | ○ | ○ | ○ | ◎ | ◎ | ◎ | ◎ | ◎ |
| 407 | 23.8 | 500 | 5.99 | ○ | ○ | ○ | ○ | ○ | ○ | ◎ | ◎ | ◎ | ◎ | ◎ |
| 408 | 24.8 | 500 | 5.95 | ○ | ○ | ○ | ○ | ○ | ○ | ◎ | ◎ | ◎ | ◎ | ◎ |
| 409 | 25.5 | 500 | 5.95 | ○ | ○ | ○ | ○ | ○ | ○ | ◎ | ◎ | ◎ | ◎ | ◎ |
| 410 | 26.8 | 500 | 5.97 | ○ | ○ | ○ | ○ | ○ | ○ | ◎ | ◎ | ◎ | ◎ | ◎ |
| 411 | 28.3 | 500 | 5.98 | ○ | ○ | ○ | ○ | ○ | ○ | ◎ | ◎ | ◎ | ◎ | ◎ |
| 412 | 23.8 | 640 | 6.40 | ○ | ○ | ○ | ○ | ○ | ○ | ◎ | ◎ | ◎ | ◎ | ◎ |
| 413 | 24.1 | 800 | 7.72 | ○ | ○ | ○ | ○ | ○ | ○ | ◎ | ◎ | ◎ | ◎ | ◎ |
| 414 | 24.8 | 1600 | 8.12 | ○ | ○ | ○ | ○ | ○ | ○ | ◎ | ◎ | ◎ | ◎ | ◎ |

◎ : Fog increase of 0.03 or less occurred. No fog streak.

○ : Fog increase of 0.04 or more occurred. No fog streak.

× : Fog increase occurred. Fog streak occurred.

Preferred embodiment of the invention

As apparent from Table 9, a slight fog increase by the use of reclaimed resin is recognized with respect to all the samples. Although a uniform fog increase is recognized with respect to samples of 22 $\mu$m or less film thickness, an uneven fog unfavorably occurs with respect to samples of more than 22 $\mu$m film thickness. It has been found that the supplemental addition of carbon black and a compound capable of suppressing the generation of harmful gases renders the fog increase uniform with respect to samples of more than 22 $\mu$m film thickness as well.

Example 5

In the samples prepared in Examples 1, 2, 3 and 4, the support of Example 3 of JP-A-10-293373 was employed in place of the support of cellulose triacetate film, and the samples were formed into APS Format cartridges. The sample resins 1 to 21 were used in the body of Utsurundesu (Quick Snap) Super Eye 800 Flash 25 produced by Fuji Photo Film Co., Ltd., and evaluations were effected. Similar results were obtained with respect to all of the Examples 1, 2, 3 and 4.

Additional advantages and modifications will readily occur to those skilled in the art. Therefore, the invention in its broader aspects is not limited to the specific details and representative embodiments shown and described herein. Accordingly, various modifications may be made without departing from the spirit or cope of the general inventive concept as defined by the appended claims and their equivalents.

What is claimed is:

1. A lightsensitive material package containing a silver halide color photographic lightsensitive material and a plastic material member, wherein the photographic lightsensitive material having at least one red-sensitive, at least one green-sensitive and at least one blue-sensitive silver halide emulsion layer on a support; the plastic material member being constituted of a thermoplastic reclaimed resin, and the photographic lightsensitive material and the plastic material member being arranged in a common gas-phase atmosphere and sealed in the package;

wherein 60% or more of the total projected area of silver halide grains contained in at least one of the red-, green- and blue-sensitive silver halide emulsion layers is occupied by tabular silver halide grains having an aspect ratio of 8.0 or more, and wherein the plastic material member is that produced from a resin to which a substance capable of adsorbing a substance having an adverse effect on a photographic property has been supplementally added prior to molding thereof.

2. The lightsensitive material package according to claim 1, wherein the tabular silver halide grains each have 10 or more dislocation lines per grain.

3. The lightsensitive material package according to claim 2, wherein the substance capable of adsorbing a substance having adverse effects on photographic properties is carbon black having an acetaldehyde gas equilibrium adsorption amount of 2 mg/g or more.

4. The lightsensitive material package according to claim 1, wherein the photographic lightsensitive material has an ISO speed of 640 or more.

5. The lightsensitive material package according to claim 4, wherein the substance capable of adsorbing a substance having adverse effects on photographic properties is carbon black having an acetaldehyde gas equilibrium adsorption amount of 2 mg/g or more.

6. The lightsensitive material package according to claim 1, wherein the silver halide color photographic lightsensitive material has a silver content of 6 to 10 g/m$^2$.

7. The lightsensitive material package according to claim 6, wherein the substance capable of adsorbing a substance having adverse effects on photographic properties is carbon black having an acetaldehyde gas equilibrium adsorption amount of 2 mg/g or more.

8. The lightsensitive material package according to claim 1, wherein the total thickness of all hydrophilic colloid layers of the photographic lightsensitive material on its side of the lightsensitive silver halide layers, is 22 $\mu$m or more.

9. The lightsensitive material package according to claim 1, wherein the plastic material member is that produced from a resin to which a compound represented by the following general formula (TS-I) and/or (TS-II) has been supplementally added prior to molding thereof:

(TS-I)

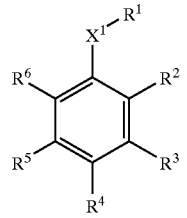

(TS-II)

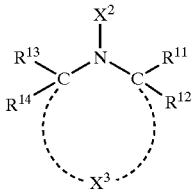

wherein in the formula (TS-I), $R^1$ represents a hydrogen atom, a substituted or unsubstituted alkyl group (including cycloalkyl and bicycloalkyl groups), substituted or unsubstituted alkenyl group (including cycloalkenyl and bicycloalkenyl groups), substituted or unsubstituted aryl group, substituted or unsubstituted heterocyclic group, substituted or unsubstituted acyl group, substituted or unsubstituted alkoxycarbonyl group (including those whose alkyl moiety is cycloalkyl or bicycloalkyl), substituted or unsubstituted aryloxycarbonyl group, substituted or unsubstituted alkylsulfonyl group (including cycloalkylsulfonyl and bicycloalkylsulfonyl groups), substituted or unsubstituted arylsulfonyl group, substituted or unsubstituted phosphino group, substituted or unsubstituted phosphinoyl group, or a group of the formula —Si($R^{21}$)($R^{22}$)($R^{23}$), wherein each of $R^{21}$, $R^{22}$ and $R^{23}$ independently represents a substituted or unsubstituted alkyl group, substituted or unsubstituted aryl group, substituted or unsubstituted alkoxy group, substituted or unsubstituted alkenyloxy group, or substituted or unsubstituted aryloxy group; —$X^1$—represents —O—, —S—or —N($R^{24}$)—, wherein $R^{24}$ has the same meaning as $R^1$; and $R^2$, $R^3$, $R^4$, $R^5$ and $R^6$ may be the same or different from each other, and each thereof represents a hydrogen atom or a substituent, provided that $R^1$ and $R^2$, or $R^{24}$ and $R^6$, or $R^1$ and $R^{24}$, may be bonded with each other to thereby form a 5- to 7-membered ring, provided that $R^2$ and $R^3$, or $R^3$ and $R^4$, or $R^4$ and $R^5$, or $R^5$ and $R^6$, may be bonded with each other to thereby form a 5- to 7-membered ring, or spiro ring or bicyclo ring, and provided that $R^1$, $R^2$, $R^3$, $R^4$, $R^5$, $R^6$ and $R^{24}$ are not simultaneously hydrogen atoms; and in the formula (TS-II), each of $R^{11}$, $R^{12}$ $R^{13}$ and $R^{14}$ independently represents a hydrogen atom, an alkyl group (including cycloalkyl and bicycloalkyl groups), or alkenyl group (including cycloalkenyl and bicycloalkenyl groups), provided that $R^{11}$ and $R^{12}$, or $R^{13}$ and $R^{14}$, may be bonded with each other to thereby form a 5- to 7-membered ring; $X^2$ represents a hydrogen atom, an alkyl group (including cycloalkyl and bicycloalkyl groups), alkenyl group (including cycloalkenyl and bicycloalkenyl groups), alkoxy group (including cycloalkyloxy and bicycloalkyloxy groups), alkenyloxy group (including cycloalkyenyloxy and bicycloalkenyloxy groups), alkyl- and alkenyloxycarbonyl groups (including those whose alkyl moiety is cycloalkyl and bicycloalkyl, and those whose alkenyl moiety is cycloalkenyl and bicycloalkenyl), aryloxycarbonyl group, acyl group, acyloxy group, alkyloxycarbonyloxy group (including those whose alkyl moiety is cycloalkyl and bicycloalkyl), alkenyloxycarbonyloxy group (including those whose alkenyl moiety is cycloalkyenl and bicycloalkyenyl), aryloxycarbonyloxy group, alkyl- and alkenylsulfonyl groups (including those whose alkyl moiety is cycloalkyl and bicycloalkyl, and those whose alkenyl moiety is cycloalkenyl and bicycloalkenyl), arylsulfonyl group, alkyl- and alkenylsulfinyl groups (including those whose alkyl moiety is cycloalkyl and bicycloalkyl, and those whose alkenyl moiety is cycloalkenyl and bicycloalkenyl), arylsulfinyl group, sulfamoyl group, carbamoyl group, hydroxyl group, or oxy radical group; and $X^3$ represents a group of non-metallic atoms required for forming a 5- to 7-membered ring.

10. The lightsensitive material package according to claim 1, wherein the substance capable of adsorbing a substance having adverse effects on photographic properties is carbon black having an acetaldehyde gas equilibrium adsorption amount of 2 mg/g or more.

11. A lightsensitive material package containing a silver halide color photographic lightsensitive material and a plastic material member, wherein the photographic lightsensitive material having at least one red-sensitive, at least one green-sensitive and at least one blue-sensitive silver halide emulsion layer on a support; the plastic material member being constituted of a thermoplastic reclaimed resin; and the photographic lightsensitive material and the plastic material being arranged in a common gas-phase atmosphere and sealed in the package;

wherein 60% or more of the total projected area of silver halide grains contained in at least one of the red-, green- and blue-sensitive silver halide emulsion layers is occupied by tabular silver halide grains having an aspect ratio of 8.0 or more; and wherein the plastic material member is that produced from a resin to which a compound represented by the general formula (TS-I) and/or (TS-II) of claim 9 has been supplementally added prior to molding thereof.

12. The lightsensitive material package according to claim 11, wherein the tabular silver halide grains each have 10 or more dislocation lines per grain.

13. The lightsensitive material package according to claim 12, wherein the compound represented by the general formula (TS-I) or (TS-II) has a molecular weight of 300 or more.

14. The lightsensitive material package according to claim 11, wherein the photographic lightsensitive material has an ISO speed of 640 or more.

15. The lightsensitive material package according to claim 14, wherein the compound represented by the general formula (TS-I) or (TS-II) has a molecular weight of 300 or more.

16. The lightsensitive material package according to claim 11, wherein the silver halide color photographic lightsensitive material has a silver content of 6 to 10 $g/m^2$.

17. The lightsensitive material package according to claim 16, wherein the compound represented by the general formula (TS-I) or (TS-II) has a molecular weight of 300 or more.

18. The lightsensitive material package according to claim 11, wherein the total thickness of all hydrophilic colloid layers of the photographic lightsensitive material on its side of the lightsensitive silver halide layers, is 22 $\mu$m or more.

19. The lightsensitive material package according to claim 11, wherein the plastic material member is that produced from a resin to which a substance capable of adsorbing a substance having an adverse effect on a photographic property has been supplementally added prior to molding thereof.

20. The lightsensitive material package according to claim 11, wherein the compound represented by the general formula (TS-I) or (TS-II) has a molecular weight of 300 or more.

* * * * *